US009532626B2

(12) United States Patent
Lovett et al.

(10) Patent No.: US 9,532,626 B2
(45) Date of Patent: Jan. 3, 2017

(54) METHODS AND DEVICES FOR RETROFITTING FOOTWEAR TO INCLUDE A REEL BASED CLOSURE SYSTEM

(71) Applicant: Boa Technology Inc., Denver, CO (US)

(72) Inventors: Kristopher C. Lovett, Denver, CO (US); Christopher H. Converse, Boulder, CO (US); Clark Morgan, Denver, CO (US); Michael J. Nickel, Golden, CO (US)

(73) Assignee: Boa Technology, Inc., Denver, CO (US)

( * ) Notice: Subject to any disclaimer, the term of this patent is extended or adjusted under 35 U.S.C. 154(b) by 316 days.

(21) Appl. No.: 14/242,629

(22) Filed: Apr. 1, 2014

(65) Prior Publication Data

US 2014/0290016 A1 Oct. 2, 2014

Related U.S. Application Data

(60) Provisional application No. 61/807,251, filed on Apr. 1, 2013.

(51) Int. Cl.
*A43C 11/20* (2006.01)
*A43C 1/04* (2006.01)
(Continued)

(52) U.S. Cl.
CPC ..... *A43C 11/20* (2013.01); *A43B 19/005* (2013.01); *A43C 1/04* (2013.01); *A43C 3/00* (2013.01);
(Continued)

(58) Field of Classification Search
CPC ..... A43C 1/04; A43C 1/00; A43C 5/00; A43C 11/20
(Continued)

(56) References Cited

U.S. PATENT DOCUMENTS 59,332 A 10/1866 White et al.
80,834 A 8/1868 Prussia
(Continued)

FOREIGN PATENT DOCUMENTS

AT 127075 2/1932
AT 244804 1/1966
(Continued)

OTHER PUBLICATIONS

ASOLO® Boot Brochure Catalog upon information and belief date is as early as Aug. 22, 1997.
(Continued)

*Primary Examiner* — Marie Bays
(74) *Attorney, Agent, or Firm* — Kilpatrick Townsend & Stockton LLP

(57) ABSTRACT

According to one embodiment, a removable tightening device is described. The tensioning mechanism is removably coupleable with an article without damaging the article so that upon removal, the coupling of the tensioning mechanism with the article is unrecognizable or not readily detectable. The tensioning mechanism is operable with a tension member to maintain a tension of the tension member and thereby maintain a tightness of the article. The tension member is guided along a path about the article, via one or more guide members, and is tensionable, via the tensioning mechanism, to tighten the article.

37 Claims, 53 Drawing Sheets

(51) Int. Cl.

| | |
|---|---|
| ***A43C 5/00*** | (2006.01) |
| ***A43B 19/00*** | (2006.01) |
| ***A43C 3/00*** | (2006.01) |
| ***A43C 3/02*** | (2006.01) |
| ***A43C 11/16*** | (2006.01) |

(52) U.S. Cl.
CPC . *A43C 3/02* (2013.01); *A43C 5/00* (2013.01); *A43C 11/165* (2013.01); *Y10T 24/3739* (2015.01); *Y10T 29/49826* (2015.01)

(58) Field of Classification Search
USPC ..... 36/50.1, 50.5; 24/713.6, 713.8, 714.4, 24/714.6, 714.7
See application file for complete search history.

(56) References Cited

U.S. PATENT DOCUMENTS 117,530 A 8/1871 Foote
228,946 A 6/1880 Schulz
230,759 A 8/1880 Drummond
301,854 A * 7/1884 Buch ..... A43C 3/00 24/714.6
371,394 A * 10/1887 Warren ..... A43C 1/04 24/714.7
379,113 A 3/1888 Hibberd
460,743 A * 10/1891 Dickson, Jr. ..... A43C 1/02 24/712.4
746,563 A 12/1903 McMahon
819,993 A 5/1906 Haws et al.
886,779 A * 5/1908 Dunstan ..... A43C 5/00 24/713.5
908,704 A 1/1909 Sprinkle
1,170,472 A 2/1916 Barber
1,288,859 A 12/1918 Feller et al.
1,390,991 A 9/1921 Fotchuk
1,393,188 A 10/1921 Whiteman
1,469,661 A 2/1922 Migita
1,412,486 A 4/1922 Paine
1,416,203 A 5/1922 Hobson
1,429,657 A 9/1922 Trawinski
1,481,903 A 4/1923 Hart
1,466,673 A 9/1923 Solomon et al.
1,530,713 A 2/1924 Clark
1,502,919 A 7/1924 Seib
1,505,430 A * 8/1924 Roberts ..... A43C 3/02 24/714.8
1,548,407 A * 8/1925 Chisholm ..... A43C 5/00 24/714.9
1,862,047 A 6/1932 Boulet et al.
1,995,243 A 6/1934 Clarke
2,088,851 A 8/1937 Gantenbein
2,109,751 A 3/1938 Matthias et al.
2,124,310 A 9/1938 Murr Jr.
2,316,102 A 4/1943 Preston
2,539,026 A 1/1951 Mangold
2,611,940 A 9/1952 Cairns
2,673,381 A 3/1954 Dueker
2,893,090 A * 7/1959 Pagoda ..... A43C 7/00 24/132 AA
2,907,086 A 10/1959 Ord
2,991,523 A 7/1961 Del Conte
3,028,602 A 4/1962 Miller
3,035,319 A 5/1962 Wolff
3,106,003 A 10/1963 Herdman
3,112,545 A 12/1963 Williams
3,122,810 A 3/1964 Lawrence et al.
3,163,900 A 1/1965 Martin
D200,394 S 2/1965 Hakim
3,169,325 A 2/1965 Fesl
3,193,950 A 7/1965 Liou
3,197,155 A 7/1965 Chow
3,221,384 A 12/1965 Aufenacker
3,276,090 A 10/1966 Nigon
D206,146 S 11/1966 Hendershot
3,345,707 A 10/1967 Rita
D210,649 S 4/1968 Getgay
3,401,437 A 9/1968 Christpohersen
3,430,303 A 3/1969 Perrin et al.
3,491,465 A 1/1970 Martin
3,545,106 A 12/1970 Martin
3,618,232 A 11/1971 Shnuriwsky
3,668,791 A 6/1972 Salzman et al.
3,678,539 A 7/1972 Graup
3,703,775 A 11/1972 Gatti
3,729,779 A 5/1973 Porth
3,738,027 A * 6/1973 Schoch ..... A43B 1/0054 24/68 R
3,793,749 A 2/1974 Gertsch et al.
3,808,644 A * 5/1974 Schoch ..... A43C 11/16 24/68 SK
3,845,575 A * 11/1974 Boden ..... A43C 7/00 24/115 M
3,934,346 A 1/1976 Sasaki et al.
3,975,838 A 8/1976 Martin
4,084,267 A 4/1978 Zadina
4,130,949 A 12/1978 Seidel
4,142,307 A 3/1979 Martin
4,227,322 A 10/1980 Annovi
4,261,081 A 4/1981 Lott
4,267,622 A 5/1981 Burnett-Johnston
RE31,052 E * 10/1982 Adams ..... A43C 1/00 24/712.5
4,408,403 A 10/1983 Martin
4,417,703 A 11/1983 Weinhold
4,433,456 A 2/1984 Baggio
4,463,761 A 8/1984 Pols et al.
4,480,395 A 11/1984 Schoch
4,507,878 A 4/1985 Semouha
4,516,576 A 5/1985 Kirchner
4,551,932 A 11/1985 Schoch
4,555,830 A 12/1985 Petrini et al.
4,574,500 A 3/1986 Aldinio et al.
4,616,432 A 10/1986 Bunch et al.
4,616,524 A 10/1986 Biodia
4,619,057 A 10/1986 Sartor et al.
4,620,378 A 11/1986 Sartor
4,631,839 A 12/1986 Bonetti et al.
4,631,840 A 12/1986 Gamm
4,633,599 A 1/1987 Morell et al.
4,644,938 A 2/1987 Yates et al.
4,654,985 A 4/1987 Chalmers
4,660,300 A 4/1987 Morell et al.
4,660,302 A 4/1987 Arieh et al.
4,680,878 A 7/1987 Pozzobon et al.
4,719,670 A 1/1988 Kurt
4,719,709 A 1/1988 Vaccari
4,719,710 A 1/1988 Pozzobon
4,722,477 A 2/1988 Floyd
4,741,115 A 5/1988 Pozzobon
4,748,726 A 6/1988 Schoch
4,760,653 A 8/1988 Baggio
4,780,969 A 11/1988 White, Jr.
4,787,124 A 11/1988 Pozzobon et al.
4,790,081 A 12/1988 Benoit et al.
4,796,829 A 1/1989 Pozzobon et al.
4,799,297 A 1/1989 Baggio et al.
4,802,291 A 2/1989 Sartor
4,811,503 A 3/1989 Iwama
4,826,098 A 5/1989 Pozzobon et al.
4,841,649 A 6/1989 Baggio et al.
4,856,207 A 8/1989 Datson
4,862,878 A 9/1989 Davison
4,870,723 A 10/1989 Pozzobon et al.
4,870,761 A 10/1989 Tracy
4,884,760 A 12/1989 Baggio et al.
4,901,938 A 2/1990 Cantley et al.
4,924,605 A 5/1990 Spademan
D308,282 S 6/1990 Bergman et al.
4,937,953 A 7/1990 Walkhoff
4,961,544 A 10/1990 Biodia
4,974,299 A * 12/1990 Moon ..... A43C 1/04 24/714.6

(56) References Cited

U.S. PATENT DOCUMENTS 4,979,953 A 12/1990 Spence
4,989,805 A 2/1991 Burke
5,001,817 A 3/1991 De Bortoli et al.
5,016,327 A 5/1991 Klausner
5,042,177 A 8/1991 Schoch
5,062,225 A 11/1991 Gorza
5,065,480 A 11/1991 DeBortoli
5,065,481 A 11/1991 Walkhoff
5,108,216 A 4/1992 Geyer et al.
5,117,567 A 6/1992 Berger
5,152,038 A 10/1992 Schoch
5,157,813 A * 10/1992 Carroll ..... A43C 7/00 24/68 B
5,158,428 A 10/1992 Gessner et al.
5,177,882 A 1/1993 Berger
5,181,331 A 1/1993 Berger
5,184,378 A 2/1993 Batra
D333,552 S 3/1993 Berger et al.
5,205,055 A 4/1993 Harrell
5,233,767 A 8/1993 Kramer
5,249,377 A 10/1993 Walkhoff
5,259,094 A * 11/1993 Zepeda ..... A43C 7/00 24/575.1
5,315,741 A 5/1994 Debberke
5,319,868 A 6/1994 Hallenbeck
5,319,869 A 6/1994 McDonald et al.
5,325,613 A 7/1994 Sussmann
5,327,662 A 7/1994 Hallenbeck
5,333,398 A * 8/1994 Seo ..... A43C 7/00 24/712.9
5,335,401 A 8/1994 Hanson
5,341,583 A 8/1994 Hallenbeck
5,345,697 A 9/1994 Quellais
5,355,596 A 10/1994 Sussmann
5,357,654 A 10/1994 Hsing-Chi
5,371,957 A 12/1994 Gaudio
5,381,609 A 1/1995 Hieblinger
5,392,535 A 2/1995 Van Noy et al.
D357,576 S 4/1995 Steinweis
5,425,161 A 6/1995 Schoch
5,425,185 A 6/1995 Gansler
5,430,960 A 7/1995 Richardson
5,433,648 A 7/1995 Frydman
5,463,822 A 11/1995 Miller
5,477,593 A 12/1995 Leick
D367,755 S 3/1996 Jones
D367,954 S 3/1996 Dion
5,502,902 A 4/1996 Sussmann
5,511,325 A 4/1996 Hieblinger
5,526,585 A 6/1996 Brown et al.
5,535,531 A 7/1996 Karabed et al.
5,537,763 A 7/1996 Donnadieu et al.
5,557,864 A 9/1996 Marks
5,566,474 A * 10/1996 Leick ..... A43C 1/00 24/713.4
D375,831 S 11/1996 Perry
5,596,820 A 1/1997 Edauw et al.
5,599,000 A 2/1997 Bennett
5,599,288 A 2/1997 Shirley et al.
5,600,874 A * 2/1997 Jungkind ..... A43C 11/16 24/68 SK
5,606,778 A 3/1997 Jungkind
5,607,448 A 3/1997 Stahl et al.
D379,113 S 5/1997 McDonald et al.
5,638,588 A 6/1997 Jungkind
5,640,785 A 6/1997 Egelja
5,647,104 A 7/1997 James
5,651,198 A 7/1997 Sussmann
5,669,116 A 9/1997 Jungkind
5,692,319 A 12/1997 Parker et al.
5,718,021 A 2/1998 Tatum
5,718,065 A 2/1998 Locker
5,720,084 A 2/1998 Chen
5,732,483 A 3/1998 Cagliari
5,732,648 A 3/1998 Aragon
5,736,696 A 4/1998 Del Rosso
5,737,854 A 4/1998 Sussmann
5,755,044 A 5/1998 Veylupek
5,756,298 A 5/1998 Burczak
5,761,777 A 6/1998 Leick
5,772,146 A 6/1998 Kawamoto et al.
5,784,809 A 7/1998 McDonald
5,791,068 A 8/1998 Bernier et al.
5,819,378 A 10/1998 Doyle
5,833,640 A 11/1998 Vazquez, Jr. et al.
5,839,210 A 11/1998 Bernier et al.
5,845,371 A 12/1998 Chen
5,906,057 A * 5/1999 Borsoi ..... A43C 3/00 24/714.7
5,909,946 A 6/1999 Okajima
D413,197 S 8/1999 Faye
5,934,599 A 8/1999 Hammerslag
5,937,542 A 8/1999 Bourdeau
5,956,823 A 9/1999 Borel
5,971,946 A 10/1999 Quinn et al.
6,015,110 A 1/2000 Lai
6,038,791 A 3/2000 Cornelius et al.
6,052,921 A 4/2000 Oreck
6,070,886 A 6/2000 Cornelius et al.
6,070,887 A 6/2000 Cornelius et al.
6,083,857 A 7/2000 Bottger
6,088,936 A 7/2000 Bahl
6,102,412 A 8/2000 Staffaroni
D430,724 S 9/2000 Matis et al.
6,119,318 A 9/2000 Maurer
6,119,372 A 9/2000 Okajima
6,128,835 A 10/2000 Ritter et al.
6,128,836 A 10/2000 Barret
6,148,489 A 11/2000 Dickie et al.
6,202,953 B1 3/2001 Hammerslag
6,219,891 B1 4/2001 Maurer et al.
6,240,657 B1 6/2001 Weber et al.
6,256,798 B1 7/2001 Egolf et al.
6,267,390 B1 7/2001 Maravetz et al.
6,286,233 B1 9/2001 Gaither
6,289,558 B1 9/2001 Hammerslag
6,311,633 B1 11/2001 Keire
D456,130 S 4/2002 Towns
6,370,743 B2 4/2002 Choe
6,401,364 B1 6/2002 Burt
6,416,074 B1 7/2002 Maravetz et al.
6,467,195 B2 10/2002 Pierre et al.
6,477,793 B1 11/2002 Pruitt et al.
6,502,286 B1 * 1/2003 Dubberke ..... A43C 7/00 24/712.1
6,543,159 B1 4/2003 Carpenter et al.
6,568,103 B2 5/2003 Durocher
6,606,304 B1 8/2003 Grinter et al.
6,606,804 B2 8/2003 Kaneko et al.
6,694,643 B1 2/2004 Hsu
6,708,376 B1 3/2004 Landry
6,711,787 B2 3/2004 Jungkind et al.
6,735,829 B2 5/2004 Hsu
6,757,991 B2 7/2004 Sussmann
6,775,928 B2 * 8/2004 Grande ..... A43C 7/00 24/115 G
6,792,702 B2 9/2004 Borsoi et al.
6,802,439 B2 10/2004 Azam et al.
6,823,610 B1 11/2004 Ashley
6,871,812 B1 3/2005 Chang
6,877,256 B2 4/2005 Martin et al.
6,899,720 B1 5/2005 McMillan
6,922,917 B2 8/2005 Kerns et al.
6,938,913 B2 9/2005 Elkington
6,945,543 B2 9/2005 De Bortoli et al.
D510,183 S 10/2005 Tresser
6,976,972 B2 12/2005 Bradshaw
6,993,859 B2 2/2006 Martin et al.
D521,226 S 5/2006 Douglas et al.
7,073,279 B2 7/2006 Min
7,076,843 B2 7/2006 Sakabayashi
7,082,701 B2 8/2006 Dalgaard et al.
7,096,559 B2 8/2006 Johnson

(56) References Cited

U.S. PATENT DOCUMENTS 7,134,224 B2 11/2006 Elkington et al.
7,266,911 B2 9/2007 Holzer et al.
7,281,341 B2 10/2007 Reagan et al.
7,293,373 B2 11/2007 Reagan et al.
7,331,126 B2 2/2008 Johnson
7,343,701 B2 3/2008 Pare et al.
7,367,522 B2 5/2008 Chen
7,386,947 B2 6/2008 Martin et al.
7,392,602 B2 7/2008 Reagan et al.
7,401,423 B2 7/2008 Reagan et al.
7,490,458 B2 2/2009 Ford
7,568,298 B2 8/2009 Kerns
7,582,102 B2 9/2009 Heinz et al.
7,584,528 B2 9/2009 Hu
7,591,050 B2 9/2009 Hammerslag
7,597,675 B2 10/2009 Ingimundarson et al.
7,600,660 B2 10/2009 Kasper et al.
7,617,573 B2 11/2009 Chen
7,624,517 B2 12/2009 Smith
7,648,404 B1 1/2010 Martin
7,650,705 B2 1/2010 Donnadieu et al.
7,694,354 B2 4/2010 Philpott et al.
7,752,774 B2 7/2010 Ussher
7,757,412 B2 7/2010 Farys
7,774,956 B2 8/2010 Dua et al.
D626,322 S 11/2010 Servettaz
7,841,106 B2 11/2010 Farys
7,871,334 B2 1/2011 Young et al.
7,877,845 B2 2/2011 Signori
7,900,378 B1 3/2011 Busse
7,908,769 B2 3/2011 Pellegrini
7,947,061 B1 5/2011 Reis
7,950,112 B2 5/2011 Hammerslag et al.
7,954,204 B2 6/2011 Hammerslag et al.
7,963,049 B2 6/2011 Messmer
7,992,261 B2 8/2011 Hammerslag et al.
D646,790 S 10/2011 Castillo et al.
8,056,150 B2 11/2011 Stokes et al.
8,056,265 B2 * 11/2011 Pirkle ..... A43C 7/00 24/712.1
8,074,379 B2 12/2011 Robinson, Jr. et al.
8,091,182 B2 1/2012 Hammerslag et al.
8,109,015 B2 2/2012 Signori
D663,850 S 7/2012 Joseph
D663,851 S 7/2012 Joseph
8,215,033 B2 7/2012 Carboy et al.
8,231,074 B2 * 7/2012 Hu ..... A43C 11/165 24/68 SK
D665,088 S 8/2012 Joseph
8,235,321 B2 8/2012 Chen
8,245,371 B2 8/2012 Chen
8,257,293 B2 9/2012 Ingimundarson et al.
8,266,827 B2 9/2012 Dojan et al.
8,277,401 B2 10/2012 Hammerslag et al.
8,302,329 B2 11/2012 Hurd et al.
8,303,527 B2 11/2012 Joseph
8,308,098 B2 11/2012 Chen
8,353,087 B2 1/2013 Chen
8,353,088 B2 1/2013 Ha
8,381,362 B2 * 2/2013 Hammerslag ..... A43B 5/1666 24/68 SK
D677,045 S 3/2013 Voskuil
D679,019 S 3/2013 Siddle et al.
1,060,422 A1 4/2013 Bowdish
1,062,511 A1 5/2013 Short
8,434,200 B2 5/2013 Chen
8,468,657 B2 * 6/2013 Soderberg ..... A43C 11/16 24/68 SK
8,490,299 B2 7/2013 Dua et al.
8,516,662 B2 * 8/2013 Goodman ..... A43C 11/165 24/68 SK
8,578,632 B2 11/2013 Bell et al.
1,083,775 A1 1/2014 Thomas
8,652,164 B1 2/2014 Aston
1,090,438 A1 3/2014 Worth et al.
8,713,820 B2 5/2014 Kerns et al.
8,984,719 B2 3/2015 Soderberg et al.
9,072,341 B2 * 7/2015 Jungkind ..... A43C 11/165
D735,987 S 8/2015 Hsu
9,101,181 B2 8/2015 Soderberg et al.
9,125,455 B2 9/2015 Kerns et al.
9,138,030 B2 9/2015 Soderberg et al.
2002/0002781 A1 * 1/2002 Bouvier ..... A43B 3/0031 36/50.1
2002/0050076 A1 5/2002 Borsoi et al.
2002/0062579 A1 5/2002 Caeran
2002/0095750 A1 7/2002 Hammerslag
2002/0129518 A1 9/2002 Borsoi et al.
2002/0148142 A1 10/2002 Oorei et al.
2002/0166260 A1 11/2002 Borsoi
2002/0178548 A1 12/2002 Freed
2003/0079376 A1 5/2003 Oorei et al.
2003/0144620 A1 7/2003 Sieller
2003/0150135 A1 8/2003 Liu
2003/0177662 A1 9/2003 Elkington et al.
2003/0204938 A1 11/2003 Hammerslag
2004/0041452 A1 3/2004 Williams
2004/0211039 A1 10/2004 Livingston
2005/0054962 A1 3/2005 Bradshaw
2005/0060912 A1 3/2005 Holzer et al.
2005/0081339 A1 4/2005 Sakabayashi
2005/0081403 A1 4/2005 Mathieu
2005/0087115 A1 4/2005 Martin
2005/0098673 A1 5/2005 Huang
2005/0102861 A1 5/2005 Martin
2005/0126043 A1 6/2005 Reagan et al.
2005/0172463 A1 8/2005 Rolla
2005/0184186 A1 8/2005 Tsoi et al.
2005/0198866 A1 9/2005 Wiper et al.
2006/0135901 A1 6/2006 Ingimundarson et al.
2006/0156517 A1 7/2006 Hammerslag et al.
2006/0179685 A1 8/2006 Borel et al.
2006/0185193 A1 8/2006 Pellegrini
2006/0213085 A1 * 9/2006 Azam ..... A43B 5/0401 36/50.5
2006/0287627 A1 12/2006 Johnson
2007/0006489 A1 1/2007 Case, Jr. et al.
2007/0063459 A1 3/2007 Kavarsky
2007/0068040 A1 3/2007 Farys
2007/0084956 A1 4/2007 Chen
2007/0113524 A1 5/2007 Lander
2007/0128959 A1 6/2007 Cooke
2007/0169378 A1 7/2007 Sodeberg et al.
2008/0016717 A1 1/2008 Ruban
2008/0060167 A1 3/2008 Hammerslag et al.
2008/0060168 A1 3/2008 Hammerslag et al.
2008/0066272 A1 3/2008 Hammerslag et al.
2008/0066345 A1 3/2008 Hammerslag et al.
2008/0066346 A1 3/2008 Hammerslag et al.
2008/0068204 A1 3/2008 Carmen et al.
2008/0083135 A1 4/2008 Hammerslag et al.
2008/0092279 A1 4/2008 Chiang
2008/0172848 A1 7/2008 Chen
2008/0196224 A1 8/2008 Hu
2009/0019734 A1 1/2009 Reagan et al.
2009/0071041 A1 3/2009 Hooper
2009/0090029 A1 4/2009 Kishino
2009/0172928 A1 7/2009 Messmer et al.
2009/0184189 A1 7/2009 Soderberg et al.
2009/0272007 A1 11/2009 Beers et al.
2009/0277043 A1 11/2009 Graser et al.
2010/0064547 A1 3/2010 Kaplan
2010/0101061 A1 4/2010 Ha
2010/0115744 A1 * 5/2010 Fong ..... A43C 1/00 24/712.1
2010/0139057 A1 6/2010 Soderberg et al.
2010/0154254 A1 6/2010 Fletcher
2010/0175163 A1 7/2010 Litke
2010/0251524 A1 10/2010 Chen
2010/0269373 A1 * 10/2010 Pirkle ..... A43C 7/00 36/136
2010/0299959 A1 * 12/2010 Hammerslag ..... A43B 5/1666 36/50.5

(56) References Cited

U.S. PATENT DOCUMENTS

| | | | | |
|---|---|---|---|---|
| 2010/0319216 | A1 | 12/2010 | Grenzke et al. | |
| 2011/0000173 | A1 | 1/2011 | Lander | |
| 2011/0071647 | A1 | 3/2011 | Mahon | |
| 2011/0162236 | A1 | 7/2011 | Voskuil et al. | |
| 2011/0167543 | A1 | 7/2011 | Kovacevich et al. | |
| 2011/0191992 | A1 | 8/2011 | Chen | |
| 2011/0197362 | A1 | 8/2011 | Chella et al. | |
| 2011/0225843 | A1 | 9/2011 | Kerns et al. | |
| 2011/0258876 | A1 | 10/2011 | Baker et al. | |
| 2011/0266384 | A1 | 11/2011 | Goodman et al. | |
| 2012/0000091 | A1 | 1/2012 | Cotterman et al. | |
| 2012/0004587 | A1 | 1/2012 | Nickel et al. | |
| 2012/0005995 | A1 | 1/2012 | Emery | |
| 2012/0023717 | A1 | 2/2012 | Chen | |
| 2012/0101417 | A1 | 4/2012 | Joseph | |
| 2012/0102783 | A1 | 5/2012 | Swigart et al. | |
| 2012/0138882 | A1 | 6/2012 | Moore et al. | |
| 2012/0157902 | A1 | 6/2012 | Castillo et al. | |
| 2012/0167290 | A1 | 7/2012 | Kovacevich et al. | |
| 2012/0174437 | A1 | 7/2012 | Heard | |
| 2012/0228419 | A1 | 9/2012 | Chen | |
| 2012/0246974 | A1 | 10/2012 | Hammerslag et al. | |
| 2012/0310273 | A1 | 12/2012 | Thorpe | |
| 2013/0012856 | A1 | 1/2013 | Hammerslag et al. | |
| 2013/0014359 | A1 | 1/2013 | Chen | |
| 2013/0019501 | A1 | 1/2013 | Gerber | |
| 2013/0025100 | A1 | 1/2013 | Ha | |
| 2013/0091667 | A1 | 4/2013 | Zerfas et al. | |
| 2013/0091674 | A1 | 4/2013 | Chen | |
| 2013/0092780 | A1 | 4/2013 | Soderberg et al. | |
| 2013/0269219 | A1 | 10/2013 | Burns et al. | |
| 2013/0277485 | A1 | 10/2013 | Soderberg et al. | |
| 2013/0340283 | A1 | 12/2013 | Bell et al. | |
| 2013/0345612 | A1 | 12/2013 | Bannister et al. | |
| 2014/0082963 | A1 | 3/2014 | Beers | |
| 2014/0094728 | A1 | 4/2014 | Soderberg et al. | |
| 2014/0117140 | A1 | 5/2014 | Goodman et al. | |
| 2014/0123440 | A1 | 5/2014 | Capra et al. | |
| 2014/0123449 | A1 | 5/2014 | Soderberg et al. | |
| 2014/0208550 | A1 | 7/2014 | Neiley | |
| 2014/0221889 | A1 | 8/2014 | Burns et al. | |
| 2014/0257156 | A1 | 9/2014 | Capra et al. | |
| 2014/0290016 | A1 | 10/2014 | Lovett et al. | |
| 2014/0359981 | A1* | 12/2014 | Cotterman | A43C 11/20 24/712.9 |
| 2015/0007422 | A1* | 1/2015 | Cavanagh | A43C 11/165 24/68 SK |
| 2015/0014463 | A1 | 1/2015 | Converse et al. | |
| 2015/0026936 | A1 | 1/2015 | Kerns et al. | |
| 2015/0033519 | A1 | 2/2015 | Hammerslag et al. | |
| 2015/0059206 | A1 | 3/2015 | Lovett et al. | |
| 2015/0076272 | A1 | 3/2015 | Trudel et al. | |
| 2015/0089779 | A1 | 4/2015 | Lawrence et al. | |
| 2015/0089835 | A1 | 4/2015 | Hammerslag et al. | |
| 2015/0101160 | A1 | 4/2015 | Soderberg et al. | |
| 2015/0150705 | A1 | 6/2015 | Capra et al. | |
| 2015/0151070 | A1 | 6/2015 | Capra et al. | |
| 2015/0190262 | A1 | 7/2015 | Capra et al. | |
| 2015/0223608 | A1 | 8/2015 | Capra et al. | |
| 2015/0237962 | A1 | 8/2015 | Soderberg et al. | |
| 2015/0335458 | A1 | 11/2015 | Romo | |
| 2016/0058130 | A1* | 3/2016 | Boney | A43C 1/06 24/712.6 |

FOREIGN PATENT DOCUMENTS

| | | | |
|---|---|---|---|
| AT | 361808 | | 4/1981 |
| CA | 2114387 | | 1/1994 |
| CA | 2112789 | | 8/1994 |
| CA | 2114387 | | 8/1994 |
| CH | 41765 | | 9/1907 |
| CH | 111341 | | 11/1925 |
| CH | 199766 | | 9/1938 |
| CH | 199766 | | 11/1938 |
| CH | 204 834 | A | 5/1939 |
| CH | 204 834 | A | 8/1939 |
| CH | 523 669 | | 7/1972 |
| CH | 562 015 | | 5/1975 |
| CH | 577 282 | | 7/1976 |
| CH | 612 076 | | 7/1979 |
| CH | 537 164 | | 7/1981 |
| CH | 624 001 | | 7/1981 |
| CH | 471 553 | | 12/1984 |
| CN | 2613167 | | 4/2004 |
| CN | 201015448 | | 2/2008 |
| DE | 555211 | | 7/1932 |
| DE | 641976 | | 2/1937 |
| DE | 1 661 668 | | 8/1953 |
| DE | 7043154.8 | | 11/1970 |
| DE | 1 785 220 | | 5/1971 |
| DE | 2 062 795 | | 6/1972 |
| DE | 23 41 658 | | 3/1974 |
| DE | 24 14 439 | | 10/1975 |
| DE | 29 00 077 | A1 | 7/1980 |
| DE | 2914280 | A1 | 10/1980 |
| DE | 31 01 952 | A1 | 9/1982 |
| DE | 36 26 837 | | 2/1988 |
| DE | 38 13 470 | | 11/1989 |
| DE | 3822113 | C2 | 1/1990 |
| DE | 9413147 | | 6/1994 |
| DE | 43 02 401 | A1 | 8/1994 |
| DE | 43 05 671 | A1 | 9/1994 |
| DE | 9308037 | | 10/1994 |
| DE | 43 26 049 | A1 | 2/1995 |
| DE | 9315776 | | 2/1995 |
| DE | 29503552.8 | | 4/1995 |
| DE | 196 24 553 | | 1/1998 |
| DE | 19945045 | A1 | 3/2001 |
| DE | 201 16 755 | U1 | 1/2002 |
| DE | 20 2010 000 354 | U1 | 6/2010 |
| DE | 11 2013 005 273 | T5 | 9/2015 |
| EP | 0 056 953 81 | | 6/1969 |
| EP | 0 081 042 81 | | 7/1972 |
| EP | 0 056 953 | | 8/1982 |
| EP | 0 099 504 | | 2/1984 |
| EP | 0 123 050 | | 2/1984 |
| EP | 0 123 050 | | 10/1984 |
| EP | 0 155 596 | | 9/1985 |
| EP | 0 201 051 | | 11/1986 |
| EP | 0 099 504 | | 1/1987 |
| EP | 0 255 869 | | 7/1987 |
| EP | 0 155 596 | | 1/1988 |
| EP | 0 255 869 | | 2/1988 |
| EP | 0 393 380 | | 3/1990 |
| EP | 0 393 380 | | 10/1990 |
| EP | 0 474 708 | | 9/1993 |
| EP | 0 589 232 | A1 | 3/1994 |
| EP | 0 589 233 | A1 | 3/1994 |
| EP | 0 614 624 | | 9/1994 |
| EP | 0 614 625 | A1 | 9/1994 |
| EP | 0 651 954 | A1 | 5/1995 |
| EP | 0 679 346 | | 11/1995 |
| EP | 0 693 260 | B1 | 1/1996 |
| EP | 0 717 942 | | 6/1996 |
| EP | 0 858 619 | | 8/1996 |
| EP | 0 734 662 | A1 | 10/1996 |
| EP | 0 848 917 | | 6/1998 |
| EP | 0 858 621 | | 8/1998 |
| EP | 0 923 965 | | 6/1999 |
| EP | 0 937 467 | | 8/1999 |
| EP | 0 848 917 81 | | 4/2000 |
| EP | 1163860 | | 12/2001 |
| EP | 1 219 195 | | 7/2002 |
| EP | 1 236 412 | | 9/2002 |
| EP | 1 236 412 | A | 9/2002 |
| EP | 2298107 | B1 | 3/2011 |
| EP | 2359708 | | 8/2011 |
| FR | 1 349 832 | | 3/1963 |
| FR | 1 404 799 | | 7/1964 |
| FR | 1 374 110 | | 10/1964 |
| FR | 1 404 799 | | 7/1965 |
| FR | 2 019 991 | A | 7/1970 |
| FR | 2 108 428 | | 9/1971 |

(56) References Cited

FOREIGN PATENT DOCUMENTS

| | | | |
|---|---|---|---|
| FR | 2 175 684 | | 3/1972 |
| FR | 2.108.429 | | 5/1972 |
| FR | 2 173 451 | | 10/1973 |
| FR | 2 399 811 | | 3/1979 |
| FR | 2 565 795 | | 6/1984 |
| FR | 2 598 292 | A1 | 11/1987 |
| FR | 2 726 440 | A1 | 5/1996 |
| FR | 2 770 379 | A1 | 5/1999 |
| FR | 2 814 919 | A1 | 4/2002 |
| GB | 189911673 | | 7/1899 |
| GB | 216400 | | 5/1924 |
| GB | 2 449 722 | A | 12/2008 |
| IT | 1220811 | | 6/1990 |
| IT | PD 2003 A 000197 | | 4/2003 |
| IT | PD 2003 A 000198 | | 3/2005 |
| JP | 49-28618 | | 3/1974 |
| JP | 51-2776 | | 1/1976 |
| JP | 51-121375 | | 10/1976 |
| JP | 51-131978 | | 10/1976 |
| JP | 53-124987 | | 3/1977 |
| JP | 54-108125 | | 2/1978 |
| JP | 62-57346 | | 4/1987 |
| JP | 63-80736 | | 5/1988 |
| JP | H02-236025 | | 9/1990 |
| JP | 7-000208 | | 6/1995 |
| JP | 6-284906 | | 2/1996 |
| JP | 3031760 | | 9/1996 |
| JP | 3030988 | | 11/1996 |
| JP | 8308608 | | 11/1996 |
| JP | 3031760 | | 12/1996 |
| JP | 10-199366 | | 7/1998 |
| JP | 2001-197905 | | 7/2001 |
| JP | 2004-016732 | | 1/2004 |
| JP | 2004-041666 | | 2/2004 |
| JP | 2009-504210 | | 2/2009 |
| KR | 20-0367882 | | 11/2004 |
| KR | 20-0400568 | | 8/2005 |
| KR | 10-0598627 | | 7/2006 |
| KR | 10-0953398 | | 4/2010 |
| KR | 10-1025134 | B | 3/2011 |
| KR | 10-1028468 | | 4/2011 |
| KR | 10-1053551 | | 7/2011 |
| WO | WO 94/27456 | | 12/1994 |
| WO | WO 95/03720 | | 2/1995 |
| WO | WO 95/11602 | | 5/1995 |
| WO | WO 98/33408 | | 8/1998 |
| WO | WO 98/37782 | | 9/1998 |
| WO | WO 99/09850 | | 3/1999 |
| WO | WO 99/15043 | | 4/1999 |
| WO | WO 99/43231 | | 9/1999 |
| WO | WO 00/53045 | | 9/2000 |
| WO | WO00/53045 | | 9/2000 |
| WO | WO 00/76337 | A1 | 12/2000 |
| WO | WO 01/08525 | | 2/2001 |
| WO | WO 01/15559 | | 3/2001 |
| WO | WO 2015/179332 | A1 | 11/2001 |
| WO | WO 02/051511 | | 7/2002 |
| WO | WO 2004/093569 | | 11/2004 |
| WO | WO 2005/013748 | A1 | 2/2005 |
| WO | WO/2007/016983 | | 2/2007 |
| WO | WO 2008/015214 | | 2/2008 |
| WO | WO/2008/033963 | | 3/2008 |
| WO | WO/2009/134858 | | 11/2009 |
| WO | WO 2010/059989 | A2 | 5/2010 |
| WO | WO 2012/165803 | A2 | 12/2012 |
| WO | WO/2015/035885 | | 3/2015 |
| WO | WO 2015/181928 | A1 | 12/2015 |

OTHER PUBLICATIONS

U.S. Appl. No. 09/956,601, filed Sep. 18, 2001, Hammerslag.
ASOLO® Boot Brochure Catalog upon information and belief date is as early as Aug. 22, 1997, 12 pages.
La Sportiva, A Technical Lightweight Double Boot for Cold Environments, 1 page. Accessed on May 27, 2015. Retrieved from http://www.sportiva.com/products/footwear/mountain/spantik.
"Strength of materials used to make my Safety Harnesses," Elaine, Inc. Jul. 9, 2012. Retrieved from <https://web.archive.org/web/20120709002720/http://www.childharness.ca/strength_data.html> on Mar. 17, 2014, 2 pages.
International Search Report and Written Opinion for PCT/US2013/032326 mailed Jun. 14, 2013, 27 pages.
International Preliminary Report on Patentability for PCT/US2013/032326 issued Sep. 16, 2014, 6 pages.
International Search Report and Written Opinion for PCT/US2013/057637 mailed Apr. 7, 2014, 34 pages.
International Preliminary Report on Patentability for PCT/US2013/057637 issued Mar. 3, 2015, 9 pages.
International Search Report and Written Opinion for PCT/US2013/068342 mailed Apr. 7, 2014, 29 pages.
International Preliminary Report on Patentability for PCT/US2013/068342 issued May 5, 2015, 9 pages.
International Search Report and Written Opinion for PCT/US2014/014952 mailed Apr. 25, 2014, 17 pages.
International Preliminary Report on Patentability for PCT/US2014/014952 issued Aug. 11, 2015, 9 pages.
International Search Report and Written Opinion for PCT/US2014/066212 mailed Apr. 22, 2015, 16 pages.
International Search Report and Written Opinion for PCT/US2014/032574 mailed Oct. 31, 2014, 19 pages.
International Search Report and Written Opinion for PCT/US2014/045291 mailed Nov. 6, 2014, 12 pages.
International Search Report and Written Opinion for PCT/US2014/013458 mailed May 19, 2014, 12 pages.
International Preliminary Report on Patentability for PCT/US2014/013458 issued Jul. 28, 2015, 7 pages.
International Search Report and Written Opinion for PCT/US2013/068814 mailed Jun. 9, 2014, 18 pages.
International Preliminary Report on Patentability for PCT/US2013/068814 issued May 12, 2015, 12 pages.
Notice of Reasons for Rejection from the Japanese Patent Office dated Feb. 26, 2015 for design application No. 2014-015570, 4 pages.
Receipt of Certificate of Design Registration No. 1529678 from the Japanese Patent Office for design application No. 2014-015570 dated Jun. 26, 2015, 1 page.
International Search Report and Written Opinion for PCT/US2014/055710 mailed Jul. 6, 2015, 19 pages.
International Search Report and Written Opinion for PCT/US2014/054420 mailed Jul. 6, 2015, 21 pages.
The Preliminary Rejections from the Korean Intellectual Property Office for Application No. 30-2014-34959 received Aug. 7, 2015, is not translated into English. The document requests a renaming of the application to be in accordance with Korean patent law, 5 pages total.
The Preliminary Rejections from the Korean Intellectual Property Office for Application No. 30-2014-34959 received Apr. 7, 2015, is not translated into English. The document requests a revision of the drawings to be in accordance with Korean patent law, 6 pages total.
Certificate of Design Registration No. 30-809409 on Aug. 3, 2015 from the Korean Intellectual Property Office for Appln No. 30-015-11475, 2 pages.
Certificate of Design Registration No. 30-809410 on Aug. 3, 2015 from the Korean Intellectual Property Office for Appln No. 30-2015-11476, 2 pages.
European Search Report for EP 14168875 mailed Oct. 29, 2014, 9 pages.
International Search Report and Written Opinion for PCT/US2014/020894 mailed Jun. 20, 2014, 12 pages.
International Preliminary Report on Patentability for PCT/US2014/020894 issued Sep. 8, 2015, 7 pages.
International Search Report and Written Opinion for PCT/US2014/041144 mailed Dec. 10, 2014, 13 pages.
International Preliminary Report on Patentability for PCT/US2014/032574 issued Oct. 6, 2015, 12 pages.

(56) References Cited

OTHER PUBLICATIONS

International Search Report and Written Opinion for PCT/US2014/046238 mailed Nov. 21, 2014, 17 pages.
Office Action received Oct. 8, 2015 from the German Patent and Trademark Office for Appin No. 402015100191.2, regarding the title of the invention, 2 pages.
Anonymous, "Shore durometer," Wikipedia, the free encyclopedia, Mar. 3, 2012, XP002747470, Retrieved from the Internet: URL: https://en.wikipedia.org/w/index.php?title=Shore_durometer&oldid=481128180 [retrieved on Oct. 20, 2015] * shore A, shore D, durometer, polymer, rubber, gel; the whole document *, 6 pages.
Notice of Reasons for Rejection from the Japanese Patent Office dated Oct. 5, 2015 for design application No. 2015-004923, 4 pages.
"Save Tourniquet," 3 pages. Copyright 2015. Accessed on Dec. 11, 2015. Retrieved from http://www.savetourniquet.com/.

* cited by examiner

METHODS AND DEVICES FOR RETROFITTING FOOTWEAR TO INCLUDE A REEL BASED CLOSURE SYSTEM

CROSS-REFERENCES TO RELATED APPLICATIONS

This application claims priority to Provisional U.S. Patent Application No. 61/807,251 filed Apr. 1, 2013, entitled "Methods and Devices for Retrofitting Footwear to Include a Reel Based Closure System," the entire disclosure of which is hereby incorporated by reference, for all purposes, as if fully set forth herein.

BACKGROUND

The embodiments described herein are generally related to closure or tightening systems, devices, and methods related to footwear. The embodiments are specifically related to closure or tightening systems and devices that may be retrofit to existing footwear, and methods of retrofitting existing footwear with a closure or tightening system or device.

Footwear commonly includes a closure or tightening system or device. For example, footwear commonly includes shoelace that is threaded through eyelets of the shoe and tensioned to tighten the shoe about the foot. Shoelace may be inconvenient for a user since its use requires the user to tension the shoelace and tie a knot. The knot may come undone after a period of time and/or as a result of the user participating in certain activities, such as hiking, running, sporting events, and the like. The tightness of the shoe is often compromised as the shoelace's knot is undone, which may impede the performance of the user in an activity and/or require the user to re-tension and retie the shoelace.

Some footwear may include other non-shoelace closure systems or devices that alleviate some of the problems associated with shoelace. For example, footwear may include a pull-cord system where a tensioning component is coupled with the shoe and with a stop or crimp-type component. The tensioning component may be tensioned, such as by pulling on an end of the tensioning component, and the stop or crimp-type component engaged with the tensioning component to maintain a set tension of the tensioning component. Other footwear may include a reel based mechanism that includes a knob that is rotated by a user. The knob is typically coupled with a spool that includes a channel around which a lace is wound as the knob is rotated by the user. The reel based mechanism may include teeth that engage, or another ratchet type mechanism, that prevent counter-rotation of the spool and/or knob.

The footwear that include these non-shoelace closure systems are often designed and/or specifically configured with the systems. As such, footwear that currently includes shoelace are often not able to use non-shoelace type closure systems. In some instances, a non-shoelace type closure system may be attached to footwear that is originally constructed for tightening via shoelace, but in such instances the footwear is typically physically altered in some way so that attaching the non-shoelace type closure system significantly damages the footwear or otherwise results in significant visible or other evidence of the attachment.

BRIEF SUMMARY

The embodiments described herein provide closure or tightening systems and devices that may be attached to existing footwear without significantly damaging or altering the footwear or otherwise forming significantly visible or other evidence of the attachment. The embodiments also provide methods of attaching closure or tightening systems or devices to existing footwear without significantly damaging or altering the footwear. According to one embodiment, a lacing system that is removably coupleabe with footwear is provided. The lacing system includes a first guide member that is positionable on a first side of the footwear and a second guide member that is positionable on a second side of the footwear opposite the first side. The lacing system also includes a tension member that is guided by the first guide member and the second guide member along a path about the footwear—commonly along a tongue portion of the footwear. The tension member is tensionable to tighten the footwear about a foot by pulling or urging the first and second sides together.

The lacing system further includes a tensioning mechanism that is coupleable with the footwear and removable therefrom without damaging the footwear so that upon removal of the tensioning mechanism, the coupling of the tensioning mechanism and the footwear is not readily recognizable. The tensioning mechanism is operable with the tension member to maintain a tension of the tension member and thereby maintain a tightness of the footwear about the foot. In some embodiments, the tensioning mechanism is operable with a single hand to tension the tension member. In such embodiments, the tensioning mechanism may be a reel based mechanism or a pull cord type mechanism.

In some embodiments, the tensioning mechanism is coupled with an elongate panel member that is positionable along a tongue of the footwear. In such embodiments, the tensioning mechanism may be coupled with a distal end of the elongate panel member and a proximal end of the elongate panel member may include a support member that extends roughly orthogonally therefrom. The support member may be coupleable with opposing sides of the footwear's tongue (i.e., the first and second sides of the footwear) to stabilize the elongate panel member. In some embodiments, the support member may be moveable proximally and distally relative to the proximal end of the elongate panel member to accommodate footwear of various shapes and sizes. The proximal end of the elongate panel member may be trimmable and/or opposing ends of the support member may be trimmable to facilitate in positioning of the elongate panel member along the footwear's tongue and/or in coupling of the support member with the opposing sides of the footwear's tongue.

In some embodiments, the first guide member and/or the second guide member may include a base member and an upper member that is attached to the base member to form a loop. The upper member may be sufficiently flexible to be insertable through an eyelet of the footwear so that the upper member is positioned on one side of the eyelet while the base member is positioned on an opposite side of the eyelet. In such embodiments, the base member may be configured to prevent the guide member from being pulled through the eyelet.

In some embodiments, the first guide member and/or second guide member may be formed via a fabric strip of material (e.g., shoelace) that is weaved along a tongue and through eyelets of the footwear to form one or more loop portions. In such embodiments, the tension member may be guided along the path about the footwear via insertion of the tension member through the loop portions. In some embodiments, the first guide member and/or the second guide member include a fabric loop having opposing end that are insertable within adjacent eyelets of the footwear such that a middle portion of the fabric loop is positioned below the eyelets while the opposing looped ends of the fabric loop are positioned above the eyelets.

In some embodiments, the tension member is fixedly attached to the tensioning mechanism prior to coupling of the tensioning mechanism with the footwear. In such embodiments, the first and second guide members may be slidingly coupled with the tension member so that the lacing system is an all-in-one unit that is coupleable with the footwear.

According to another embodiment, a removable tightening device is provided. The removable tightening device includes a tensioning mechanism that is removably coupleable with an article without damaging the article so that upon removal, the coupling of the tensioning mechanism is unrecognizable. The tensioning mechanism may be operable with a tension member to maintain a tension of the tension member and the tension member may be tensionable to tighten the article and may be guided along a path about the article via one or more guide members.

The tensioning mechanism may be coupled with an elongate panel member that is positionable about the article to stabilize the tensioning member relative to the article. A support member may be coupled toward an end of the elongate panel member opposite the tensioning mechanism. The support member may be coupleable with opposing sides of the article to stabilize the elongate panel member relative to the article. The one or more guide members may include a base member and an upper member that are attached to the base member to form a loop. The upper member may be sufficiently flexible so as to be insertable through an eyelet of the article such that the upper member is positioned on one side of the eyelet while the base member is positioned on an opposite side of the eyelet. The base member may be configured to prevent the one or more guide members from being pulled through the eyelet. The tension member may be fixedly attached to the tensioning mechanism prior to coupling the tensioning mechanism with the article, and the one or more guide members may be slidingly coupled with the tension member.

According to another embodiment, a removable device for tightening an article is provided. The removable device includes a tensioning mechanism that is coupleable with the article and that is removable therefrom without damaging the article so that upon removal of the tensioning mechanism, the article has substantially no visible indications of the tensioning mechanism being coupled therewith. The tensioning mechanism is operable to tension a tension member to tighten the article and to maintain the tension of the tension member to maintain a tightness of the article. The tension member extends along or about a lace path about the article and is guided along the lace path by one or more guide members of the article.

According to another embodiment, a method of configuring footwear to include a removable tensioning mechanism is provided. The method includes or involves footwear that includes: a first guide member positioned on a first side of the footwear and a second guide member positioned on a second side of the footwear opposite the first side. The method also includes positioning a tension member about the footwear and along a path so that the tension member is guided by the first guide member and the second guide member along the path. The tension member is tensionable to tighten the footwear by urging or pulling the first side of the footwear toward the second side of the footwear. The method further includes coupling a tensioning mechanism with the footwear without damaging the footwear so that upon removal of the tensioning mechanism, the coupling of the tensioning mechanism and the footwear is unrecognizable or not readily detectable. The tensioning mechanism is operable with the tension member to maintain a tension of the tension member and thereby maintain a tightness of the footwear.

In some embodiments, the tensioning mechanism is coupled with an elongate panel member. In such embodiments, the method also includes positioning the elongate panel member along a tongue portion of the footwear. In such embodiments, the method may further include coupling a support member of the elongate panel member with opposing sides of the footwear's tongue portion to stabilize the elongate panel member, the support member being coupled toward an end of the elongate panel member opposite the tensioning member. In such embodiments, the method may additionally include adjusting the support member proximally or distally about the elongate panel member to accommodate a shape and/or size of the footwear. In such embodiments, the method may additionally include trimming the end of the elongate panel member to facilitate in positioning of the elongate panel member along the footwear's tongue and/or trimming opposing ends of the support member to facilitate in coupling of the support member with the opposing sides of the footwear's tongue.

In some embodiments, the first guide member and/or the second guide member may include a base member and an upper member that is attached to the base member to form a loop. In such embodiments, the method may also include inserting the upper member through an eyelet of the footwear so that the upper member is positioned on one side of the eyelet while the base member is positioned on an opposite side of the eyelet.

In some embodiments, the method may further include weaving a shoelace along a tongue portion of the footwear and through one or more eyelets to form one or more loop portions, the first guide member and the second guide member being formed from the one or more loop portions, and inserting the tension member through the one or more loop portions so that the tension member is guided along the path about the footwear.

According to another embodiment, a method of removably coupling a tensioning mechanism with an article is provided. The method includes coupling a tensioning mechanism with an article without damaging the article so that the tensioning mechanism is removable from the article and so that the coupling of the tensioning mechanism is unrecognizable or not readily detectable upon removal of the tensioning mechanism. The method also includes coupling the tensioning mechanism with a tension member, where the tension member is guided along a path about the article via one or more guide members and is tensionable to tighten the article, and where the tensioning mechanism is operable to maintain a tension of the tension member and thereby maintain a tightness of the article. In some embodiments, the article may be footwear.

In some embodiments, the tensioning mechanism is coupled with an elongate panel member. In such embodiments, the method also includes positioning the elongate panel member about the article to stabilize the tensioning mechanism about the article. In some embodiments, the first guide member and/or the second guide member include a base member and an upper member that is attached to the base member to form a loop. In such embodiments, the method also includes inserting the upper member through an eyelet of the article so that the upper member is positioned on one side of the eyelet while the base member is positioned on an opposite side of the eyelet.

In some embodiments, the tension member is fixedly coupled with the tensioning mechanism prior to coupling the tensioning mechanism with the article and the one or more guide members are slidingly coupled with the tension member. In such embodiments, the method also includes coupling the one or more guide members with the article. In such embodiments, coupling the one or more guide members with the article may removably couple the one or more guide members, tension member, and tensioning mechanism with the article. In such embodiments, coupling the one or more guide members with the article may include inserting a proximal end of the one or more guide members through a respective eyelet of the article.

According to another embodiment, a guide member for routing a tension member along a path of an article is provided. The guide member includes a base member and an upper member that is attached to the base member to form a loop for routing the tension member after the tension member is inserted through the loop. The upper member is sufficiently flexible so as to be positioned through an eyelet of the article and the base member is sufficiently rigid to restrict the base member from being pulled through the eyelet. When the upper member is inserted through the eyelet, the upper member is positioned on one side of the eyelet while the base member is positioned on an opposite side of the eyelet.

In some embodiments, the upper member is a fabric material loop or strip. In some embodiments, the base member is a rigid material. In other embodiments, the base member is a fabric material strip having a shorter longitudinal length than a longitudinal length of the upper member's fabric material strip. In such embodiments, opposing ends of the fabric material strips may be coupled together with a central portion of the upper member's fabric material strip extending from the base member to form the loop. In such embodiments, the coupled opposing ends may form flanges that extend roughly orthogonally from the upper material's loop. Each flange may have a longitudinal length of between 3 and 6 mm.

In some embodiments, the upper member is attached to the base member so that a portion of the loop directly adjacent the base member comprises a gap having a width of between 3 and 5 mm. In some embodiments, the upper member's loop extends above the base member by between about 8 and 12 mm. In some embodiments, the a backing material may be positionable atop the base member after the upper member is positioned through the eyelet. The backing material may be couplable with the article to conceal the base member thereunder.

According to another embodiment, a method of forming a guide member is provided. The guide member is configured for routing a tension member along a path of an article and the method includes providing a base member that is sufficiently rigid so as to restrict the base member from being pulled through an eyelet of the article and attaching an upper member to the base member to form a loop for routing the tension member after the tension member is inserted through the loop. The upper member is sufficiently flexible so as to be positionable through the eyelet of the article so that when the upper member is inserted through the eyelet, the upper member is positioned on one side of the eyelet while the base member is positioned on an opposite side of the eyelet.

In some embodiments, the upper member is a fabric material strip having opposing ends coupled together to form a loop and the base member is a rigid material having a pair of slots through which the fabric material is slidingly disposed. In other embodiments, the upper member is a fabric material strip and the base member is a fabric material strip with the base member's fabric material strip having a shorter longitudinal length than a longitudinal length of the upper member's fabric material strip. In such embodiments, the method also includes coupling opposing ends of the fabric material strips with a central portion of the upper member's fabric material strip extending roughly orthogonally from the base member to form the loop. In such embodiments, the coupled opposing ends may form flanges that extend roughly orthogonally from the upper material's loop with each flange having a width of between 3 and 6 mm.

In some embodiments, the upper member is attached to the base member so that a portion of the loop directly adjacent the base member includes a gap having a width of between 3 and 5 mm. In some embodiments, the upper member's loop extends above the base member by between about 8 and 12 mm. In some embodiments, the method additionally includes positioning a backing material atop the base member after the upper member is positioned through the eyelet and coupling the backing material with the article to conceal the base member thereunder.

BRIEF DESCRIPTION OF THE DRAWINGS

The present invention is described in conjunction with the appended figures.

Figure 1:
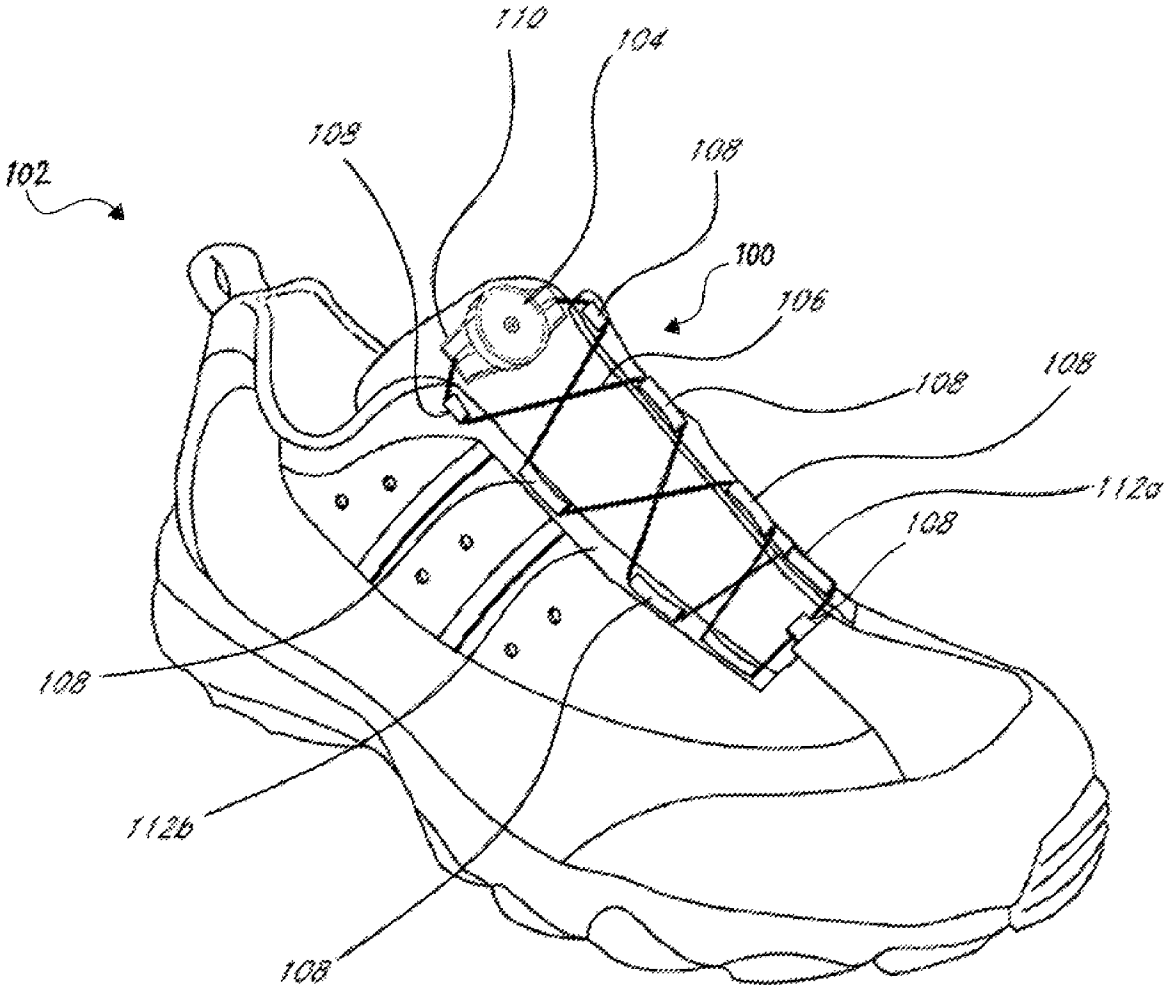
FIGS. 1-4 illustrate general embodiments of lacing system components and lacing system operations that may be employed to close a shoe or other article.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION

Embodiments described herein provide various features of closure devices that may be used to close a variety of items, such as medical braces (i.e., back braces, knee braces, and the like), items of clothing (i.e., hats, gloves, and the like), sports apparel (boots, snowboard boots, ski boots, and the like), and various other items. A specific embodiment in which the closure devices may be used involves shoes. For ease in describing the embodiments herein, the disclosure will mainly describe the closure device being used for shoes, although it should be realized that the closure devices may be used for the various other items.

In some embodiments, it may be desirable to "retrofit" a shoe to include one or more components of a lacing system. As used herein, the term "retrofit" describes adapting an existing shoe, or another article or apparel, to include one or more components of the lacing system so that the lacing system may be used to close the shoe or other article/apparel. Adapting or retrofitting an existing shoe may include coupling a tightening mechanism, one or more guides, lace termination points, and the like, with the shoe or other apparel so that the shoe is able to be closed via the lacing system. In some embodiments, the shoe may experience no visible or other damage in being retrofit or adapted to include the lacing system. For example, in many of the embodiments described herein, the lacing system is removable without altering or damaging the shoe. This can allow the system to be transferred from a relatively old and/or worn out shoe to a relatively new and/or clean shoe. This also allows for a shoe that is retrofit with a lacing system to be subsequently fit with conventional shoelace, or another tightening device, without having visible or readily detectable signs or indications of previously being retrofit with the lacing system.

In some embodiments, adapting the shoe or other apparel includes utilizing the lace of the shoe or other apparel in a manner so that the lace is able to be used as or with a guide for the lacing system. Utilizing the shoe's lace may include inserting or looping the lace through existing eyelets or webbing of the shoe or other apparel in a manner that creates a loop through which the lace of the lacing system may be inserted. In other embodiments, a reel based mechanism may be coupled with the shoe or other apparel via stitching, rivets, adhesive bonding, and the like. Various embodiments of adapting existing shoes and/or other apparel to include one or more components of the lacing system are described herein below. FIGS. 1-4 provide a general description of lacing system components and lacing system operations that may be employed to close shoes or other apparel. FIGS. 1-4 are provided to show the construction of a reel based mechanism and do not necessarily reflect the actual reel based mechanism that may be used with the retrofit embodiments described herein. Accordingly, various different configurations of reel based mechanisms may be employed without departing from the retrofit embodiments described herein. In other embodiments, pull cords or other tightening mechanisms or systems may be employed with the retrofit embodiments.

Referring now to the figures, FIG. 1 is a perspective view of an embodiment of lacing system 100 used for tightening a shoe 102. The shoe can be any suitable footwear that can be tightened around a wearer's foot. The lacing system 100 can be used to close or tighten various other articles as described herein, such as, for example, a belt, a hat, a glove, snowboard bindings, a medical brace, or a bag. The lacing system can include a reel assembly 104, a lace 106, and one or more lace guides 108. In the illustrated embodiment, the reel assembly 104 can be attached to the tongue 110 of the shoe. Various other configurations are also possible. For example, the reel assembly 104 can be attached to a side of the shoe 102, which can be advantageous for shoes in which the shoe sides 112*a-b* are designed to be drawn closely together when tightened leaving only a small portion of the tongue 110 exposed. The reel assembly 104 can also be attached to the back of the shoe 102, and a portion of the lace 106 can pass through the shoe 102, sometimes using tubing for the lace to travel through, on either side of the wearer's ankle such that the lace 106 can be engaged with the reel assembly 104 when back-mounted. In some embodiments, the reel assembly 104 may also be attached to the lateral side at or near the top of the lacing throat.

Figure 2:
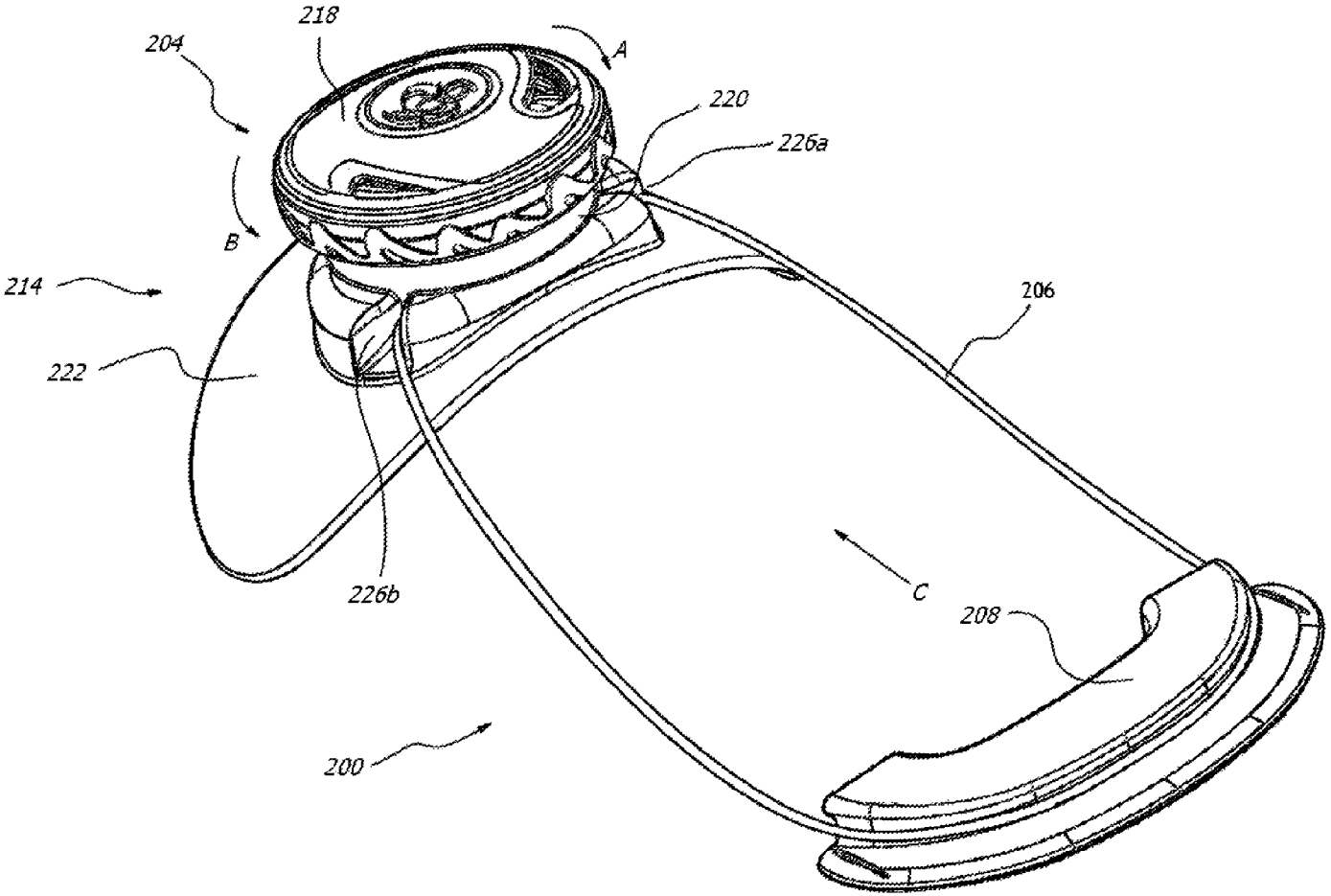
Figure 3:
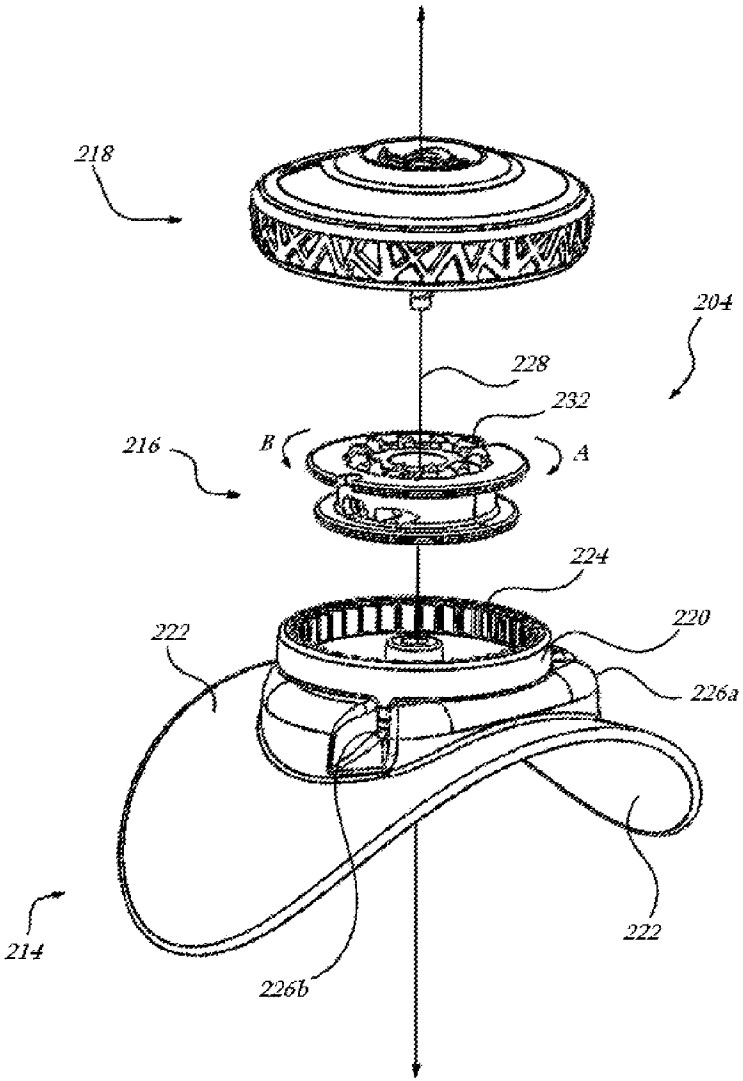
Figure 4:
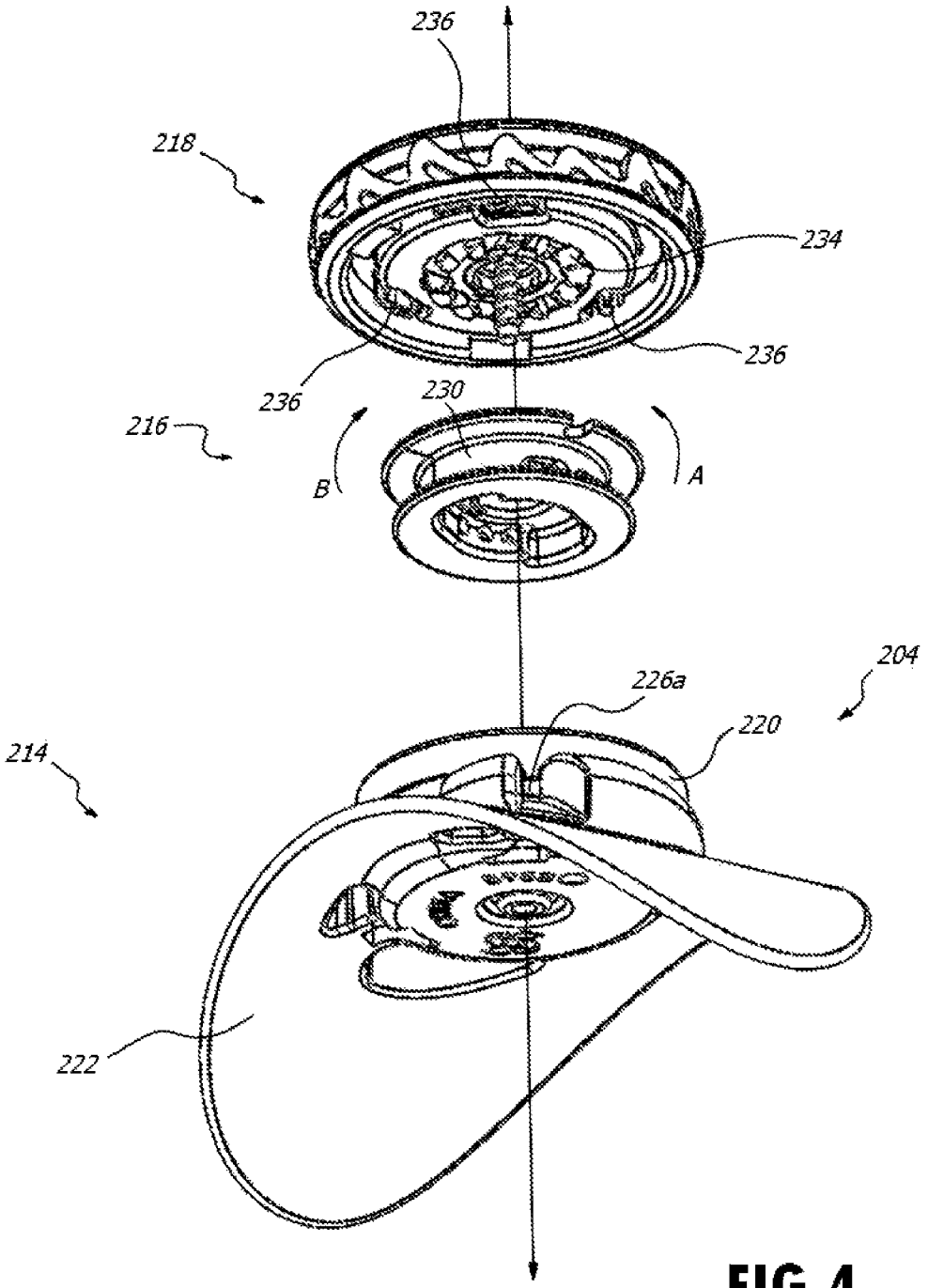

FIG. 2 is a perspective view of an embodiment of lacing system 200 that can be similar to the lacing system 100, or any other lacing system described herein. The lacing system can include a reel assembly 204 which can be similar to the reel assembly 104, or any other reel/knob assembly known in the art. FIG. 3 is an exploded perspective view of the reel assembly 204. FIG. 4 is another exploded perspective view of the reel assembly 204.

With reference to FIGS. 2 to 4, the reel assembly 204 can include a base member 214, a spool member 216, and a knob member 218. The base member can include a housing 220 and a mounting flange 222. The spool housing 220 can include a plurality of ratchet teeth 224, which can extend radially inwardly. The base member 214 can include lace holes (e.g., 226*a*) that allow the lace 206 to enter the spool housing 220.

The spool member 216 can be disposed within the spool housing 220 such that the spool member 216 is rotatable about an axis 228 with respect to the spool housing 220. The lace 206 can be secured to the spool member 216 such that when the spool member 216 rotates in a tightening direction (shown by arrow A) the lace 206 is drawn into the spool housing 220 and is wound around the channel 230 formed in the spool member 216, and when the spool member 216 rotates in a loosening direction (shown by arrow B) the lace 206 unwinds from the channel 230 of the spool member 216 and exits the spool housing 220 via the lace holes (e.g., 226*a*). The spool member 216 can also include spool teeth 232 formed thereon. It will be understood that the embodiments disclosed herein can be modified such that rotation in the direction shown by arrow B will tighten the lacing. In this particular embodiment, the knob member 218 may be raised axially to disengage from spool 230 to allow the spool to freewheel in direction B in order to release the lace. In other embodiments, rotation of the knob member 218 in the direction shown by arrow A may loosen the lacing system. In a specific embodiment, the knob member 218 may be rotated be a specific amount (e.g., ¼ to ½ turn) in a loosening direction (e.g., as shown by arrow B) to loosen the lacing system. Other user interfaces are possible for tightening, releasing, or adjusting lace tension.

The knob member 218 can be attached to the spool housing 220 such that the knob member 218 can rotate about the axis 228 with respect to the spool housing 220. The knob member 218 can include knob teeth 234 that can be configured to mate with the spool teeth 232 to couple the knob member 218 to the spool member 216 such that rotation of the knob member 218 in the tightening direction causes the spool member 216 to also rotate in the tightening direction.

In some embodiments, the rotation of the knob member 218 in the loosening direction can also cause the spool member 216 to rotate in the loosening direction. The knob member 218 can also include one or more pawls 236 which can be biased radially outwardly so as to mate with the ratchet teeth 224. The pawls 236 and ratchet teeth 224 can be configured so that the ratchet teeth 224 can displace the pawls 236 radially inwardly when the knob member 218 is rotated in the tightening direction, thereby allowing the knob member 218 to rotate in the tightening direction. The pawls 236 and the ratchet teeth 224 can also be configured so that they engage one another when force is applied to twist the knob member 218 in the loosening direction, thereby preventing the knob member 218 from rotating in the loosening direction. In other arrangements, the ratchet teeth 224 may be oriented axially to engage knob pawl members (not shown) that are correspondingly arranged to mate axially.

Thus, a reel assembly such as reel assembly 204 can provide a one-way tightening system configured to allow the user to rotate the knob member 218 in the tightening direction, which causes the spool member 216 to rotate in the tightening direction, which in turn causes the lace 206 to be drawn into the spool housing 220 via the lace holes (e.g., 226*a*). As the lace 206 is drawn into the spool housing 220 the lacing system 200 can tighten, causing the lace guide 208 to be drawn in the direction toward the reel assembly 204 (shown by arrow C in FIG. 2). Although the lacing system 200 is shown with a single lace guide 208, any other suitable number of lace guides can be used. Other features of the reel and lacing system are described in U.S. Patent Application No. 2011/0266384, filed Apr. 29, 2011, and Titled "Reel Based Lacing System", the entire disclosure of which is incorporated herein by reference.

The embodiments described herein generally describe embodiments in which a shoe or other apparel is retrofit to include one or more components of the lacing system, such as those described above in FIGS. 1-4. Although the disclosure is generally directed toward using a reel or dial mechanism and lacing system, it should be realized that any tightening mechanism may be used and the disclosure is not limited to embodiments that only use a reel or dial and/or lacing system. For example, various other tightening mechanisms could be used to retrofit a shoe, brace, or other device. An example of another such tightening mechanism is a pull cord system with suitable means for locking the cord in place after tensioning.

Figure 5A:
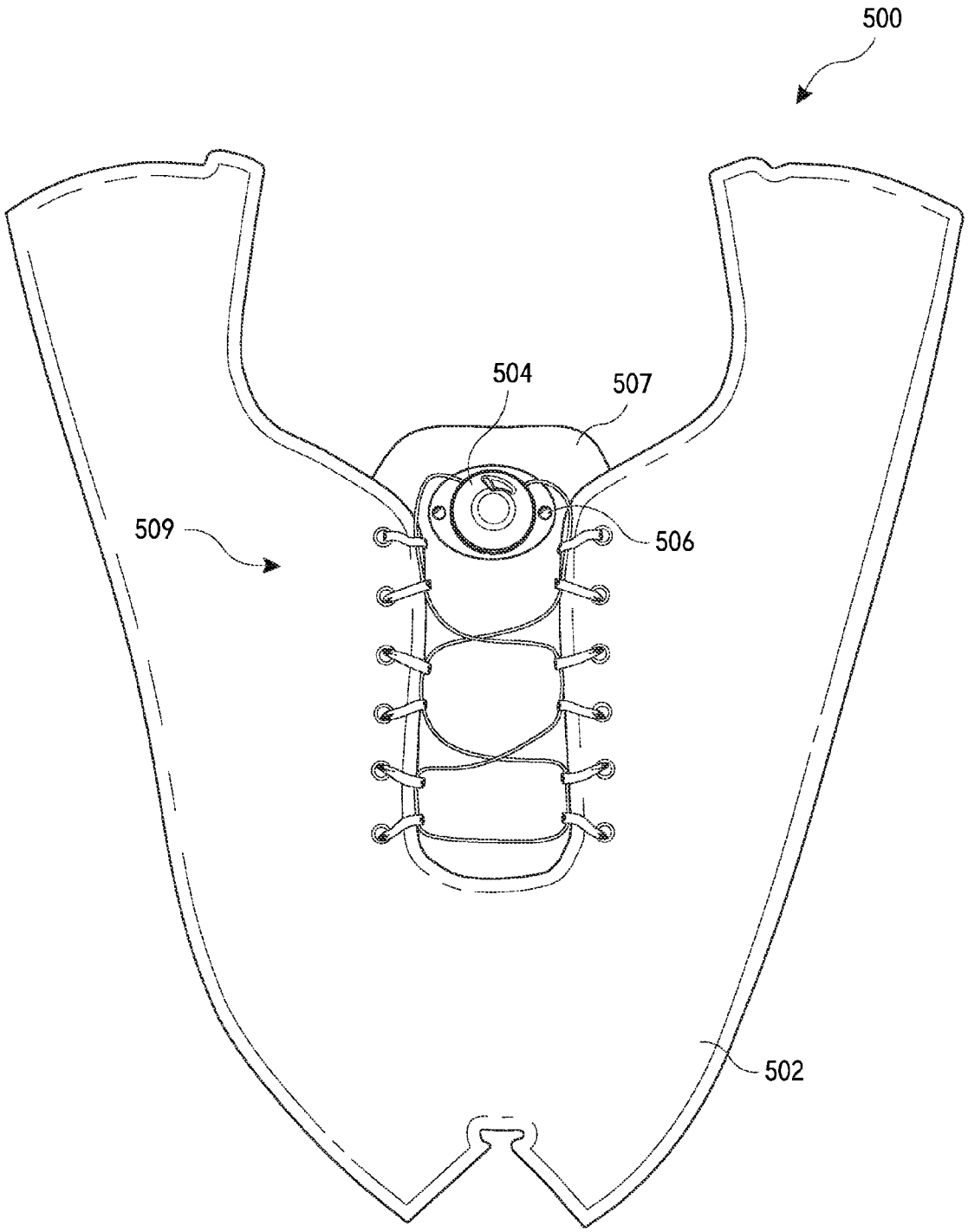
FIGS. 5A-J illustrate various embodiments that may be employed to retrofit a shoe or other article with a tightening mechanism.
Figure 5B:
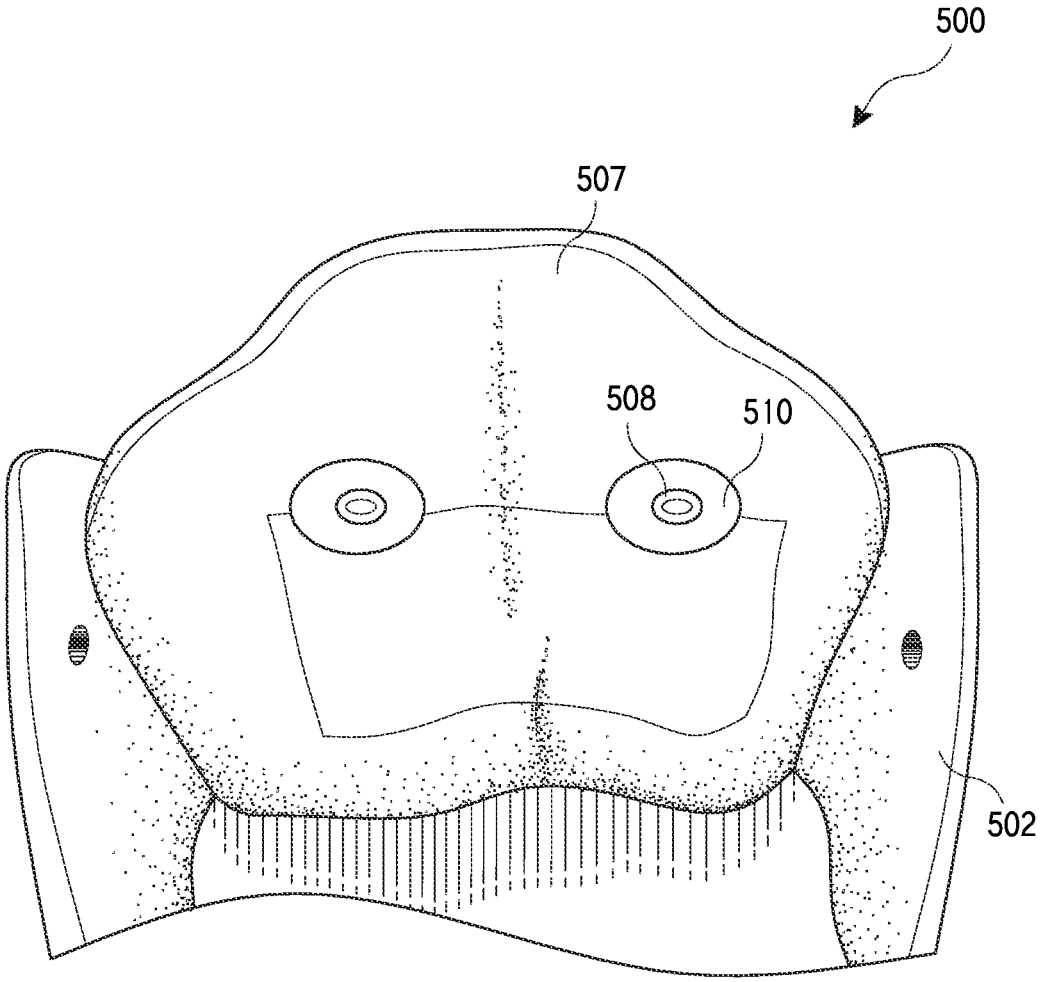

Referring now to FIGS. 5A and 5B, illustrated is one embodiment 500 of retrofitting a shoe 502 to include a reel assembly 504. In this embodiment, reel assembly 504 includes a pair of apertures 506, which may be slits, holes, and the like, positioned on a bayonet or bottom portion of a housing of reel assembly 504. Rivets 508 are inserted through apertures 506 to attach the reel assembly 504 to a tongue 507 of shoe 502. In other embodiments, the reel assembly 504 may be attached to an eyestay 509 or side of the shoe 502 to couple the reel assembly 504 to the side of the shoe 502 rather than to tongue 507. One or more washers 510 may be used with rivets 508 to prevent the rivets 508 from pulling through the fabric of tongue 507 and/or material of the eyestay 509. The rivets 508 may relatively rigidly couple the reel assembly 504 to shoe 502 to prevent rotation of the reel assembly 504 about tongue 507 as the knob of reel assembly 504 is rotated and lace is wound around the reel assembly 504's spool. The rivets 508, or washers 510 coupled therewith, may be tapered at their edges to prevent user contact.

In some embodiments, the rivets 508 may be applied using a rivet gun, or in more simple cases a hammer or other object may be used to apply rivets 508. In other embodiments, rivets 508 may be replaced with other fastening mechanisms, such as a self-tapping screw, a nut and bolt assembly, a binder post screw, or any other mechanical fastener known in the art.

In some embodiments, the reel assembly may include a plurality of apertures through which a clip is inserted. The tongue of the shoe may also include a plurality of slits or holes through which the clip is inserted to couple the reel assembly to the tongue. Although not shown, in some embodiments the eyestay of the shoe may similarly include a plurality of slits through which the clip is inserted to couple the reel assembly to the eyestay of the shoe. The clip and the reel assembly may couple the reel assembly with the shoe to prevent or minimize rotation of the reel assembly as the knob is operated. Other clip shapes could be used between shoe apertures and reel/spool housing receptacles.

Figure 5C:
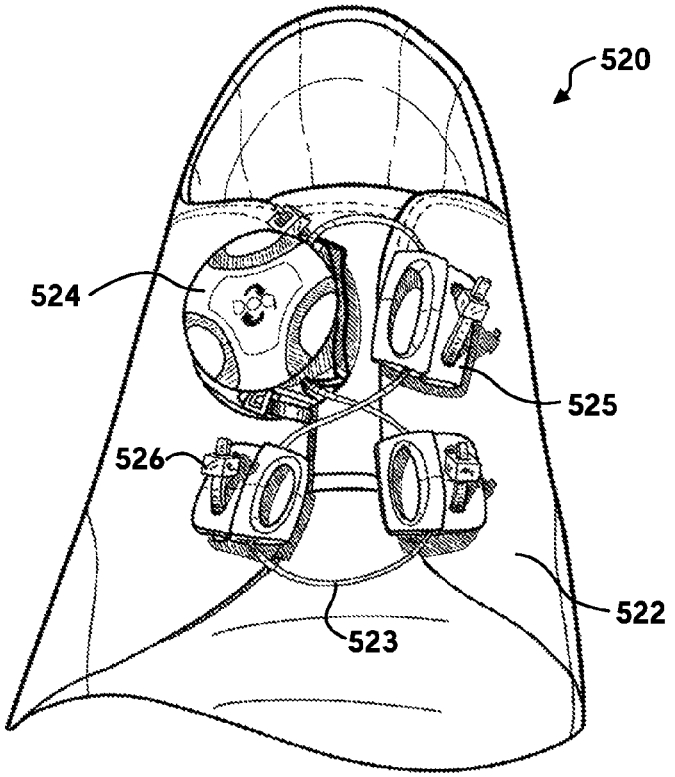
Figure 5D:
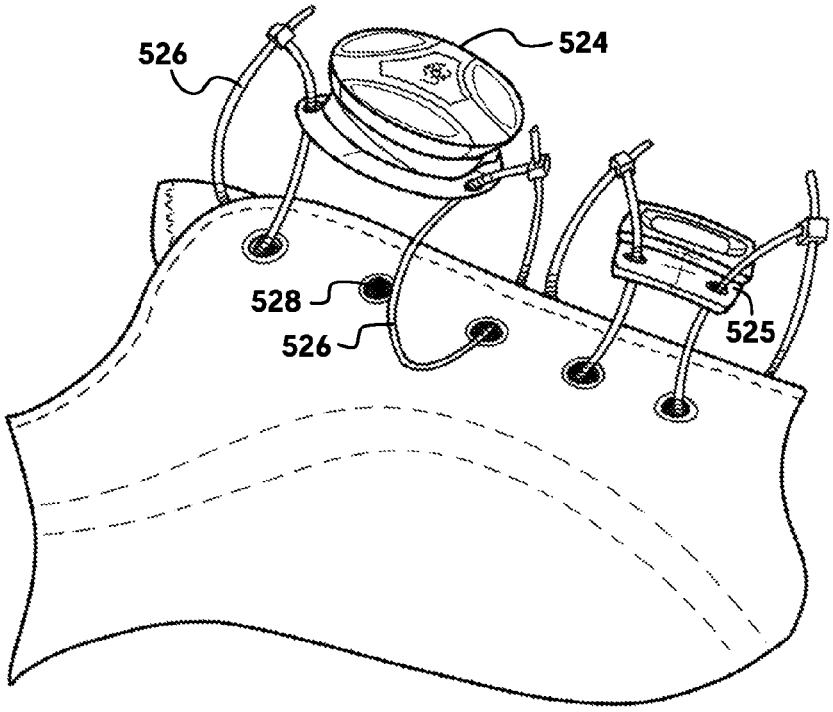
Figure 5E:
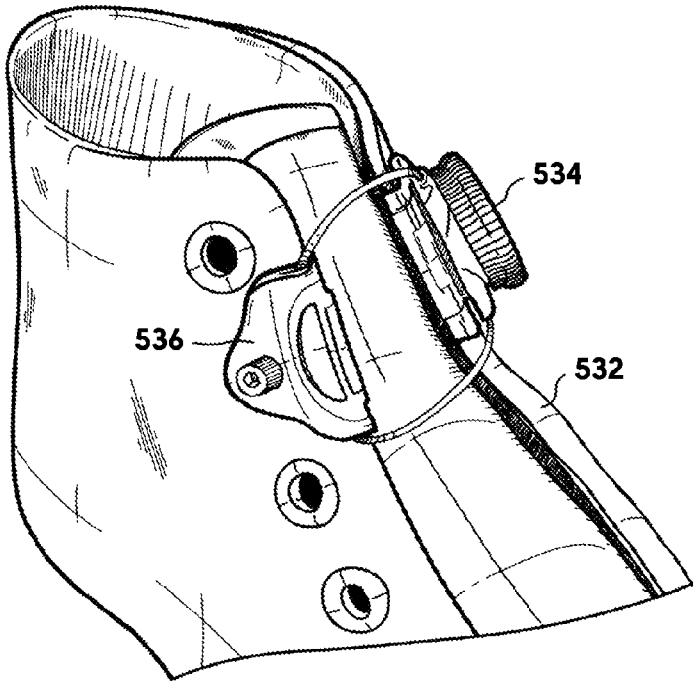
Figure 5F:
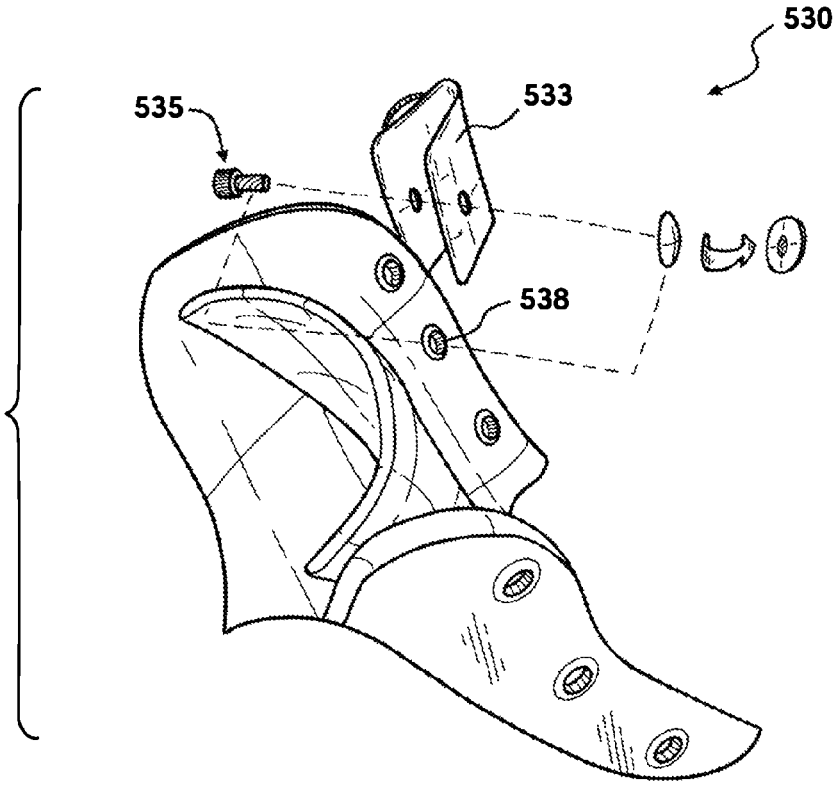
Figure 5G:
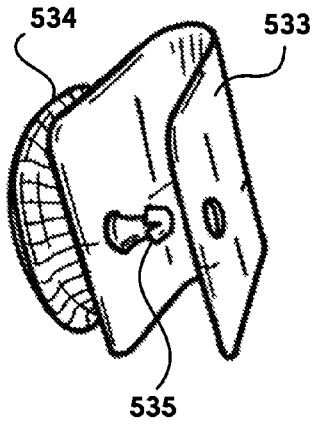
Figure 5H:
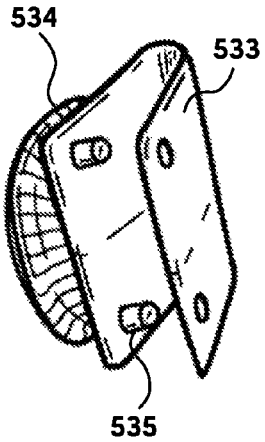

Referring now to FIGS. 5C and 5D, illustrated is another embodiment 520 of coupling a reel assembly 524 with a shoe 522. Specifically, in this embodiment one or more cable ties 526 may be inserted through an eyelet 528 of shoe 522 and further inserted through a corresponding aperture of the reel assembly 524 in order to couple the reel assembly 524 with the shoe 522. A head portion of the cable ties 526 may include a ratchet mechanism that allows a cable or wire of the cable tie 526 to be pulled through the head portion while preventing retraction thereof. In this manner the cable ties 526 may be inserted through eyelets 528 and through the apertures of reel assembly 524 and cinched down relative to these components to couple the reel assembly 524 with the shoe 522. The cable ties 526 may also be used to couple one or more guides 525 with shoe 522 in like manner. Alternatively, a lace guide may incorporate the ratchet mechanism and ratchet strip. In some embodiments, the cable tie 526 may be used as a guide for the lacing system's lace.

Referring now to FIGS. 5E-H, illustrated are other embodiments 530 of coupling a reel assembly 534 with a shoe 532. Specifically, reel assembly 534 is coupled with a clip body 533 that is inserted over the eyestay of shoe 532 and coupled relative thereto. The clip body 533 is coupled to the eyestay of shoe 532 by inserting a fastening mechanism 535 through an eyelet 538 of the eyestay and through corresponding apertures of the clip body 533. The fastening mechanism 535 may include one or more components that snap together in a releasable or non-releasable manner. In other embodiments, the fastening mechanism 535 includes components that thread, press fit, bond, and the like, together.

In some embodiments, the reel assembly 534 may be removably coupled with the clip body 533 so that the reel assembly 534 may be attached to clip body 533 after the clip body 533 is coupled with the eyestay of shoe 532 and/or so the reel assembly 534 may be removed from the clip body 533, such as for replacement, repair, cleaning, and the like. In other embodiments, a clip body 533 may be used to couple one or more guides 536 with the eyestay of shoe 532 and/or may be used as guides for the lace of the lacing system.

Figure 5I:
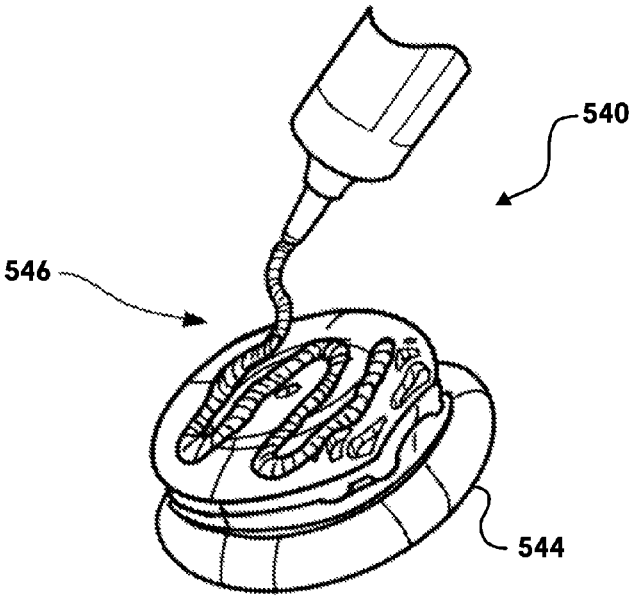
Figure 5J:
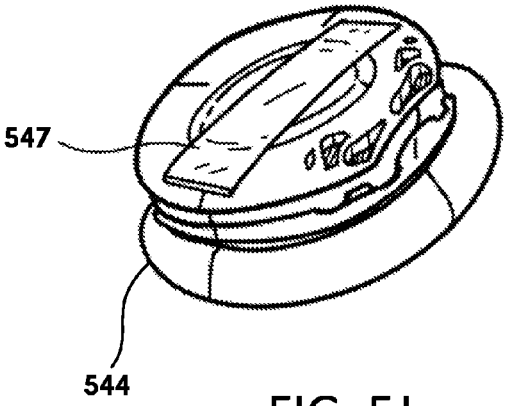

Referring now to FIGS. 5I and 5J, illustrated is another embodiment 540 of coupling a reel assembly 544 with a shoe. In this embodiment, reel assembly 544 may be adhesively bonded 546 (e.g., using hot melt and the like) to a portion of the shoe, such as to a tongue, eyestay, heel portion, and the like. Alternatively and/or additionally, other adhesive methods, such as the use of double-sided tape 547 may be used to couple the reel assembly 544 to the shoe.

In some embodiments, a locking tab (not shown) may be used to fasten a reel assembly to the shoe's tongue or to any other portion of the shoe. The reel assembly may include a slot or recess into which the locking tab is slid. A pair of fastening members may extend laterally across the slot such that when the locking tab is inserted within the slot, the fastening members holds or secures the tab in place. The shoe's tongue may also include a slot (e.g., slits cut into the fabric material of the tongue) through which the locking tab is inserted. The tongue's slot may be positionable between the fastening member of the reel assembly to allow the locking tab to be slid into the reel assembly's slot and the tongue's slot to secure the reel assembly to the shoe. Uncoupling the reel assembly from the shoe may be done in the reverse order.

The usage of rivets, bolts, and other mechanical fasteners, may be preferred when coupling a reel assembly to an eyestay because such components more fixedly couple the reel assembly to the shoe and thereby prevent rotation of the reel assembly relative to the shoe. Fixedly coupling the reel assembly to the shoe prevents reel torqueing and/or provides an improved user interface by providing a structure for the component (e.g., reel assembly) that a user interacts with. The structure may be provided by the reel assembly itself, by another component (e.g., the elongated tongue guides described herein), or the shoe via the fixed coupling. The relatively rigid coupling further prevents the reel assembly from moving or biasing relative to the shoe. These mechanical fasteners may likewise prevent the reel assembly from being pulled through the fabric of the shoe. Positioning and mounting of the reel assembly about the tongue may be preferred for higher power applications since the forces applied to the reel assembly by the lace are essentially equalized when the lace is positioned on opposite sides of the reel assembly.

Figure 6A:
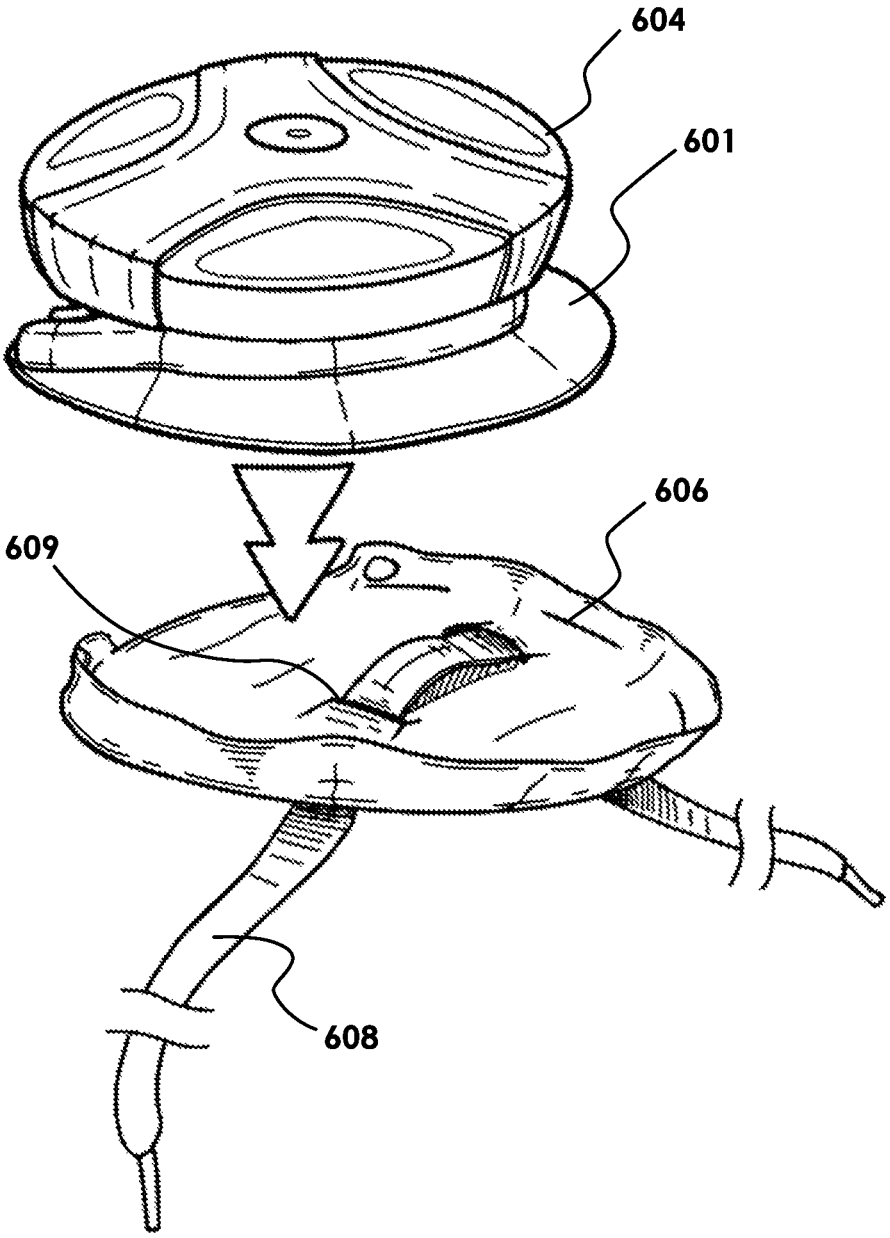
FIGS. 6A-P illustrate various other embodiments that may be employed to retrofit a tightening mechanism with a shoe or other article.
Figure 6B:
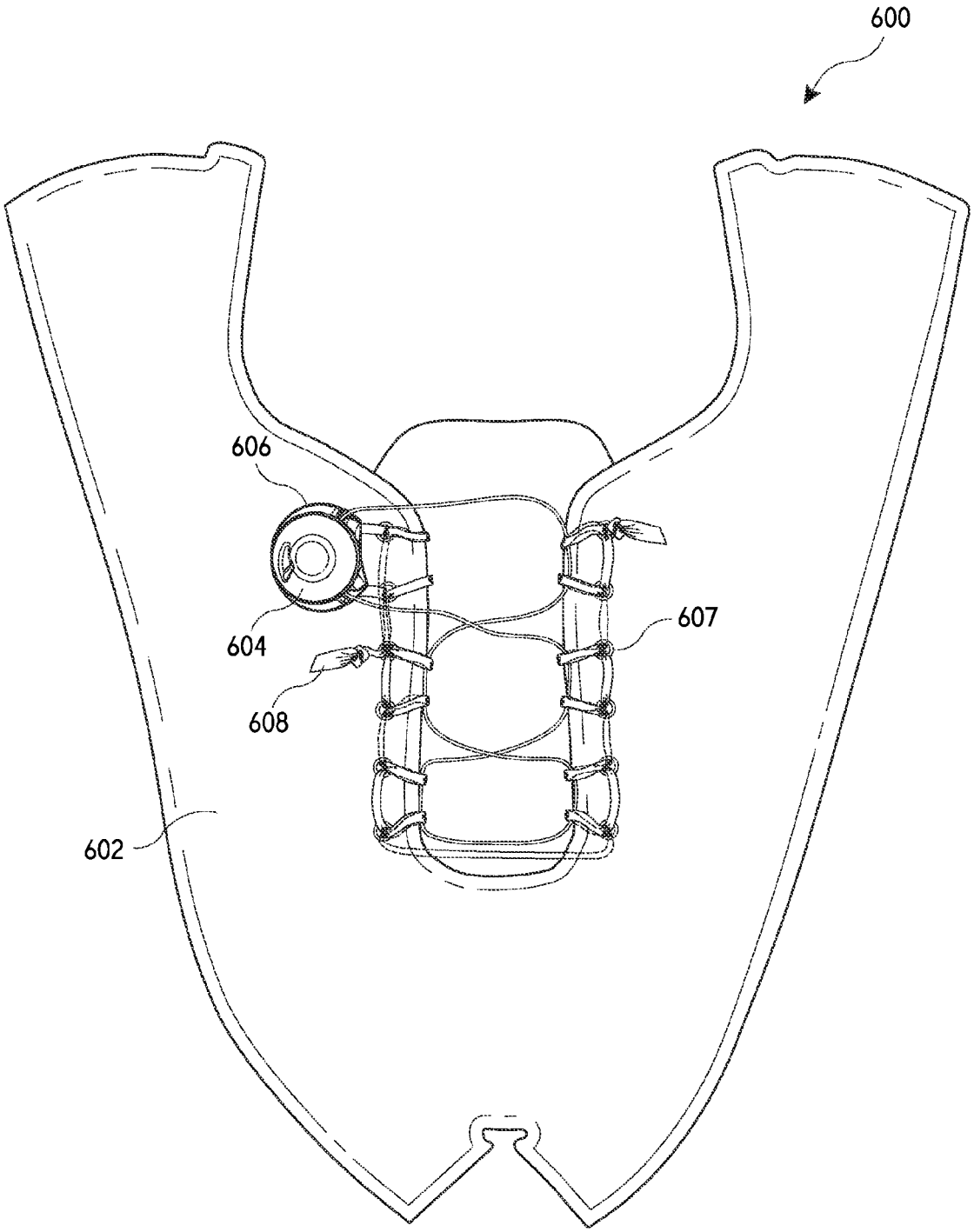
FIGS. 6Q-U illustrate various components that may be used to retrofit a tightening mechanism with a shoe or other article.
FIGS. 6V-Y illustrate various embodiments of elongated tongue panels that may be used to retrofit a shoe or other article with a tightening mechanism.
Figure 6C:
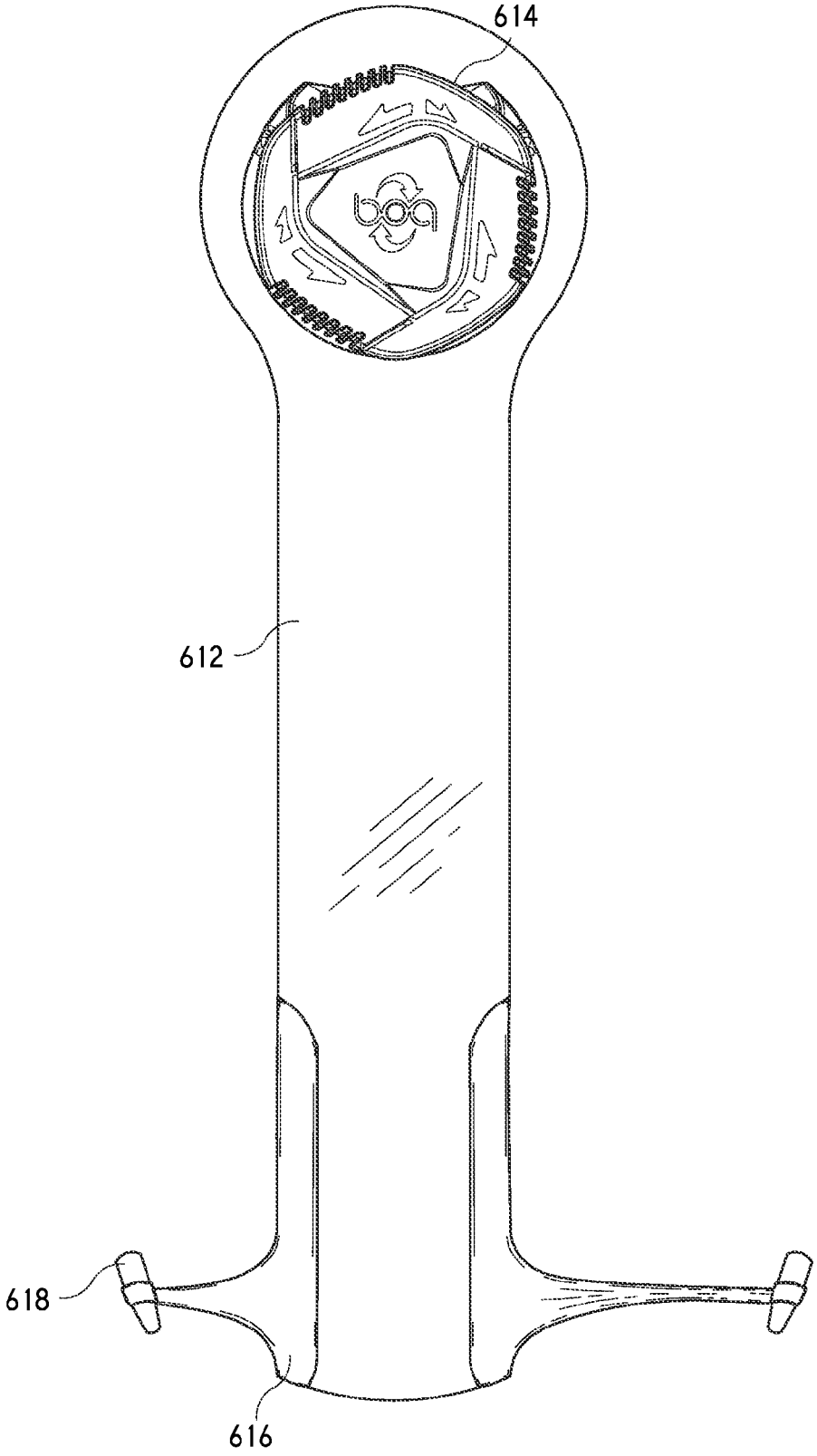
Figure 6D:
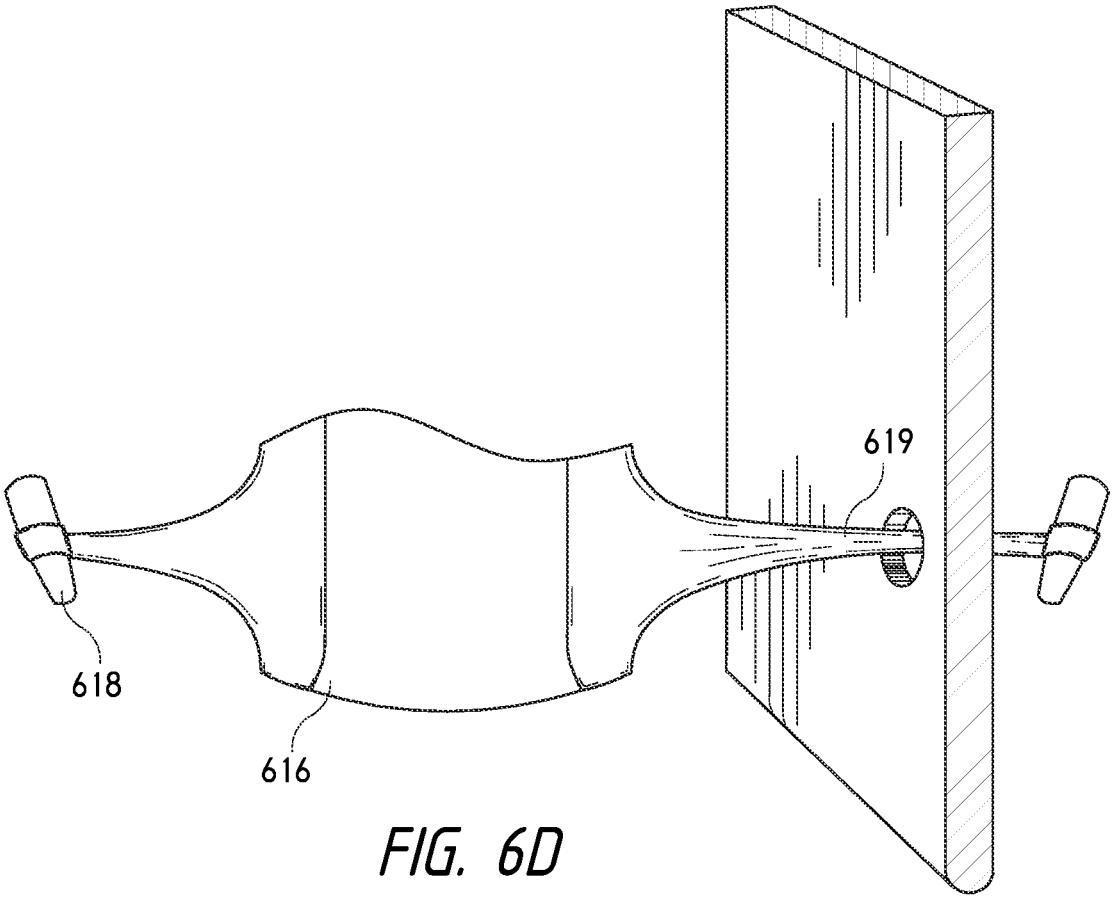
Figure 6E:
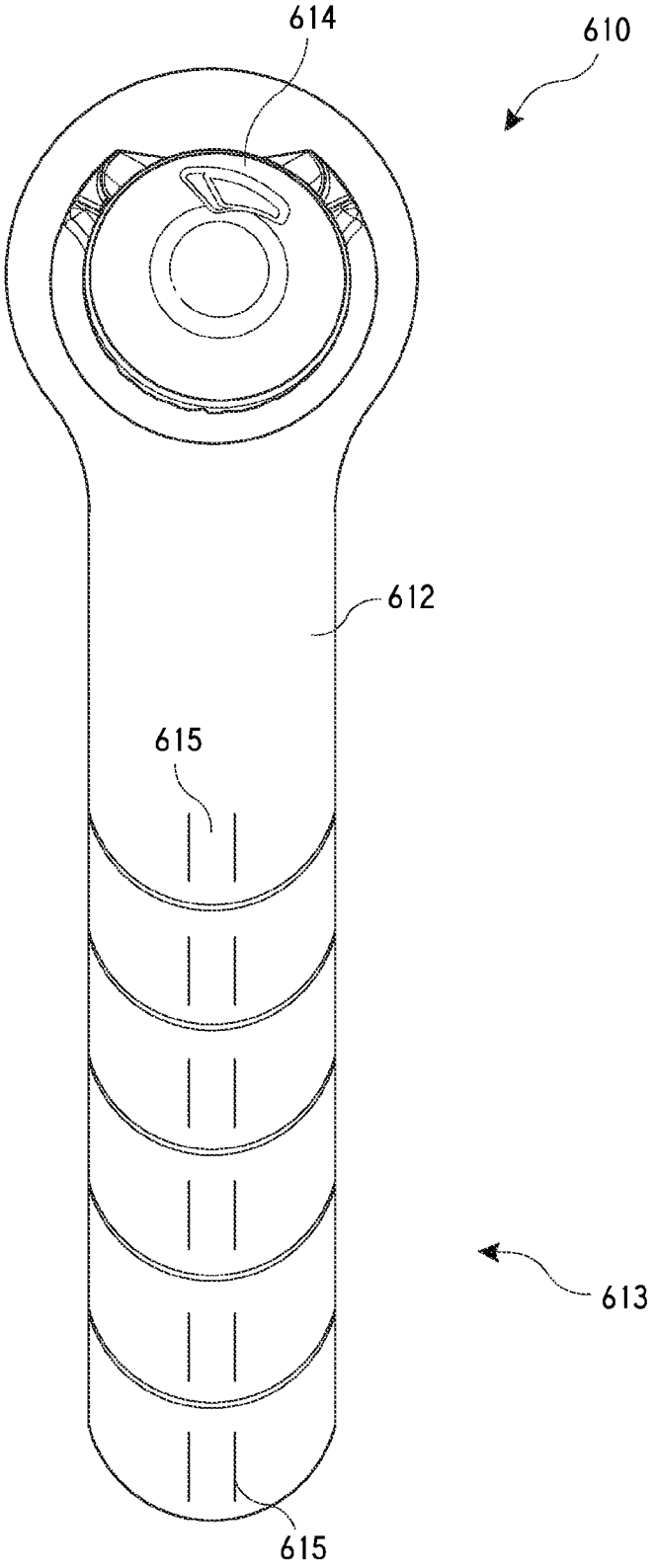
Figure 6F:
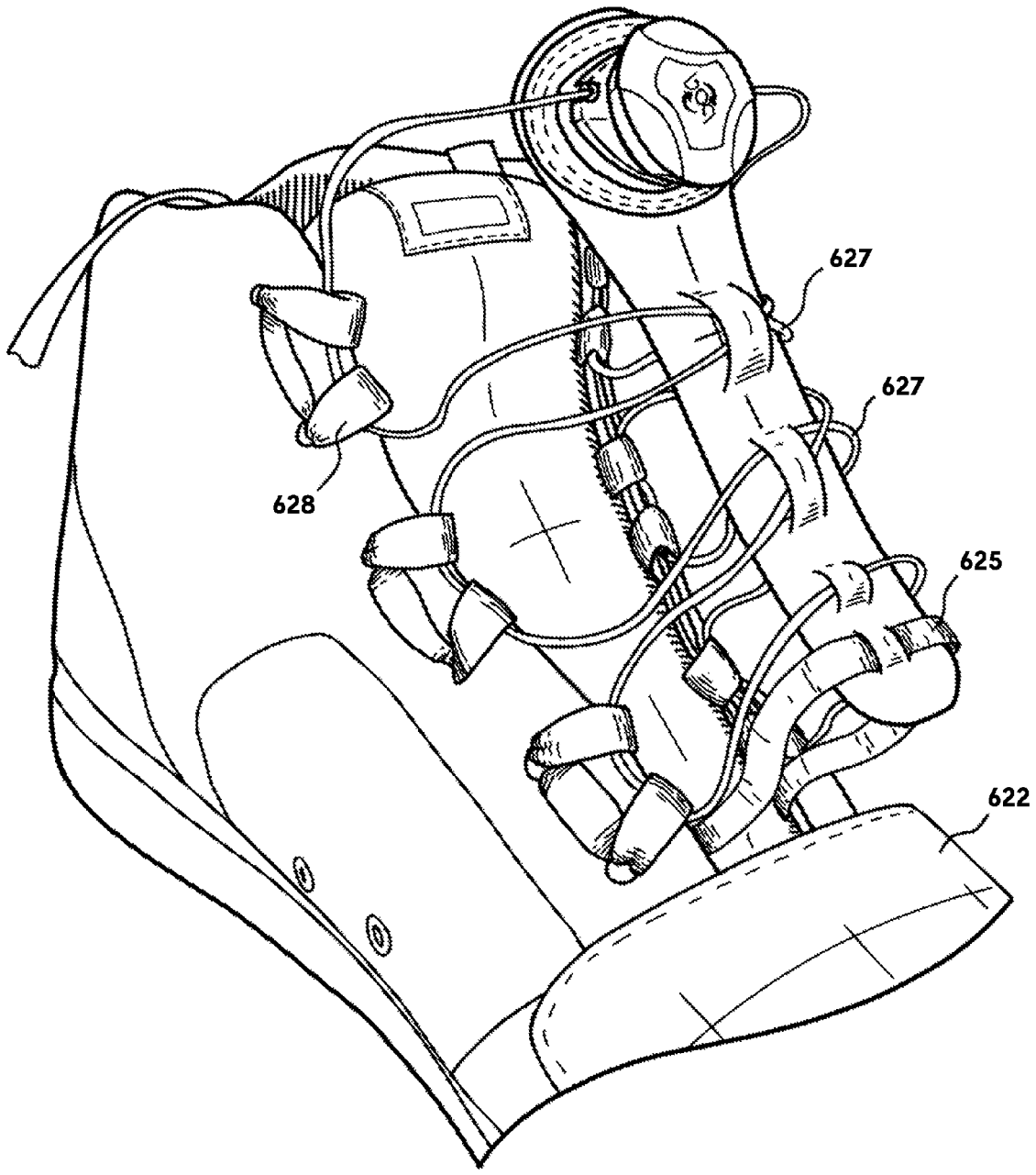
Figure 6G:
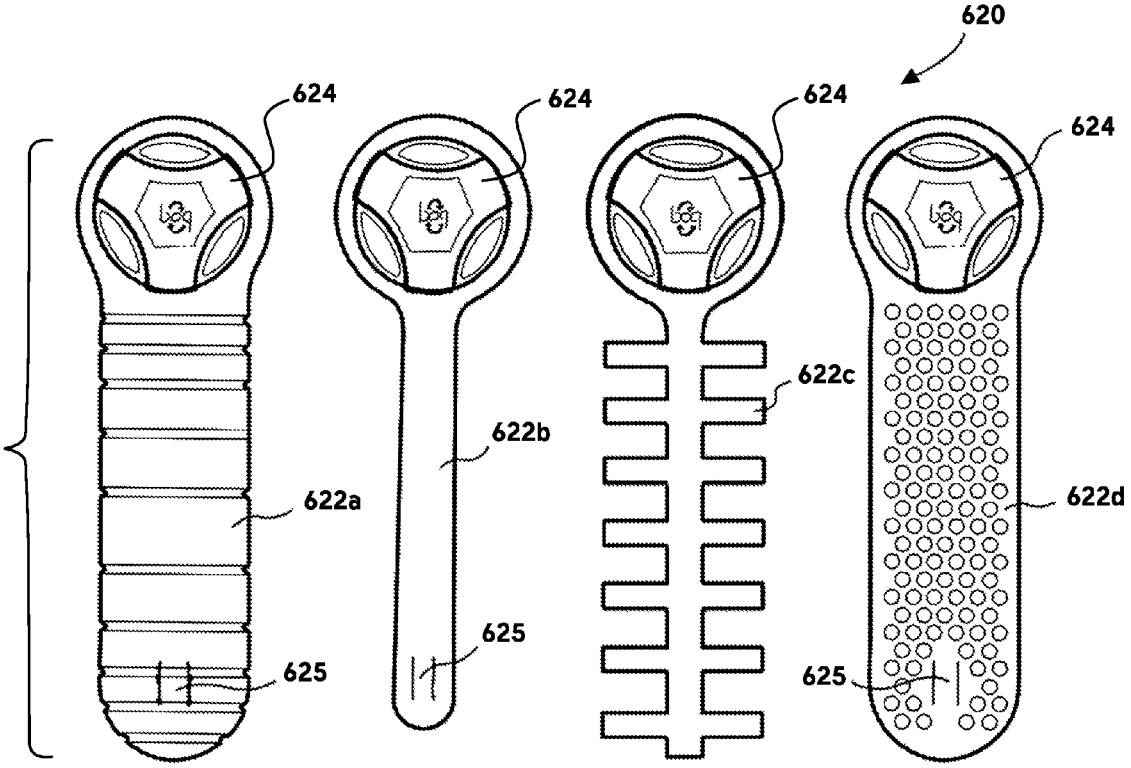
Figure 6H:
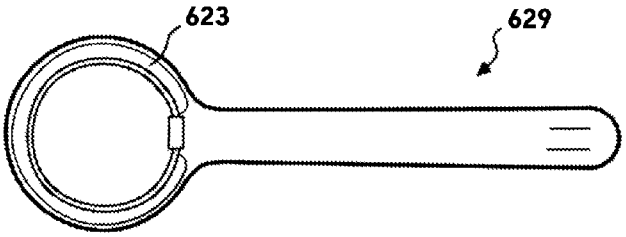
Figure 61:
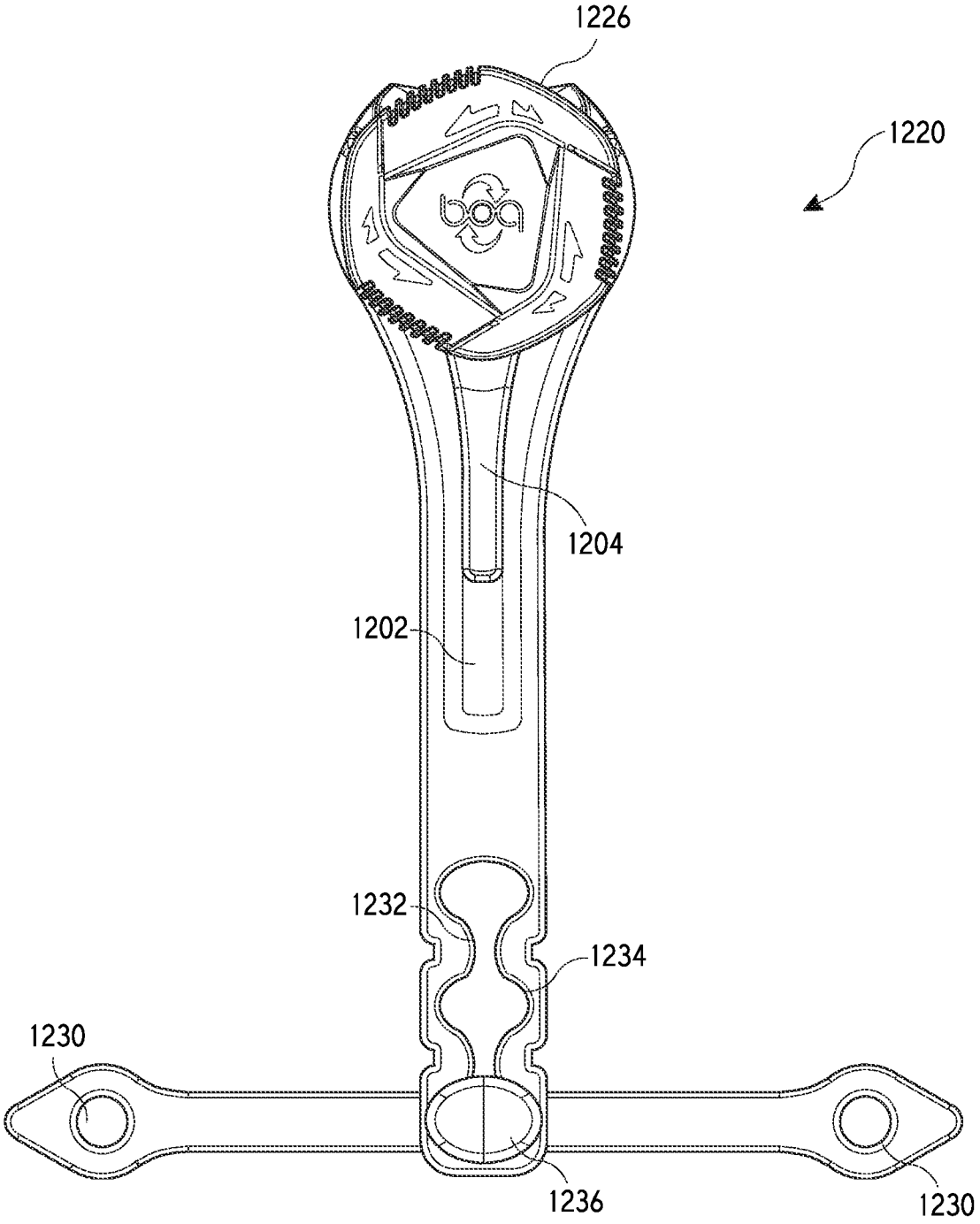
Figure 6J:
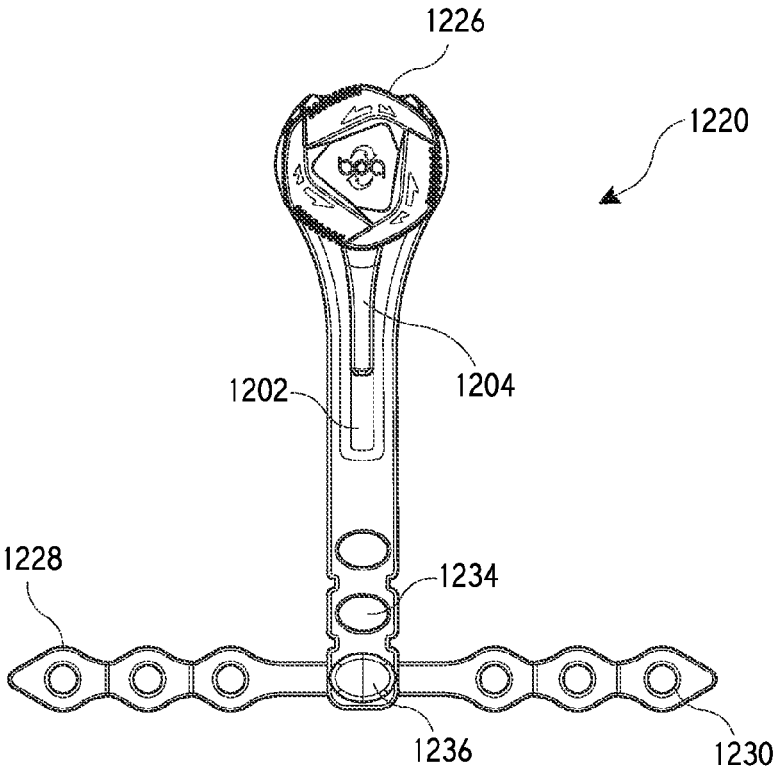
Figure 6K:
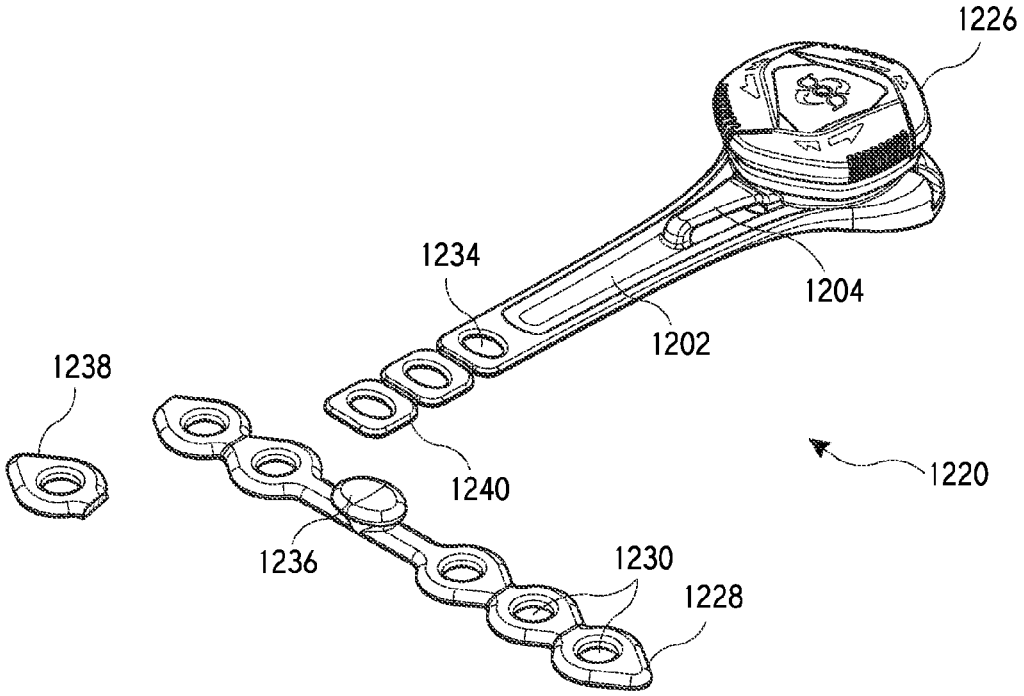
Figure 6L:
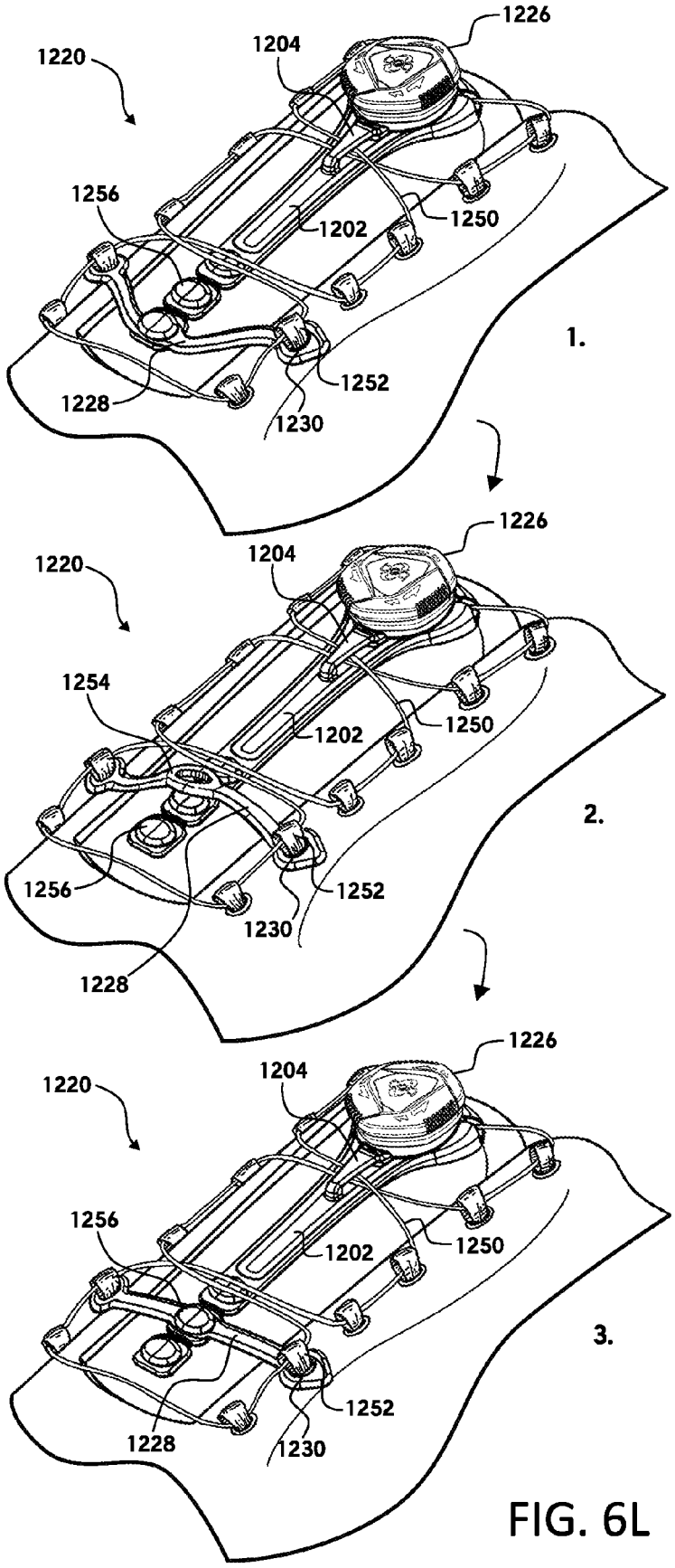
Figure 6M:
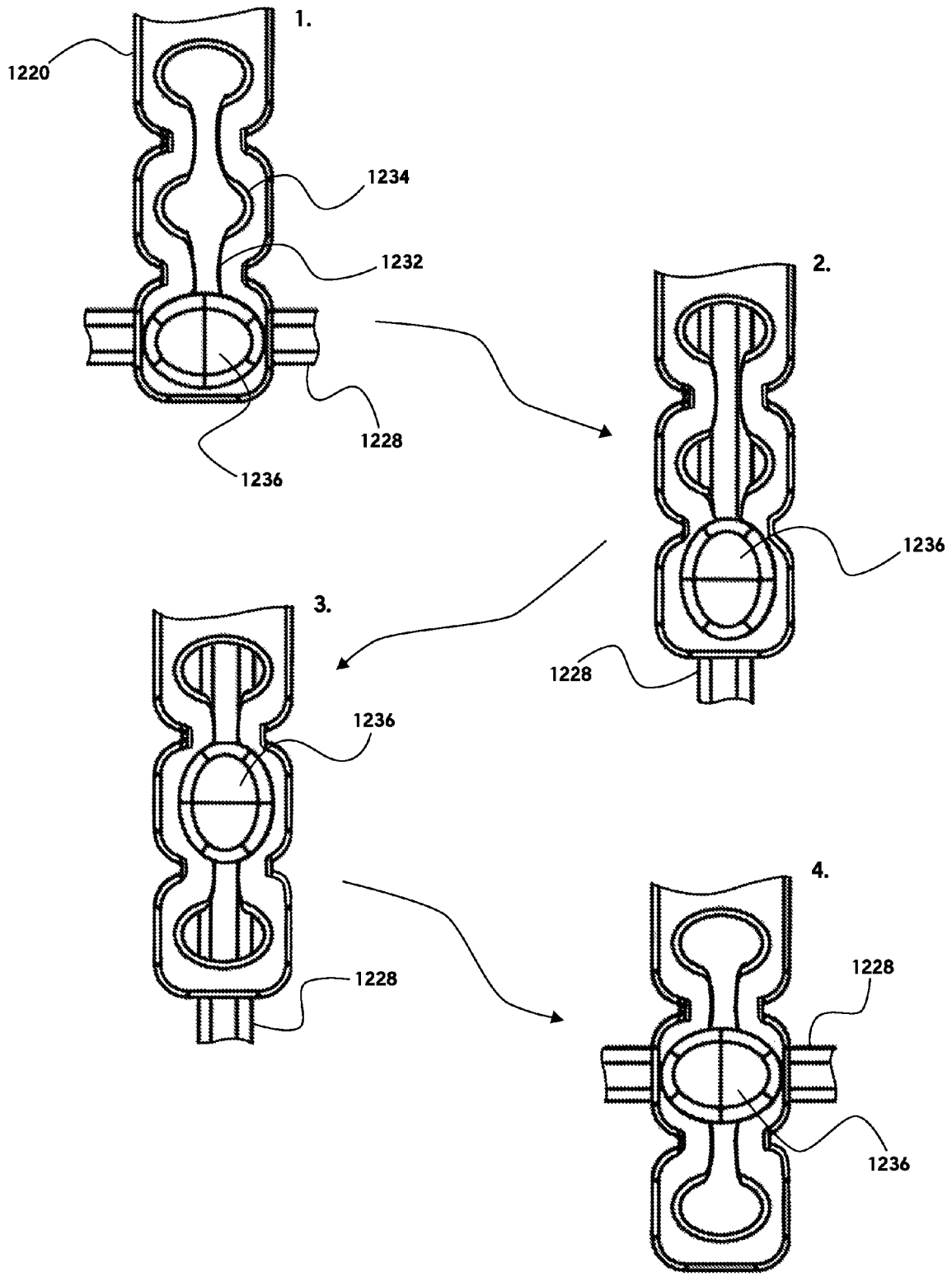
Figure 6N:
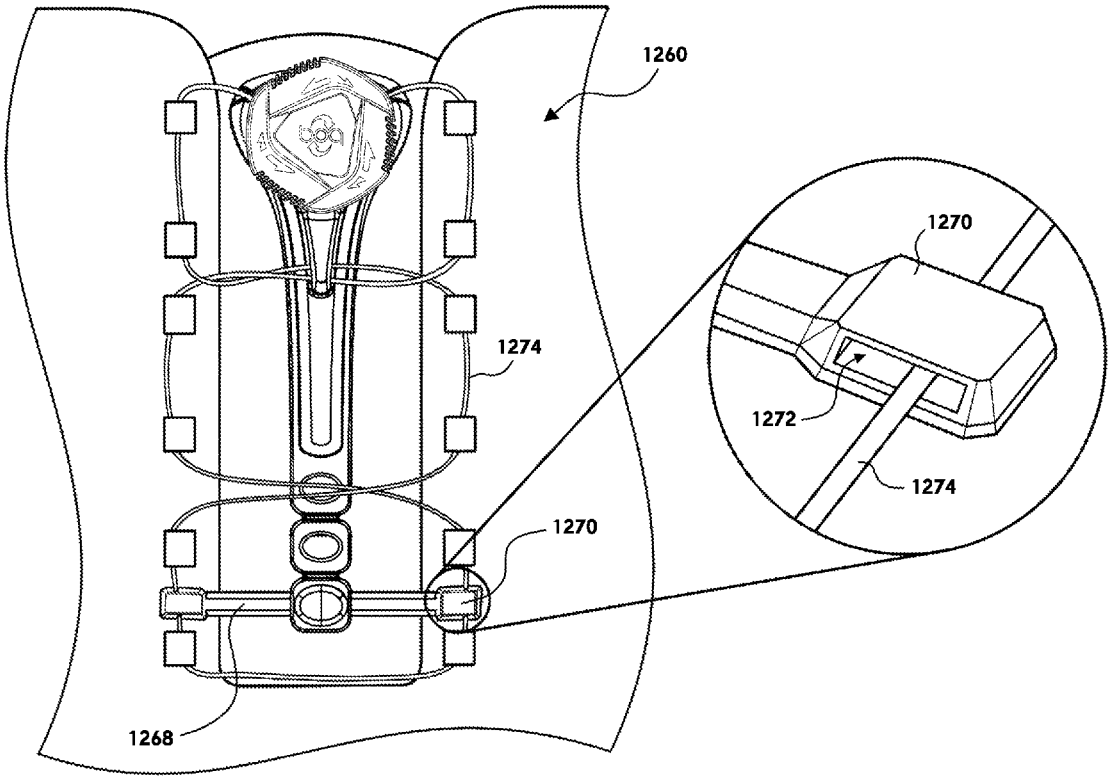
Figure 6O:
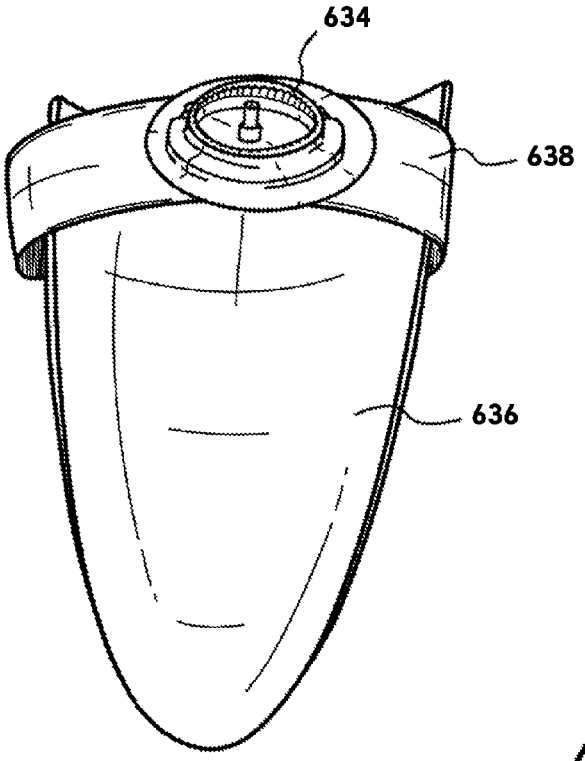

Referring now to FIGS. 6A-O, illustrated are various other embodiments of coupling a reel assembly with a shoe. In these embodiments, the reel assembly may not be directly coupled with the shoe, but may instead be coupled to one or more components that are in turn coupled with the shoe. As shown in FIGS. 6A and 6B, in one embodiment 600 a reel assembly 604 may be coupled with a sleeve 606 that is in turn coupled with shoe 602. The sleeve 606 is coupled with shoe 602 by inserting the shoe's lace 608 through slits or holes 609 in sleeve 606. The lace 608 is wound through eyelets 607 of shoe 602 to create guides for the lace (not numbered) of the lacing system as well as to couple sleeve 606 to shoe 602. The sleeve 606 is then wrapped around and coupled to bayonet 601 or sew flange of reel assembly 604. In some embodiments, the sleeve 606 may be wrapped around the sew flange or bayonet 601 and subsequently stitched to couple the reel assembly 604 to the sleeve 606. In another embodiment, the sleeve 606 may include an elastic band that pulls the sleeve 606 tight over the bayonet 601. Other methods of coupling the reel assembly 604 with the sleeve 606 may include adhesively bonding, mechanically fastening, and the like. This sleeve may be a fabricated textile and/or molded component. In an alternative embodiment, sleeve 606 may be a bayonet that removably couples with the reel assembly. The sleeve 606 may include one or more holes through which the lacing system's lace is inserted to be accessible to the reel assembly 604.

As shown in FIG. 6B, reel assembly 604 may be coupled with the eyestay of shoe 602. In other embodiments, reel assembly 604 may be coupled with a tongue portion or another portion of shoe 602. Likewise, a single shoelace 608 may be used to both couple sleeve 606 with shoe 602 and to create the various guides for the lacing system; or separate shoelaces may be used to create the lacing system guides and to couple sleeve 606 with shoe 602.

Referring now to FIGS. 6C-E, illustrated are other embodiments 610 of a component that may be coupled with a reel assembly 614 and a shoe (not shown). The component includes an elongated tongue panel 612 that may be placed on top of the shoe's tongue. When the elongated tongue panel 612 is placed atop the shoe's tongue, the lace (not shown) of the lacing system may traverse across the top surface of the elongated tongue panel 612. The elongated tongue panel 612 may include a relatively enlarged top portion that couples with reel assembly 614. In some embodiments, the elongated tongue panel 612 may include one or more slots 615 through which shoe's lace may be inserted to further couple the elongated tongue panel 612 atop the shoe's tongue. A bottom portion 613 of the elongated tongue panel 612 may be trimmable or otherwise removable so that the overall length of elongated tongue panel 612 may be adjusted to accommodate different sized shoes.

In some embodiments, an attachment member 618 (e.g., barrel, plug, and the like) may be coupled with a bottom portion of elongated tongue panel 612. The attachment member 618 may be couplable with the shoe, such as by inserting a barrel or plug through an eyelet 619 of the shoe. The attachment member 618 may be attached to the elongated tongue panel 612 via second shot molding of a low durometer TPU or TPE material, adhesive bonding, mechanically fastening, or using any other method known in the art. Attachment member 618 may be coupled to the elongated tongue panel 612 in a manner that allows the attachment member 618 to be pulled laterally from the elongated tongue panel 612 toward the shoe and coupled therewith.

Referring now to FIGS. 6G and 6H, illustrated are other embodiments 620 of elongated tongue panels, 622*a-d*, that may be used to indirectly couple a reel assembly 624 with a shoe 622. FIG. 6F shows an elongate tongue panel being coupled with the shoe 622. The elongated tongue panels, 622*a-d*, are similar to elongated tongue panel 612 previously described in that the elongated tongue panels, 622*a-d*, are configured to be placed atop a shoe's tongue with lace of the lacing system and/or a portion of a shoelace traversing across a top surface thereof. FIG. 6F illustrates the elongated tongue panel positioned atop the shoe's tongue and also illustrates a shoelace 628 being inserted through eyelets of the shoe 622 to create guides for the lace 627 of the lacing system as described herein below. The shoelace 628 may be inserted through a slit or hole 625 positioned at a distal end of the elongated tongue panel so as to reinforce the coupling of the elongated tongue panel atop the shoe's tongue. Lace 627 is inserted through webbing loops of the shoelace 628 and traverses over a top surface of the elongated tongue panel. Lace 627 may also be inserted through one or more slits (not numbered) of the elongated tongue panel as shown. The slits may function as additional guides for the lace 627, or may otherwise manage or tend lace 627 that traverses across the panel. Adapting shoe 622 so that the shoelace 628 forms the lace guides and so that the elongated tongue panel is positioned atop the shoe's tongue allows the shoe 622 to be easily retrofitted with the lacing system. The elongated tongue panels, 622*a-d*, provide low friction surfaces for the lace and also distribute lace pressure across the shoe's tongue. The elongated tongue panels, 622*a-d*, may also control the position of the lace crossings and may minimize tongue "puffiness" between crossings due to its increased rigidity compared with the shoe's tongue material. Various materials may be used for the elongated tongue panels, 622*a-d*, such as a variety of thermoplastics as well as laminates of textile and thermoplastic.

FIG. 6G illustrates that the elongated tongue panels, 622*a-d*, may have various designs or configurations depending on need, usage, or user preference. For example, a first elongated tongue panel 622*a* includes a plurality of hinged portions or living hinge lines that allow the elongated tongue panel 622*a* to be flexed along a longitudinal length thereof. This allows the elongated tongue panel 622*a* to be easily bent or flexed as a user moves or walks with the shoe 622. Elongated tongue panel 622*b* includes a narrow body portion that allows the elongated tongue panel 622*b* to be fit with shoes having a narrow tongue and/or allows the elongated tongue panel 622*b* to be easily flexed. Elongated tongue panel 622*c* includes a plurality of ribs that similarly allow the elongated tongue panel to be flexed while possibly preventing rotation of the elongated tongue panel 622*c* atop the shoe's tongue and/or decreasing shoe puffiness. Elongated tongue panel 622*d* includes a plurality of perforations that may increase the flexibility of elongated tongue panel 622*d* and/or increased ventilation through the elongated tongue panel 622*d*. The perforations of elongated tongue panel 622*d* may be matched to similar perforations of shoe 622.

As shown in FIG. 6H, in another embodiment, an elongated tongue panel 629 may include a bayonet 623 that allows a reel assembly 624 to be removably coupled with the elongated tongue panel 629. In this manner, the elongated tongue panel 629 may be fit and coupled to the shoe's tongue and a reel assembly 624 selected and coupled with the bayonet 623 depending on a user's need and/or usage.

The bayonet 623 allows a relatively rigid material housing to be used for the reel assembly 624 and coupled with the elongated tongue panel 629, which may be made of a relatively softer material. In some embodiments, the bayonet 623 may be made of a different material than the elongated tongue panel 629. For example, the bayonet 623 may be made of a relatively hard and rigid material with the elongated tongue panel 629 is made of a relatively soft material. The bayonet 623 may be coupled with the elongated tongue panel 629 via a snap fit, two shot molding process, adhesive bonding, insert molding, stitching, mechanical fastening (e.g., riveting), and the like. The two component bayonet 623 and elongated tongue panel 629 may provide added flexibility, weight savings or reduction, increased breathability, and the like. The two components may also allow the elongated tongue panel 629 and bayonet to be different colors so as to match a design of the shoe.

Referring now to FIGS. 6I-M, illustrated is another embodiment of an elongated tongue panel 1220 that may be used to retrofit a shoe or other article to include a reel assembly 1226. Elongate panel 1220 includes a main body portion 1202 that is designed to be positioned along the shoe's tongue as described above. A proximal or upper end is slightly larger than a distal or bottom end to accommodate the reel assembly 1226. The body portion 1202 may include a tongue guide 1204 that is spaced below the reel assembly 1226 and through which lace may be inserted. The tongue guide 1204 may aid in stabilizing the panel 1220 about the shoe's tongue in addition to guide or tending the lace. In some embodiments, the panel 1220 may include a bayonet or housing located at the proximal or upper end that allows the reel assembly 1226 to be removably coupled with the panel 1220.

The elongate panel 1220 includes a support or stabilizer member or members 1228 (hereinafter support member 1228) that anchor a bottom portion of the elongated panel 1220 relative to the shoe. The support member 1228 extends roughly orthogonally from the distal or bottom portion of the elongate panel's body 1202 and is configured to releasable couple with opposing sides of the shoe's tongue. By coupling the support member 1228 with opposing sides of the shoe, the support member 1228 stabilizes the elongate panel 1220, which improves the fit of the panel 1220 and/or reduces the time in retrofitting the shoe. The support member 1228 stabilizes the elongate panel 1220 relative to the shoe by preventing or limiting movement of the distal or bottom portion of the panel 1220 relative to the shoe. For example, rotational and/or translational movement of the distal or bottom portion of the panel 1220 is limited or prevented as the reel assembly's knob is grasped and rotated by a user.

To couple the support member 1228 with the opposing sides of the shoe, the support member 1228 includes one or more openings 1230 through which guide members for the lace are threaded and/or through which the lace is threaded. For example, FIG. 6L illustrates webbing guide members 1252, such as those described herein, inserted through the respective openings 1230 of the support member 1228. In other embodiments, plastic or relatively hard guide members may be inserted through the opening 1230 rather than the webbing guides 1252. In some embodiments, the support member 1228 is made of an elastomeric material, which can allow for lateral adjustment by stretching of the support member 1228. For example, the stabilizer member 1208 can have a hardness of 45-60 as measured on a shore A durometer.

The support member 1228 coupled with the elongate panel 1220 so as to adjustable longitudinally relative to the panel 1220. As used herein the term longitudinally means in a direction measured from the upper portion of the panel 1220 to the lower portion of the panel. To enable longitudinal adjustment of the support member 1228, the elongate panel 1220 may include a channel 1232 that includes one or more positioning apertures 1234. The support member 1228 includes a knob 1236 that can be inserted through one of the positioning apertures 1234 to couple the support member 1228 with the elongate panel 1220. In some embodiments, the knob 1236 may be oval or non-circular in shape so that rotation of the knob 1236 within the positioning aperture 1234 locks or coupled the components together. For example, the knob 1236 and support member 1228 may be aligned with the body 1202 of panel 1220 to allow the knob 1236 to be inserted within a positioning aperture 1234. The support member 1228 and knob 1236 may then be rotated (e.g., 90 degrees) so that the knob 1236 engages with the positioning aperture 1234 and prevents or hinders withdrawal of the knob 1236 from the positioning aperture 1234.

FIG. 6M illustrates a process for adjusting the location of the support member 1228 about or relative to the elongate panel 1220. As shown in step 1, the support member 1228 is located in a distal most positioning aperture 1234. The knob 1236 is positioned with its widest portion oriented orthogonally to the panel's longitudinal axis, which orientation prevents or hinders withdrawal of the knob 1236 from the positioning aperture 1234. At step 2, the support member 1228 is rotated into alignment with the panel's longitudinal axis, which rotates the knob 1236 so the widest part of the knob is aligned with the positioning aperture 1234 and channel 1232. This position of the knob 1236 allows the knob 1236 to be removed from the positioning aperture 1234 and repositioned within another positioning aperture, such as a more proximal positioning aperture as shown in step 3. At step 4, the support member 1228 may be rotated relative to elongate panel 1220 so that the support member 1228 extends roughly orthogonally from the panel's longitudinal axis, which rotates the knob 1236 so that the widest part of the knob is again oriented orthogonally relative to the panel's longitudinal axis thereby locking the support member 1228 and panel 1220 in place. The positioning of the support member 1228 may be adjusted proximally and distally relative to the elongate panel 1220 by performing the above process.

As shown in FIG. 6K, in some embodiments distal end segments 1240 of the elongate panel 1220 may be removed from the panel 1220 to allow the panel to be shortened and sized to a particular shoe. Similarly, end portions 1238 of the support member 1228 may be removed to allow the support member 1228 to be shortened and sized to a particular shoe. In this manner, either or both the panel 1220 and support member 1228 may be adjusted to accommodate feet and shoes of various shape and size.

FIG. 6L illustrates an elongate tongue panel 1220 that is coupled with a shoe and about the tongue portion of the shoe. Specifically, the main body portion 1202 of the panel 1220 is positioned longitudinally along the shoe's tongue. The lace 1250 of the lacing system is threaded through the tongue guide 1204 of the panel and through the guide members 1252 that are inserted through the shoe's eyelets. The lace 1250 extends along a path about or along the shoe between the various lace guides. As described above, the support member 1228 is attached to opposing sides of the shoe by inserting the guide members 1252 through the opening 1230 of the support member 1228.

Unlike the previously described support members, the support member 1228 of FIG. 6L includes an aperture 1254 that snaps over a post 1256 positioned on the distal end of the elongate panel 1220. The aperture 1254 and post 1256 arrangement of the support member 1228 and panel 1220, respectively, allow the position of the support member 1228 to be quickly and easily adjusted about the panel 1220 as shown in steps 1-3. For example, by snapping the aperture 1254 over the post 1256, an adjustment of the position of both components can easily accomplished without removing the lace 1246 from the shoe. After attaching the panel 1220 with the shoe, the reel assembly 1226 may be operated to tension the lace 1250 and thereby tighten the shoe.

Referring now to FIG. 6N, illustrated is another embodiment of a elongate panel 1260. Panel 1260 is similar to those previously described, but includes an alternate configuration of the support member 1268 in that the support member 1268 is configured to directly couple with the tensioning system's lace 1274. To enable direct coupling of the support member 1268 with the lace 1274, the opposing ends 1270 of the support member 1268 includes lumens 1272 that are oriented so that the lumen's axis aligns with the lace 1274. This alignment allows the lace 1274 to be inserted through the lumen 1272 of the support member 1268, which directly couples the support member with the lace. The direct coupling may reduce the overall size of the panel 1260.

The elongate panels of FIGS. 6I-N are particularly useful for enabling a tensioning mechanism to be coupled with the shoe and removed therefrom without damaging the footwear so that upon removal of the tensioning mechanism, the previous coupling or attachment of the tensioning mechanism with the footwear is not readily recognizable or detectable. For example, since the elongate panel and all the components attached thereto (e.g., the reel assembly, support member, lace, etc.) are positioned atop the shoe's tongue and essentially float relative thereto, the elongate panel and components do not produce or leave visible signs of the panel and components being coupled with the shoe. Stated differently, the shoe does not need to be altered or modified in coupling or attaching the elongate panel and components with the shoe, which results in essentially no detectable indications of the panel and components being coupled with the shoe.

It should be realized that the use of the terms unrecognizable, not readily detectable, not readily visible, and the like as used herein in describing the coupling of the tensioning mechanism with shoes does not imply that the coupling is entirely undetectable. For example, the elongate panel and/or components thereof (e.g., reel assembly, support member, etc.) may slightly scuff or scar the shoe after an extended period of time and/or use. These scuffs or scars may be detectable upon close inspection of the shoe, but are mainly unrelated to any damage the shoe may experience during the actual coupling of the tensioning mechanism with the shoe. The terms unrecognizable, not readily detectable, not readily visible, and the like as used herein refer more to how the shoe is not significantly damaged, modified, and/or altered during coupling, which would produce readily detectable signs or indications of coupling. Significant damaging, modification, and/or alteration of the shoe readily occurs in conventional retrofitting processes, which involve puncturing the shoe, stitching, adhesive bonding, heat pressing or welding, and the like. These actions typically change the structure of the shoe to some degree and leave or result in signs or indications of the damage or alterations. In contrast, the elongate panels of FIGS. 6I-N utilize the existing features and/or components of the shoe to enable coupling of the tensioning mechanism and the shoe. The utilized existing features and/or components include the shoe's eyelets, tongue, and the like.

The elongated tongue panels described herein may include plastic members made of a relatively low friction material so as to create a lower friction surface upon which the lace of the lacing system slides. This may allow the lace to more easily be pulled across the shoe's tongue and facilitate in closing the opposing sides of the shoe with the lacing system. The elongated tongue panels may also press downwardly against the shoe's tongue as the lacing system is tensioned to reduce "puffiness", or in other words, reduce portions or areas of the tongue that protrude outwardly against the lacing system's lace during tensioning thereof. As described herein, the elongated tongue panels are generally free-floating atop the surface of the shoe's tongue. In other embodiments, however, elongated tongue panels may be fixedly fastened to the shoe's tongue, such as by sewing or adhesively bonding the elongated tongue panel to the shoe's tongue. In still other embodiments, fasteners may be used to couple the elongated tongue panel to the shoe's tongue, such as self-tapping screws, nut and bolt assemblies, double sticky sided tape, various plugs, iron-on adhesive materials, and the like.

Figure 6P:
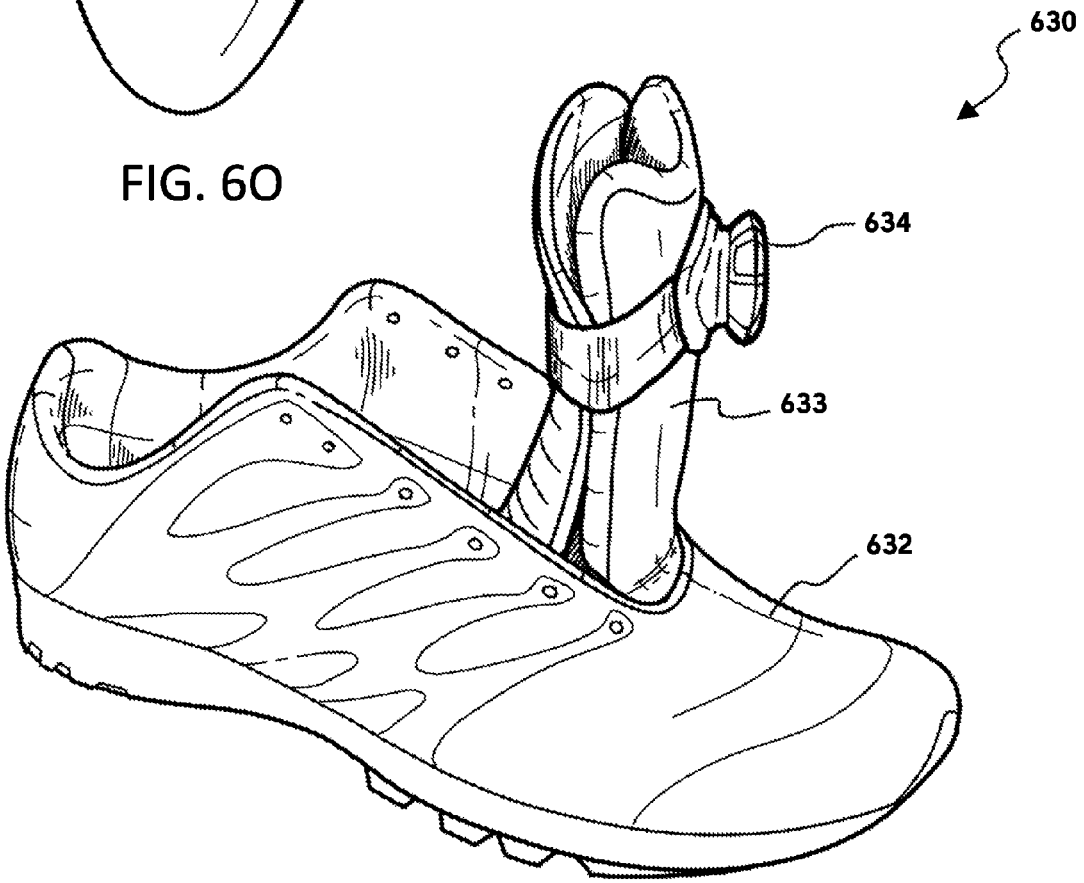
Figure 6Q:
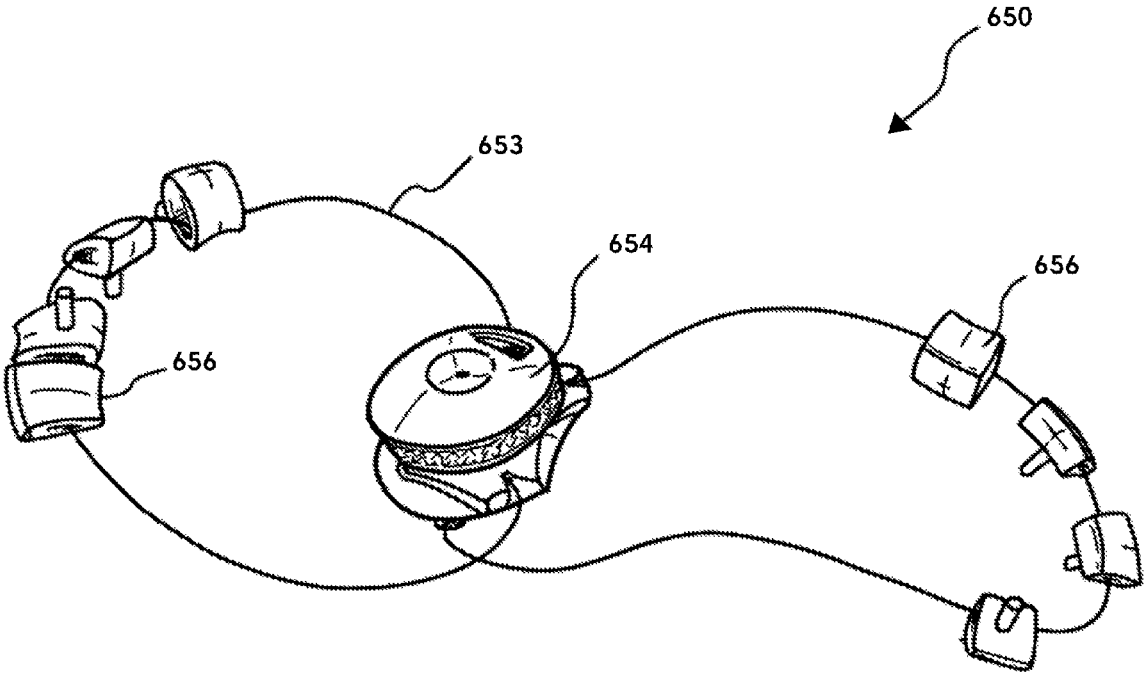
Figure 6R:
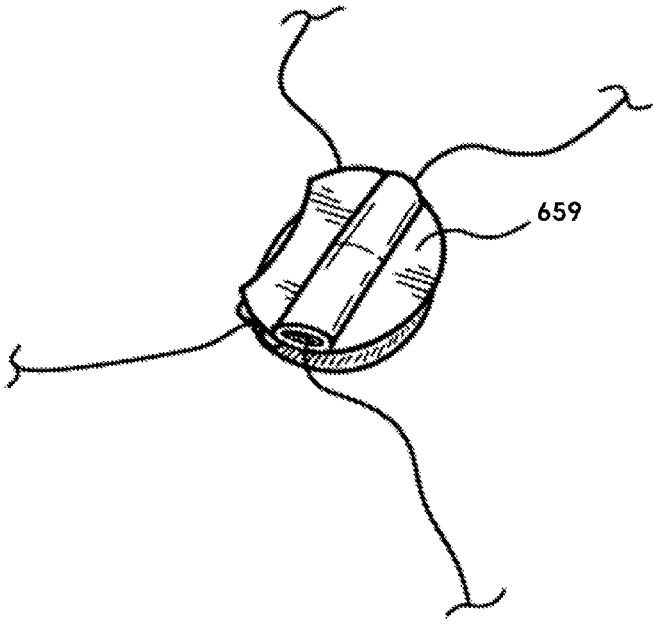
Figure 6S:
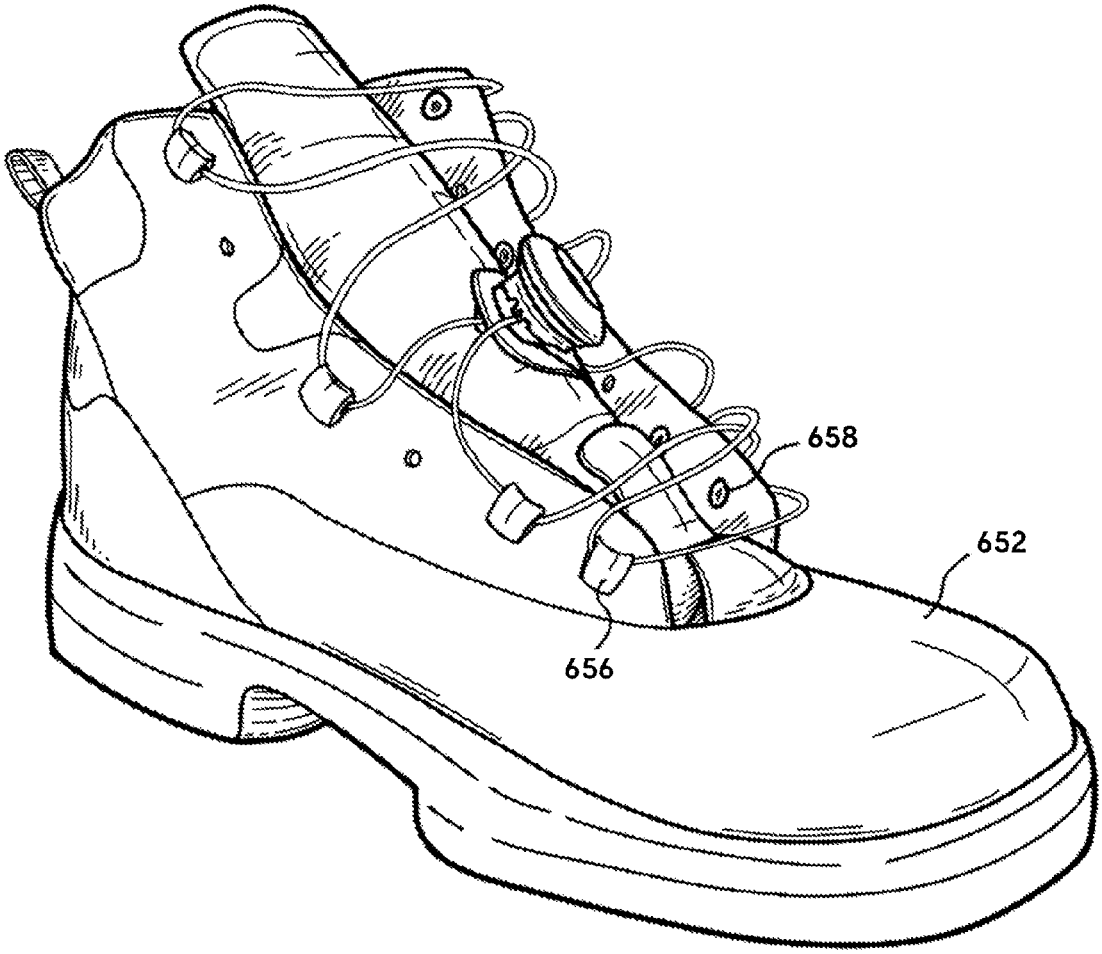

Referring now to FIGS. 6O and 6P, illustrated is another embodiment 630 of a component that may be used to couple a reel assembly 634 with a shoe 632. Specifically, FIGS. 6O and 6P illustrate a panel 636 that includes a strap 638 that wraps around a front surface of the panel 636 and couples with a reel assembly 634. To couple the reel assembly 634 with the shoe 632, the panel 636 is positioned on a rear surface of the shoe's tongue 633 with the strap 638 wrapping around a front surface of the shoe's tongue 633. In this configuration, the reel assembly 634 is positioned in front of the shoe's tongue 633. The panel 636 positions the reel assembly 634 near a top surface of the shoe's tongue 633, although the position of the reel assembly 634 relative to the shoe's tongue 633 may be adjusted as desired. In some embodiments, the distal portion of the panel 636 and/or the side portions of the panel 636 may be trimmable so that the panel 636 may be adjusted to accommodate for various shaped and sized shoes.

In some embodiments, a strap may be coupled with the reel assembly or with a bayonet or housing that releasably couples with the reel assembly. The strap may include a buckle, such as a ladder lock buckle, that allows the size of a looped region of the strap to be adjusted by pulling the strap through buckle. To couple the reel assembly with the shoe, and specifically the shoe's tongue, the strap may be wrapped around the shoe's tongue and pulled through the buckle until the looped region substantially constricts about the shoe's tongue. In some embodiments, the looped region of the strap may include a backing component that is positioned against a back surface of the reel assembly's housing. The backing component may be positioned against the outer surface of the shoe's tongue to provide a relatively rigid surface and prevent the shoe's tongue from collapsing as the strap is pulled through the buckle and constricted about the tongue.

Referring now to FIGS. 6Q-U, illustrated is another embodiment 650 of a component that may be used to couple a reel assembly 654 with a shoe 652. The component of FIGS. 6Q-U is configured to "free float" atop the shoe's tongue when the component is coupled with shoe 652. The term "free float" describes that the reel assembly 654 is not fixedly attached to the shoe 652, or the shoe's tongue, in a manner other than via the guides 656 and lace 653 that are coupled with the shoe 652. Because the reel assembly 654 is not fixedly attached to shoe 652, the reel assembly 654 is able to move or "float" relatively freely atop the shoe 652, and specifically atop the shoe's tongue. The embodiments of FIGS. 6Q-U represent an all-in-one unit that is coupleable with footwear. The lace or tension member is fixedly attached to the reel assembly or tensioning mechanism prior to coupling of the tensioning mechanism with the footwear. The guide members are likewise slidingly coupled with the tension member prior to coupling with the footwear.

Figure 6T:
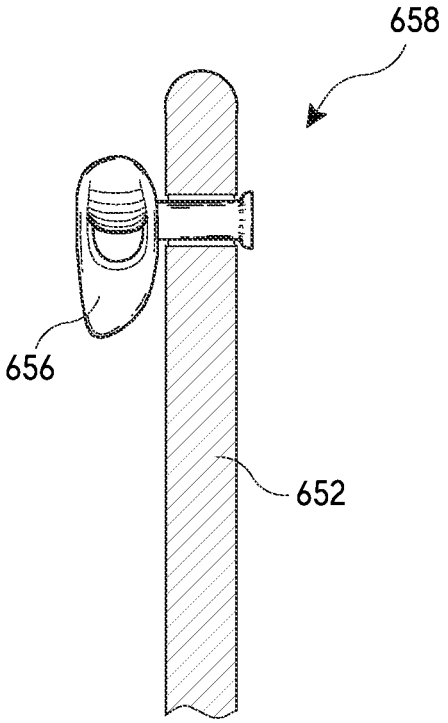
Figure 6U:
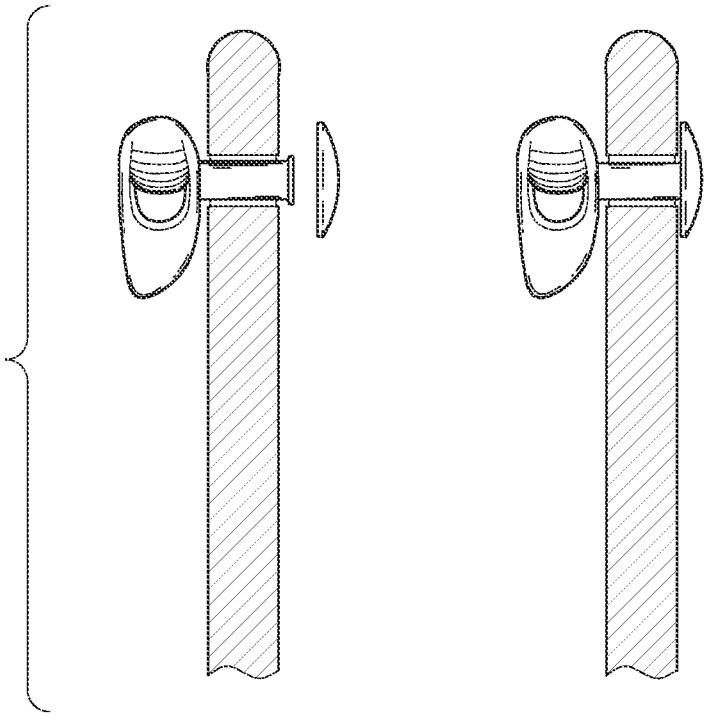

As shown in FIGS. 6T and 6U, coupling the component with the shoe 652 is achieved by inserting guides 656 within eyelets 658 of shoe 652. Each of the guides 656, or in some embodiments some of the guides, may include a post that is insertable into an eyelet of the shoe 652. The post of each guide 656 may be riveted so that the guide 656 is fixedly coupled with shoe 652. In other embodiments, mechanical fasteners, such as snaps, screws, bolts, and the like may be used to mechanically fasten the guide 656 within the eyelets of the shoe 652.

The lace 653 of the lacing system is connected to the reel assembly 654 and guides 656 such that the reel assembly 654 is indirectly coupled with the shoe 652 in a free floating manner. The lace 653 is coupled to reel assembly 654 by being inserted through one or more channels 659 positioned in the reel assembly's housing. In one embodiment, the lace extends from the spool of reel assembly 654 and through a plurality of guides 656 that are coupled with an upper region of the shoe 652. The lace 653 then passes through the channel 659 of reel assembly 654 and through a plurality of guides 656 that are coupled with a lower region of shoe 652. The lace 653 terminates at the housing and/or spool of reel assembly 654. In this arrangement, reel assembly 654 is positioned between the upper and lower regions of shoe 652 and free floats at a roughly central point relative to shoe 652. The arrangement of FIGS. 6Q-U allow the lacing system to be easily coupled with a shoe 652 without essentially damaging any portion thereof. The component may be preassembled with guides 656 attached to the lace 653, or a user can determine a number of guides 656 to use and couple the guides 656 with the lace 653. In some embodiments, reel assembly 654 may be coupled with either an upper portion of lace or a lower portion of lace, but not both portions.

Figure 6V:
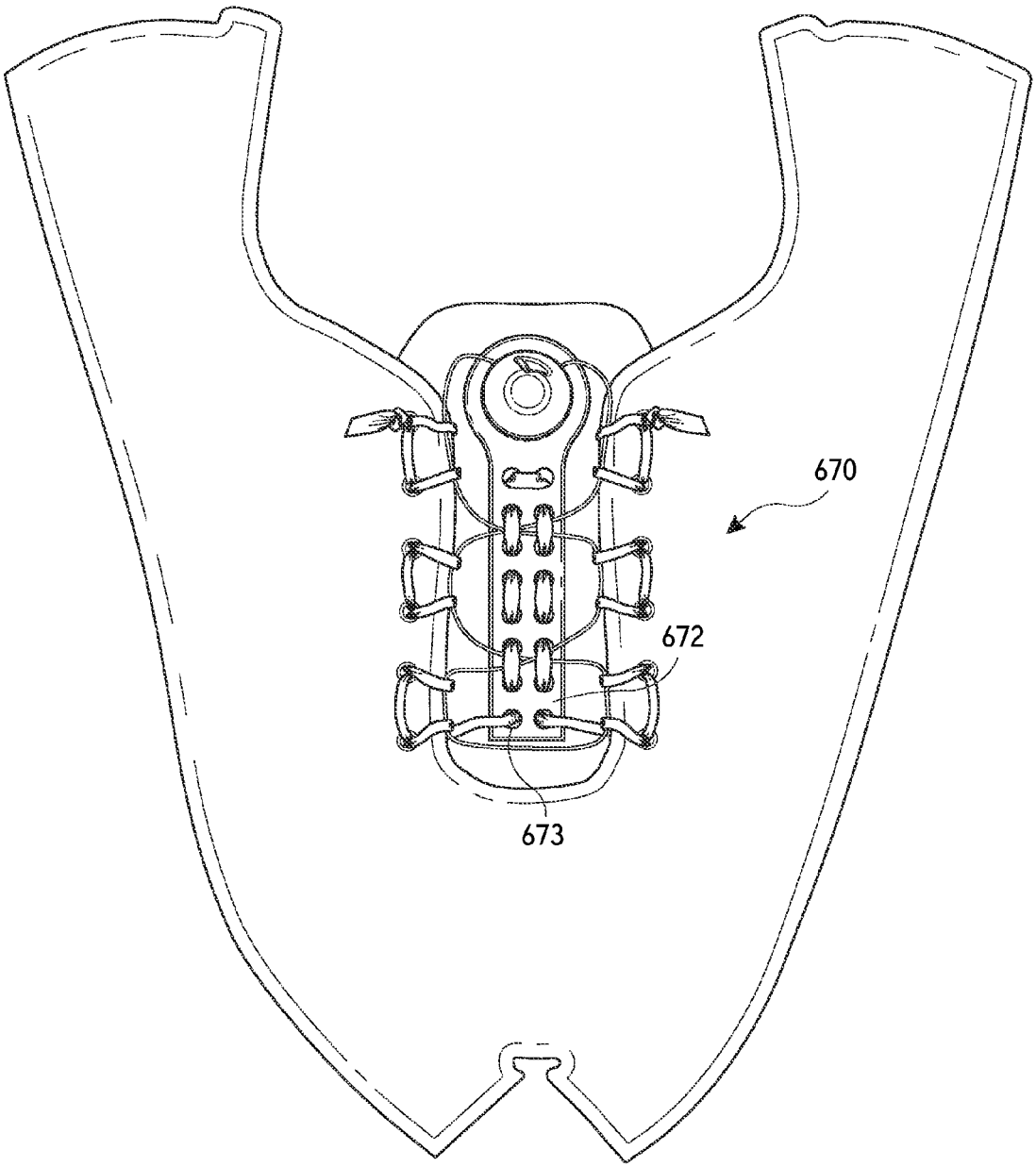

FIGS. 6V-Y, illustrate various other embodiments of the elongated tongue panels that may be used to retrofit a shoe or other apparel to include a reel assembly. FIG. 6V illustrates one embodiment of an elongated tongue panel 670 that includes a main body portion 672 having a plurality of holes 673 spaced and arranged longitudinally there along. As shown in FIG. 6V, a shoelace, webbing, or other fabric or material may be threaded through the holes 673 so that the elongated tongue panel 670 is securely attached to the tongue of the shoe. The webbing loops that are created by weaving the shoelace through the plurality of holes 673 may function as webbing guides for the lacing system's lace as shown in FIG. 6V.

Figure 6W:
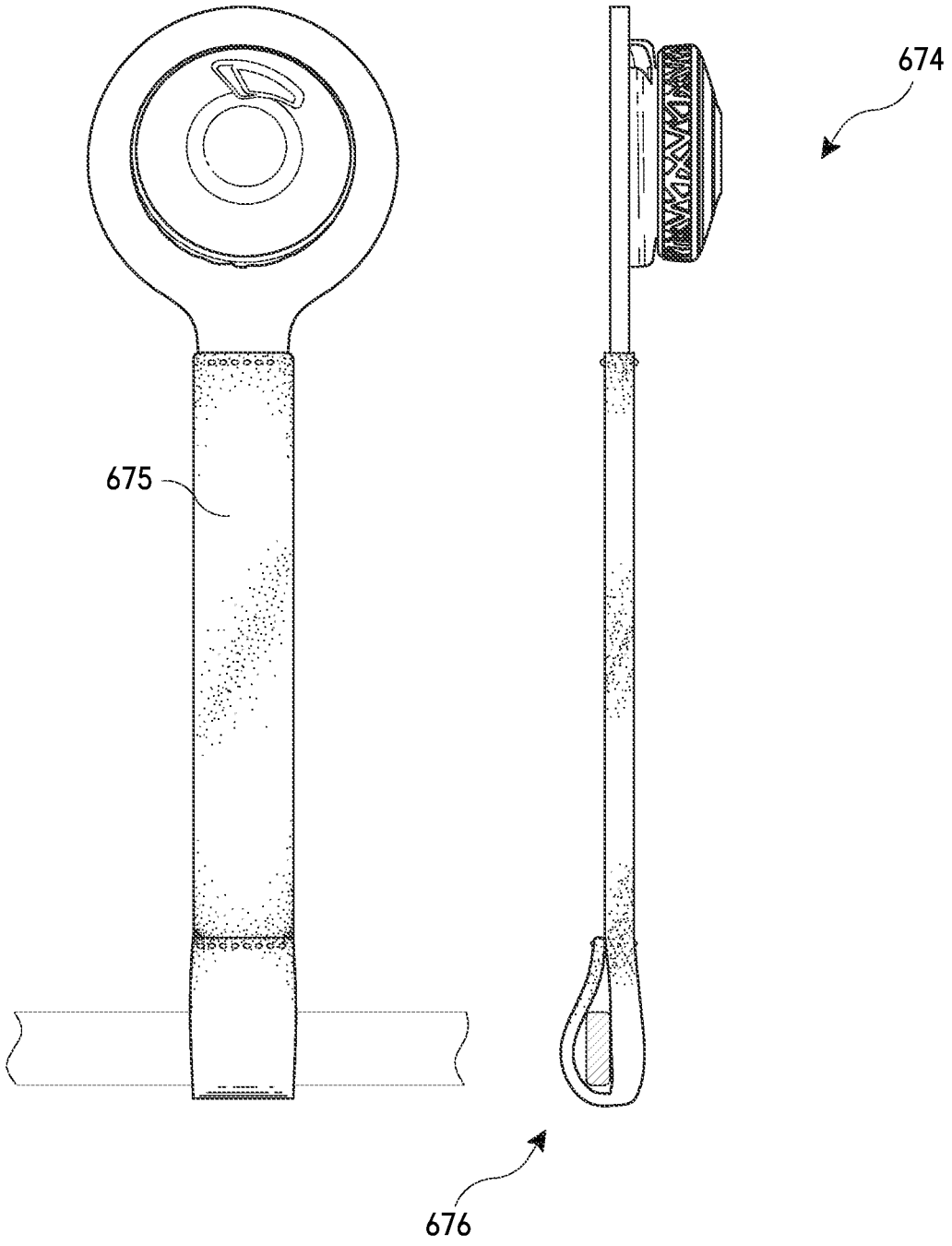

FIG. 6W illustrates another embodiment of an elongated tongue panel 674 that includes a main body portion 675 made of a fabric material. The proximal end 676 of the fabric main body portion 675 may be folded back on itself and stitched, bonded, or otherwise coupled together to create a loop through which shoelace, webbing, or other fabric or material may be inserted to couple the elongated tongue panel 674 with the shoe. In some embodiments, the fabric main body portion 675 may be relatively thin and/or may be made of a material that substantially matches the material and/or color of the shoe. In this manner, elongated tongue panel 674 may be relatively hidden from view when coupled with the shoe. In some embodiments, a central shaft may be inserted within main body 675, or main body 675 may be wrapped around the central shaft. The central shaft may stiffen the panel 674 to provide some rigidity.

Figure 6X:
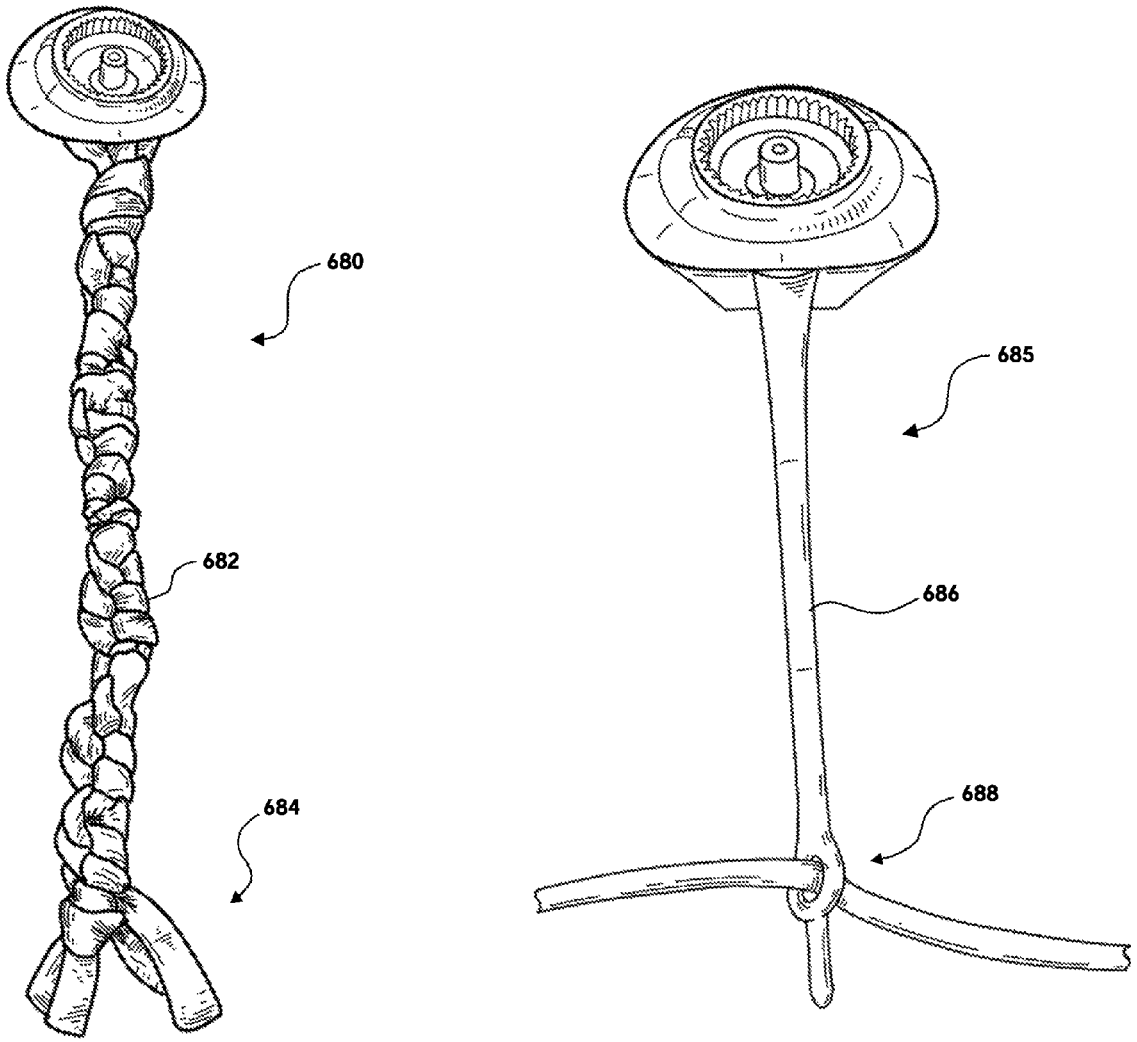

FIG. 6X illustrates another embodiment of the elongated tongue panel 680 having a main body portion 682 that is formed by knitting fabric, webbing, shoelace, and the like together. This material may be knitted so as to form one or more loops 684 at a proximal end of the main body portion 682 through which a shoelace, webbing, or other fabric may be threaded to couple the elongated tongue panel 680 with the shoe. In some embodiments, the main body portion 682 may be knitted so as to create one or more loops along the longitudinal length of the main body portion 682 through which the lacing system's lace may be inserted to function as guides for the lace. In such embodiments, the main body portion 682 may function to direct and/or manage the lacing system's lace. FIG. 6X also illustrates another embodiment of an elongated tongue panel 685 having a main shaft body 686 that includes an aperture 688 through which shoelace, webbing, or other material may be inserted to couple the elongated tongue panel 685 with the shoe. In some embodiments, the main shaft body 686 may be made of a relatively flexible or elastic material that allows the distal end of the elongated tongue panel to be stretched or bent relative to the proximal end that is coupled with the shoelace, webbing, or other fabric. In this manner, the elongated tongue panel 685 may be stretched so as to accommodate various shaped and sized shoes.

Figure 6Y:
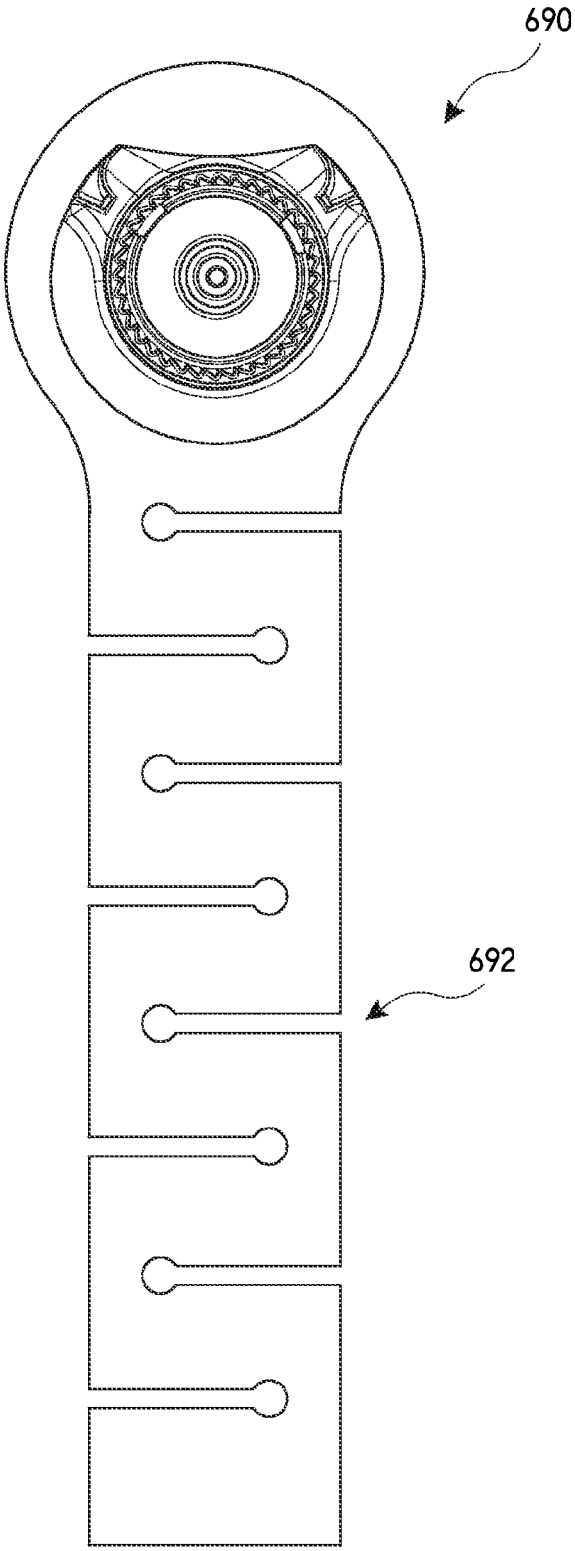

FIG. 6Y illustrates an embodiment of an elongated tongue panel 690 where the main body portion of the panel includes a plurality of slits or cuts 692 arranged longitudinally there along. The cuts 692 increase the flexibility of the main body portion of the elongated tongue panel 690. In some embodiments, the lacing system's lace may be wound through and/or around the cuts 692 such that the cuts function as guides for the lace. In some embodiments, the elongated tongue panel may have a bayonet or housing positioned at a distal end of the main body portion. In such embodiments, a main body portion of the panel may be made of a first type of material while bayonet or housing is made of a second type of material that is different than the first type of material. For example, in one embodiment the main body portion may be made of a relatively flexible material, such as nylon or soft urethane, while the housing or bayonet is made of a relatively rigid material, such as polycarbonate. In this manner, the main body portion may be relatively flexible while the bayonet or housing is relatively rigid to support a reel assembly mounted or coupled therewith. The bayonet or housing may be coupled with the main body portion via any known method in the art, such as second shot molding, insert molding, adhesive bonding, mechanically fastening, and the like.

Figure 7A:
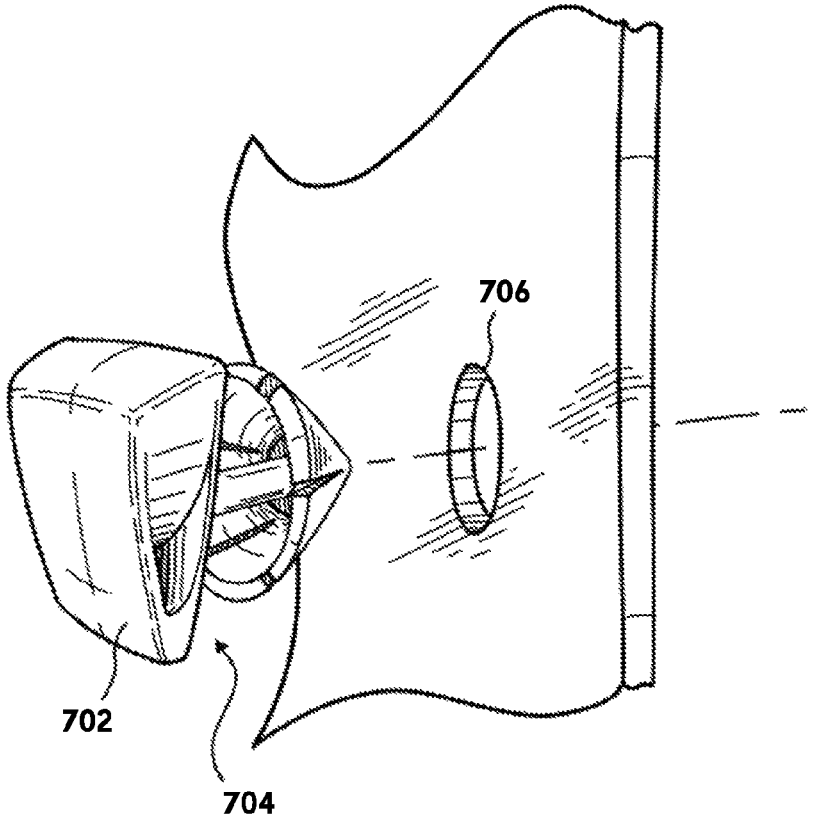
FIGS. 7A-L illustrate various embodiments of retrofitting a shoe or other article with guides for a tension member.
Figure 7B:
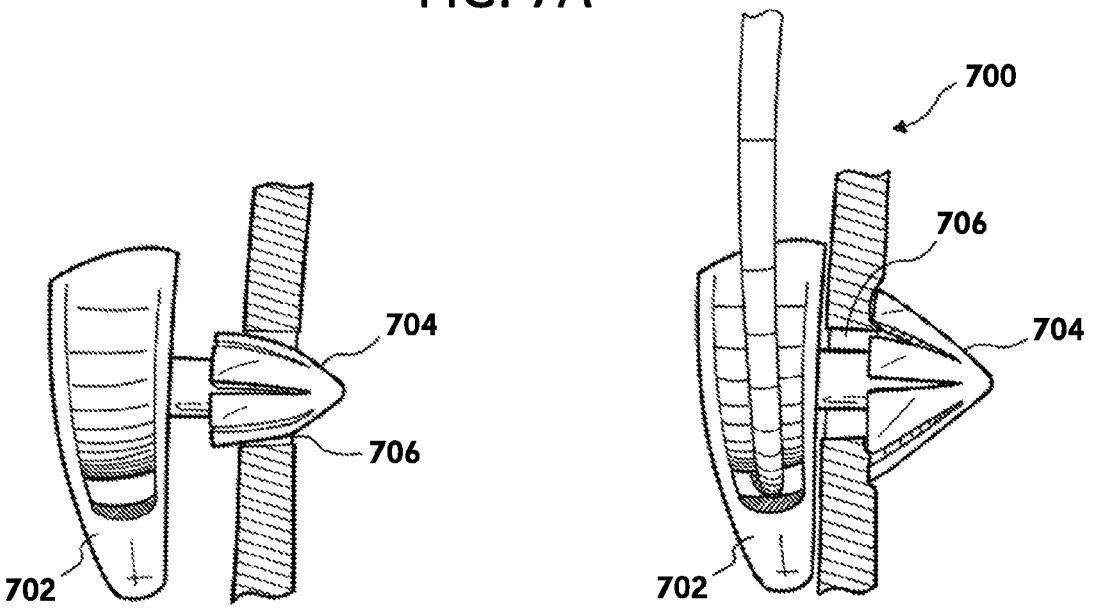

FIGS. 7A-L illustrate various embodiments of attaching guides to a shoe. FIGS. 7A-B illustrates one embodiment 700 in which the guide 702 couples with an eyelet of a shoe by inserting a plug 704 of the guide 702 through an aperture 706 of the eyelet. The plug 704 includes a plurality of extending members positioned around a central post that deflect radially inward and outward as the plug 704 is pressed within the aperture 706 of the eyelet. When the plug 704 is fully positioned within the aperture 706, the extending members press flare radially outward to hold or secure the guide 702 within the aperture 706 of the eyelet. A washer body (not shown) may be used to further prevent the guide 702 from being pulled through the eyelet. The guides 702 of FIGS. 7A-B allow a plurality of guides to be easily coupled with eyelets of the shoe.

Figure 7C:
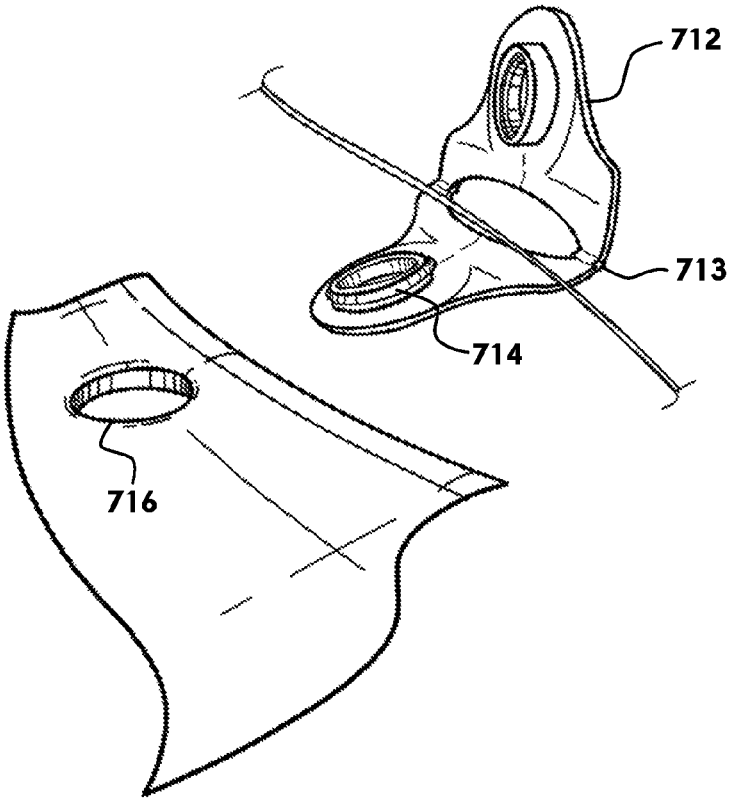
Figure 7D:
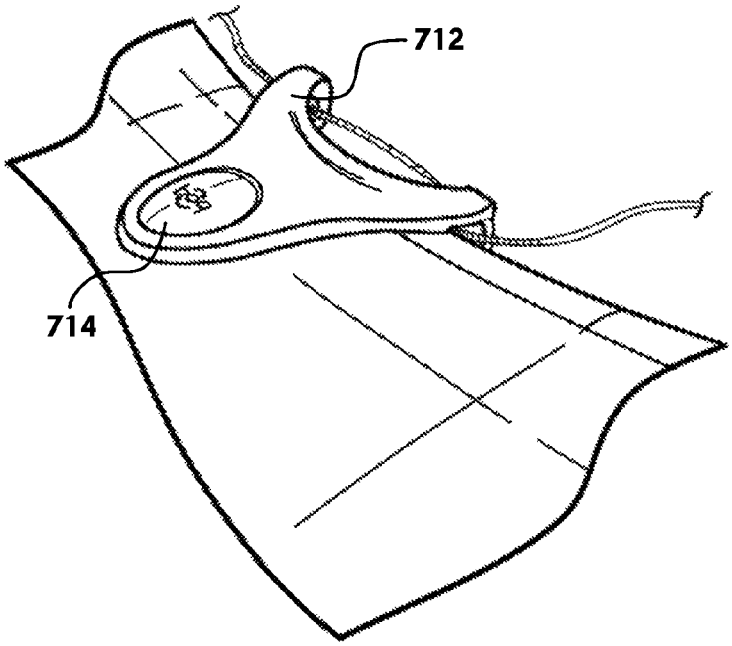

FIGS. 7C-D illustrate a similar guide 712 that may be easily coupled with the shoe. Specifically, guide 712 includes a first end and a second end that are coupled via a hinge portion 713 that allows the first end to be folded over the second end. The first end and the second end each include a button component 714 that snap together as the first end is folded over the second end. To couple the guide 712 with the shoe, the button component 714 of the second end is positioned adjacent or within an eyelet 716 of the shoe. The first end is then folded over the second end so that the button component 714 of the first end couples with the button component of the second end. The guide 712 is then locked in position relative to the shoe with the button components being positioned within and/or through the eyelet 716. In some embodiments, folding the first end and over the second end forms a channel within which the lacing system's lace is inserted. In other embodiments, guide 712 may include a separate channel through which the lacing system's lace is inserted. In another embodiment, the guide 712 may comprise two separate pieces that are snapped or otherwise coupled together.

Figure 7E:
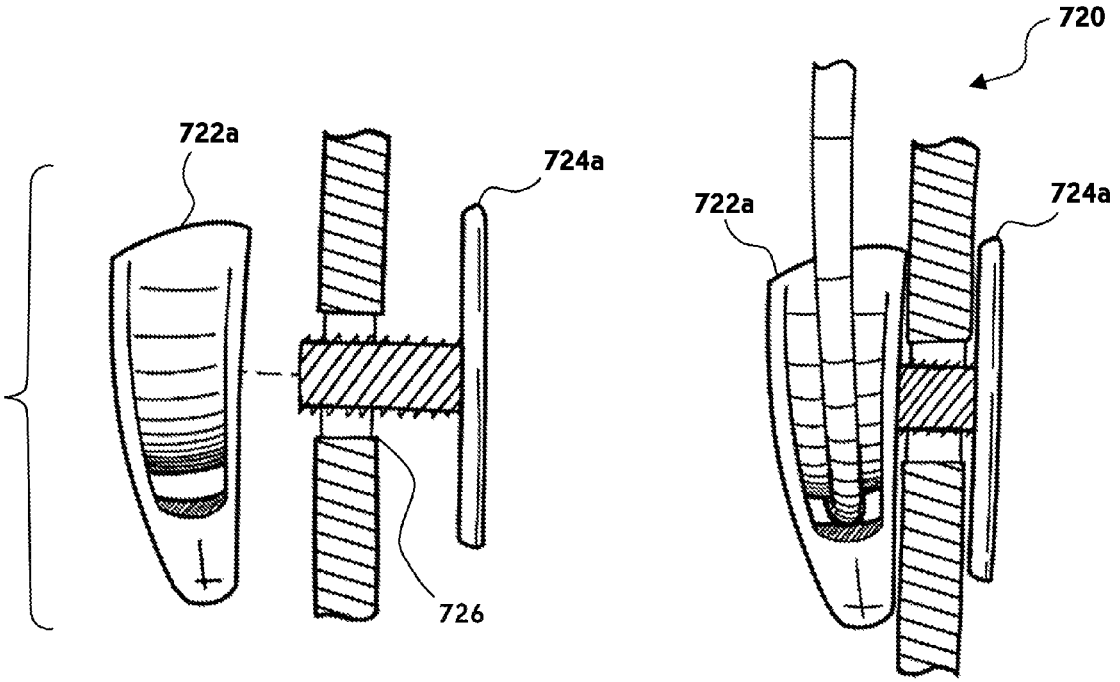
Figure 7F:
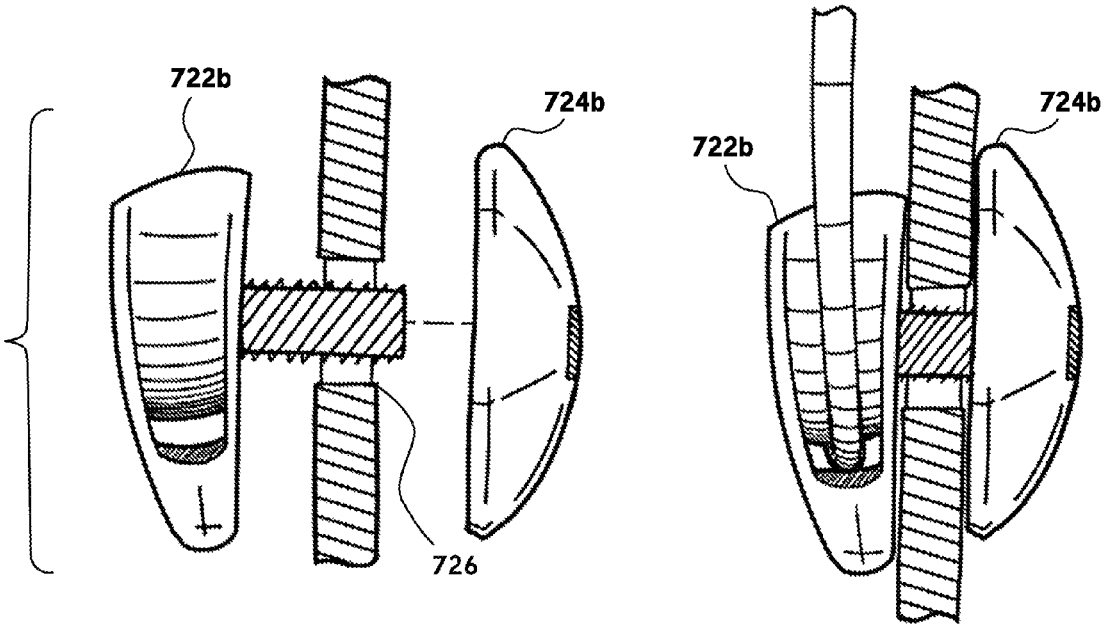
Figure 7G:
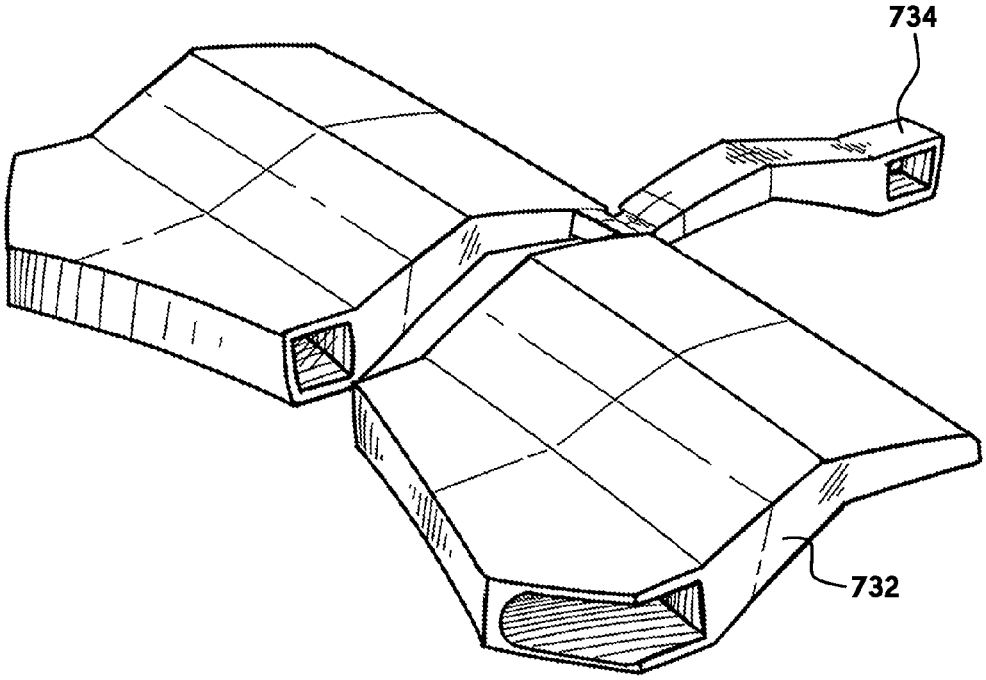
Figure 7H:
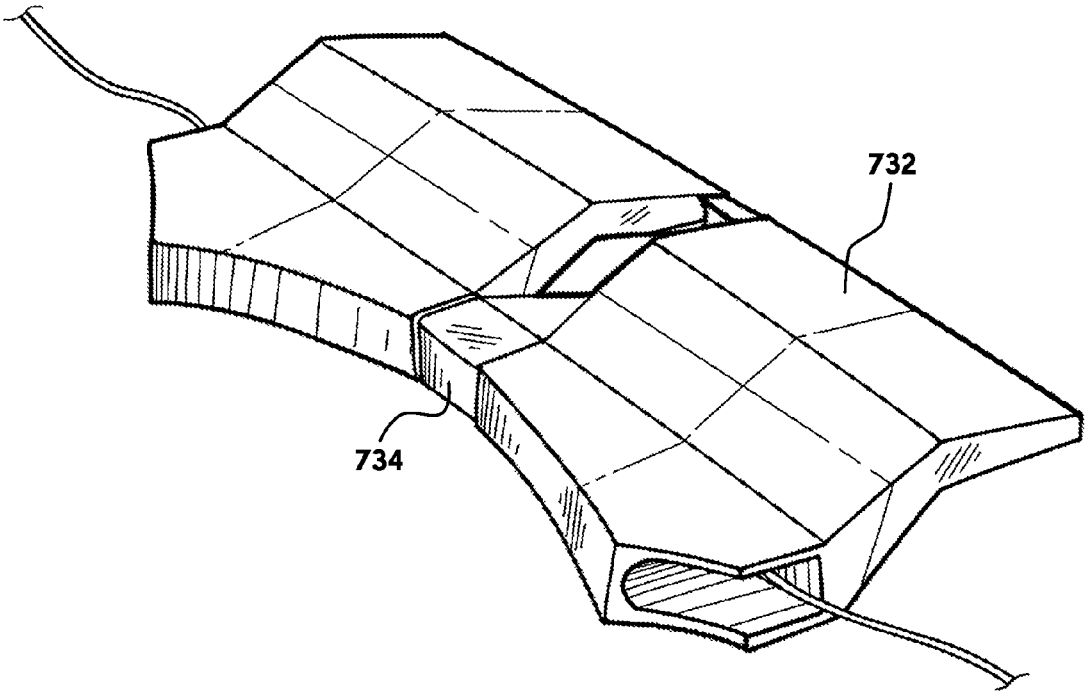
Figure 7I:
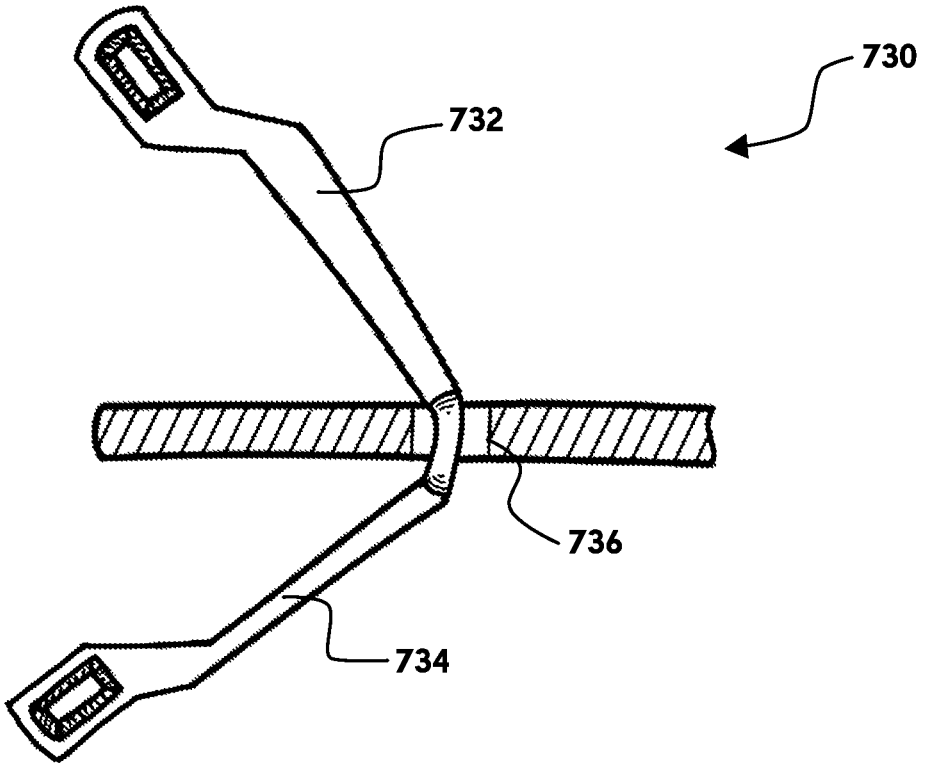
Figure 7J:
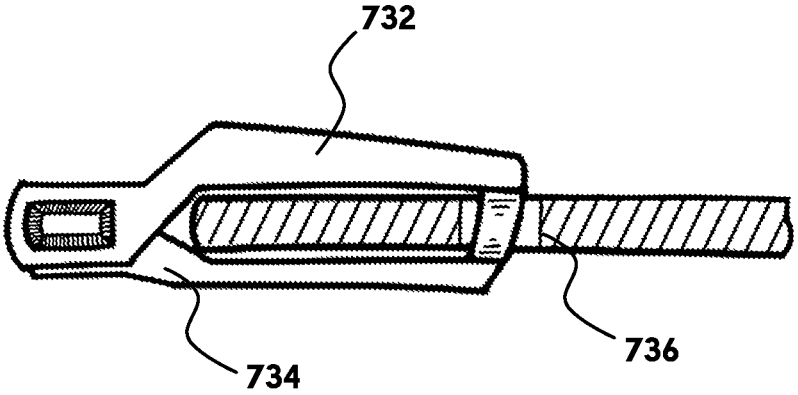

FIGS. 7E-F illustrate another embodiment 720 of attaching guides to shoes. Specifically, a guide 722*a* may include a threaded aperture (not shown) within which a threaded post 724*a* is inserted. The threaded post 724*a* may be inserted through an eyelet 726 of the shoe and then threaded into the aperture of guide 722*a* to couple the guide with the shoe. In an alternative embodiment, the guide 722*b* may include a threaded post that is threaded into an aperture of a bolt or plug 724*b*. In some embodiments, threading the post or plug 724*b* with the guide 722*b* may require a fastening tool, such as a screwdriver, wrench, and the like, or may be performed by hand. In some embodiments, guide 724*b* may be self-tapping or of the drivable rivet type.

FIGS. 7G-J illustrate another embodiment 730 of attaching a guide to a shoe. Specifically, in this embodiment the guide 732 includes a coupling member 734 that is rotationally attached to a main body of guide 732. The coupling member 734 is configured to be inserted within an eyelet 736 of the shoe and rotated relative to guide 732 so that the distal end of the coupling member 734 is positioned adjacent a distal end of the guide 732. The coupling member 734 may be positioned relatively centrally within a main body of guide 732 so that as the coupling member 734 is rotated towards the guide 732, the distal end of the coupling member 734 snaps or locks into place relative to the distal end of guide 732. The guide 732 is locked into place about the shoe as the coupling member 734 locks or snaps into place relative to guide 732.

The distal ends of the coupling member 734 and guide 732 may include a lumen that is configured to align coaxially as the distal ends of the coupling member 734 and guide 732 are positioned adjacent one another. The lacing system's lace may be inserted through the lumens of coupling member 734 and guide 732 so that the aligned lumens function as a channel to guide the lace as described herein. When the lace is inserted through the lumens of coupling member 734 and guide 732, the lace may function to maintain the coupling member 734 and guide 732 in the locked arrangement. The lumens may have an arcuate or curved configuration and/or flared openings to reduce any potential wear and/or stress on lace inserted there through.

Figure 7K:
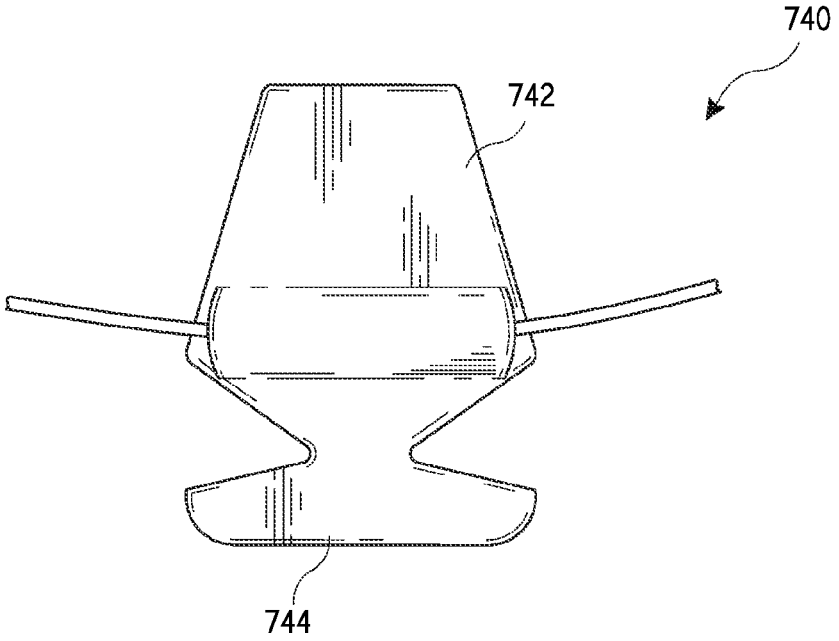
Figure 7L:
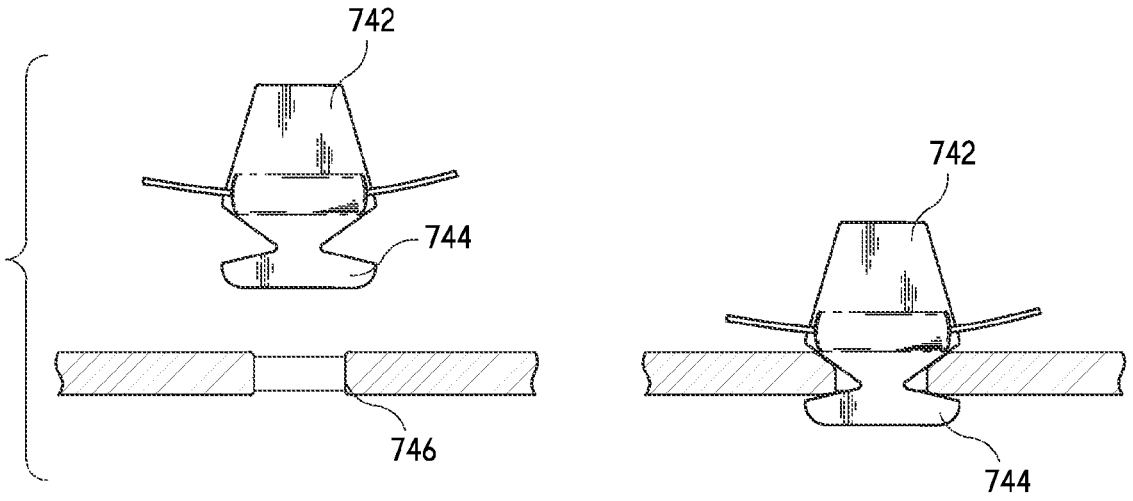

Referring now to FIGS. 7K-L, illustrated is another embodiment 740 of attaching a guide to a shoe or a lace material specific to a shoe. Specifically, a guide 742 includes a t-shaped bottom portion 744 that allows the bottom portion 744 of guide 742 to be inserted within an eyelet 746 of the shoe while preventing or restricting withdrawal of the guide 742 therefrom. The bottom portion 744 may be tapered so as to facilitate insertion of the guide 742 within eyelet 746 while preventing or restricting withdrawal of the guide 742 therefrom.

Figure 8A:
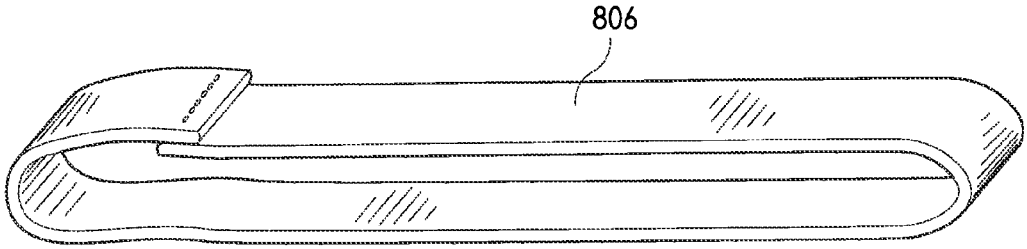
FIGS. 8A-M illustrate various embodiments of creating tension member guides using fabric or other material strips.
Figure 8B:
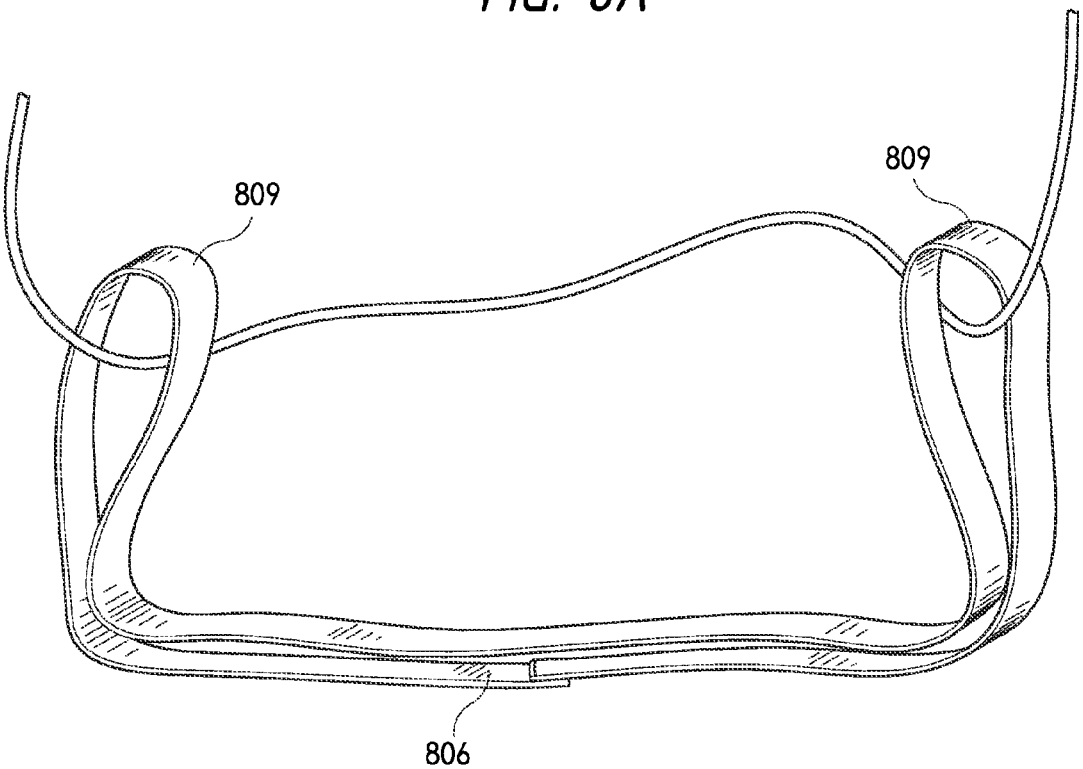
Figure 8C:
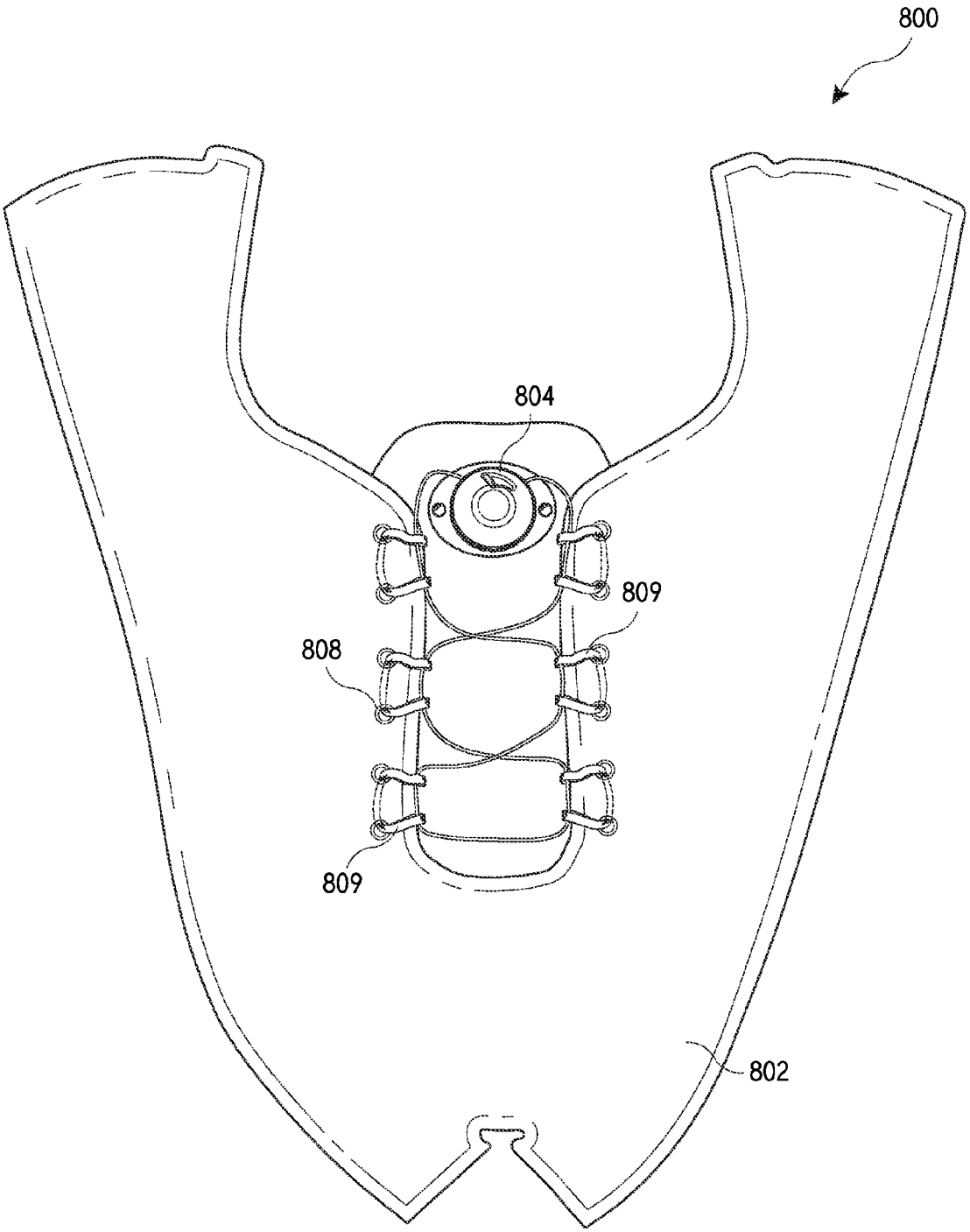

In FIGS. 8A-M, illustrated are embodiments of creating guides using typical lace for a shoe. For example, as illustrated in FIGS. 8A-C, to create guides for the lacing system, a strip of fabric may be coupled at opposing ends to form a fabric ring 806. The opposing ends 809 of the fabric ring 806 may be positioned through eyelets 808 of the shoe so as to form webbing guides as shown in FIG. 8C. The lace of the lacing system may be inserted through loops created as the opposing ends 809 of fabric ring 806 are inserted through the eyelets 808 of the shoe. In some embodiments, the opposing ends 809 of the fabric loop 806 may each function as a single loop of a paired webbing loop guide arrangement as shown in FIG. 8C. Each webbing loop of the paired webbing loop guide arrangement may be angled as the lace is tensioned, which reduces wear and provides an improved radius of curvature of the lace. The guides created by the fabric loop 806 provide a relatively inexpensive and easy way of creating webbing guides for the lacing system. As further described in U.S. patent application Ser. No. 13/011,707 entitled "Guides for Lacing Systems," the entire disclosure of which is incorporated herein for all purposes, angled webbing or the paired webbing loop guide arrangement reduces friction wear on the lace. Other advantages provided by this arrangement include increased lace durability due to reduce lace fatigue, less lace crossings, less lace-guide friction, size grading possibilities, and the like. In some embodiments, the lacing system's lace may be laced through single webbing loops.

In some embodiments, the fabric ring 806 may be used to create a single webbing loop or a pair of webbing loops in a single eyelet of the shoe. For example, the fabric ring 806 may be inserted through the eyelet so that the opposing ends 809 each form a webbing loop through which the lace is inserted. In another embodiment, one end of the fabric ring 806 may be positioned over the eyelet and the opposing end 809 may be pulled through the eyelet to form a single webbing loop. As the lace is tensioned, the fabric ring is locked into place relative to the eyelet.

Figure 8D:
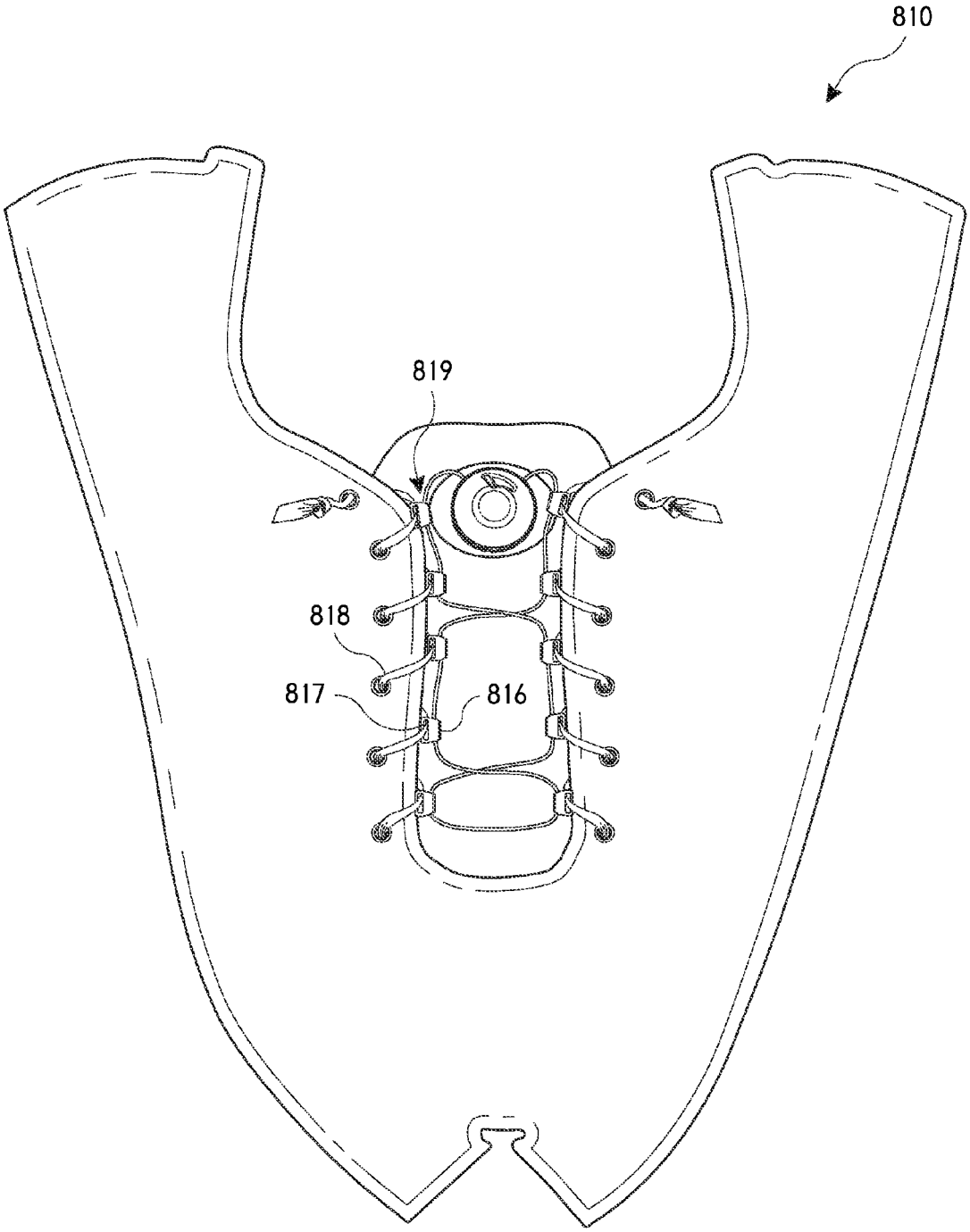

FIG. 8D illustrates another embodiment 810 of coupling guides with a shoe using a shoelace. Specifically, a guide body 816 includes a slot 817 through which a shoelace 818 is inserted. The shoelace 818 is in turn inserted through the eyelets of the shoe to couple the guide body 816 to the shoe. The guide body 816 also includes a channel 819 through which lace of the lacing system is inserted as described previously. The shoelace 818 may be wound helically around the eyestay of the shoe and through the eyelets positioned longitudinally along the eyestay and through slots 817 of guides 816 positioned between each of the eyelets so that one or more guides 816 is positioned between each of the eyelets. In one embodiment, a single shoelace may be used to couple all the guides 816 with the shoe, although in other embodiments multiple shoelaces or other webbing or cord may be used.

Figure 8E:
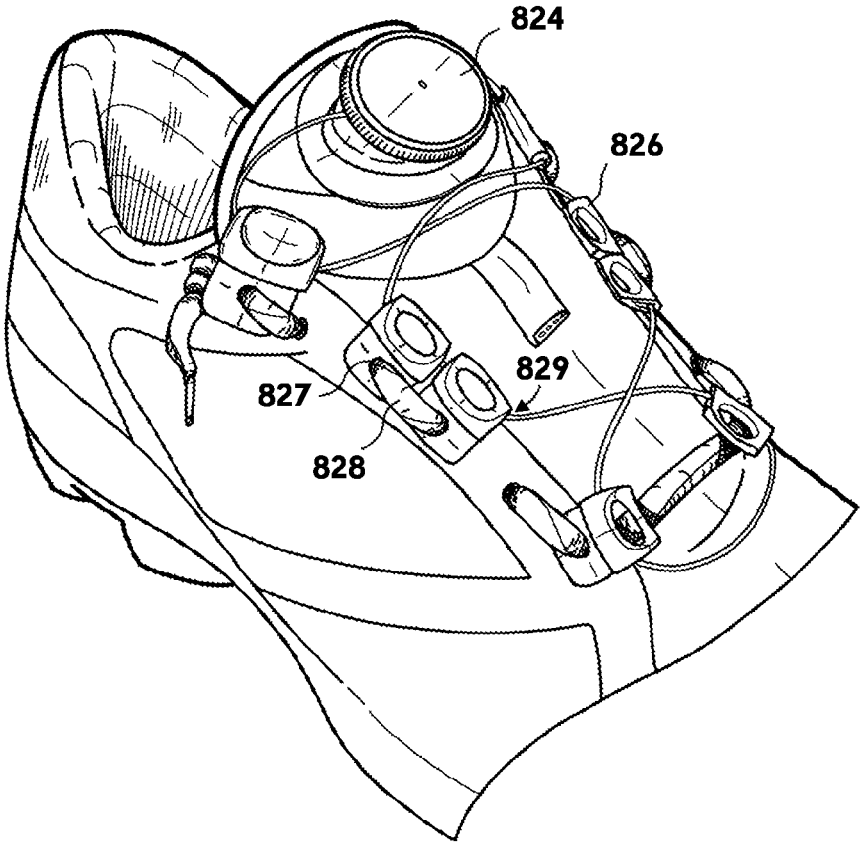
Figure 8F:
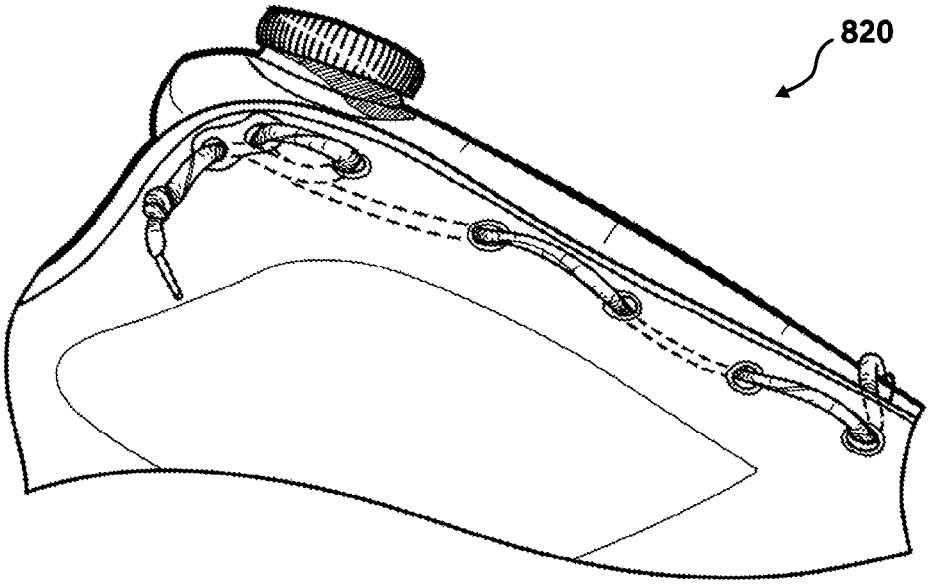
Figure 8G:
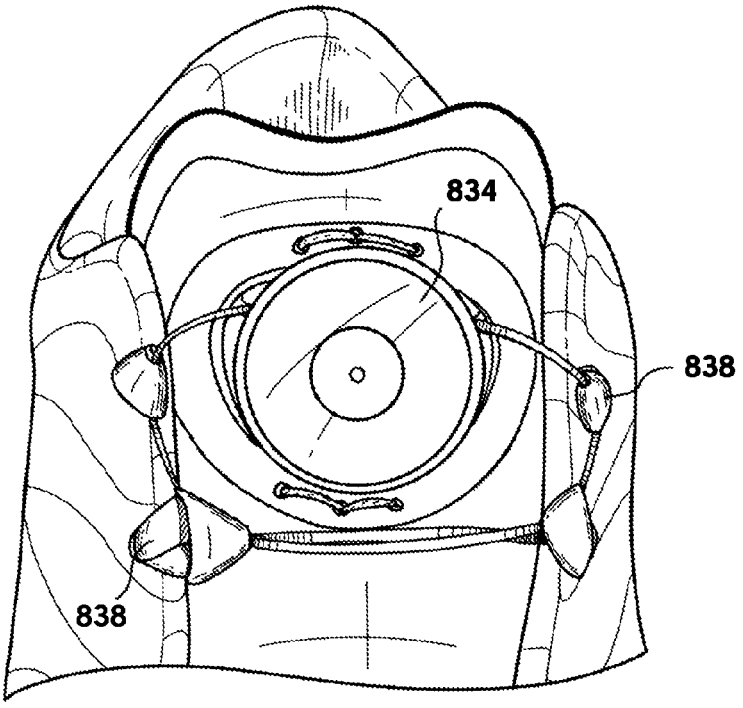
Figure 8H:
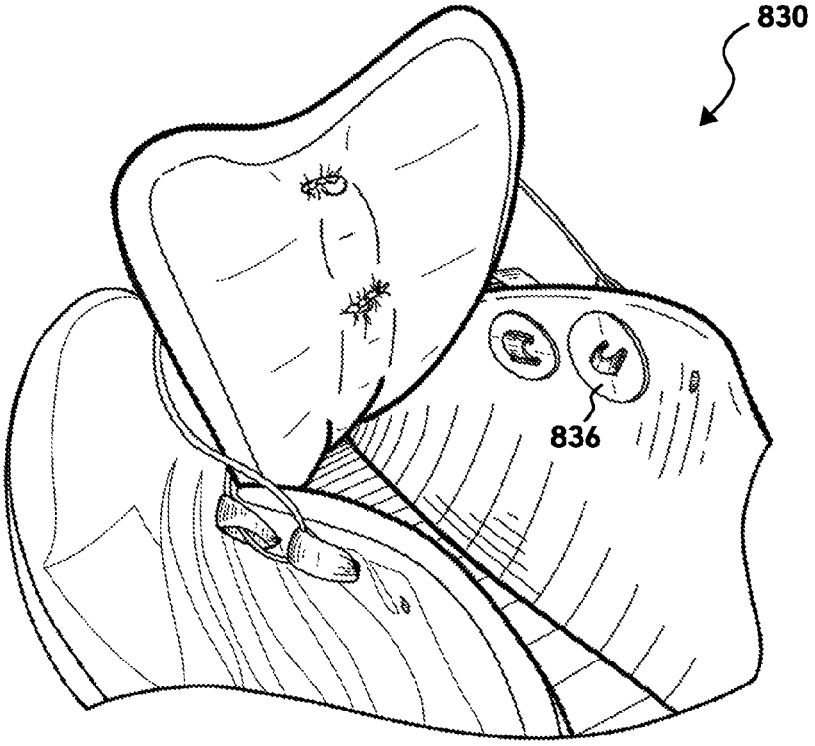
Figure 8I:
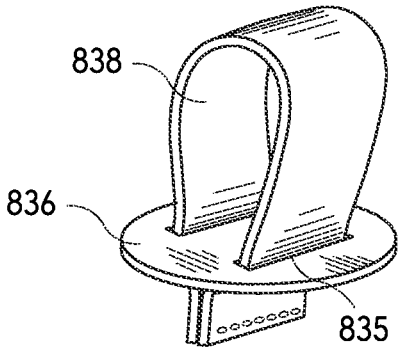

FIGS. 8E-F illustrate a similar embodiment in which a guide 826 is coupled with a shoe by inserting a shoelace 828 through an aperture 827 positioned on a bottom portion of the guide 826. FIGS. 8E-F differ from FIG. 8D in that the shoe lace 828 is run longitudinally along the eyestay instead of being wound helically there around. The guide 826 includes a channel 829 through which the lacing system's lace is inserted as described herein. As shown in FIGS. 8E-F, the guide 826 may be used alone or in combination with other guides so as to create a variable length guide. The guides of FIGS. 8D-F are relatively inexpensive components that may be discarded after use and/or easily replaced. In some embodiments, the guides may be designed specifically for a particular event. A user may conveniently select an appropriate set of guides and easily configure his or her shoe to include the appropriate guides for any given event. In some embodiments, the shoelace 828 may also or alternatively be used as a guide for the lacing system's lace.

Figure 8J:
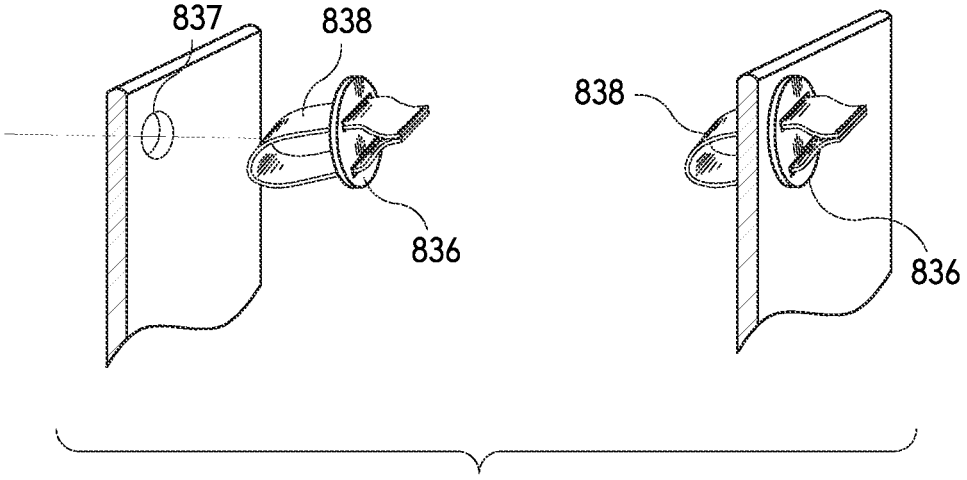

Referring now to FIGS. 8G-J, illustrated is another embodiment 830 of a guide that may be used with a lacing system of a shoe. Specifically, the guide includes a relatively flat washer portion 836 of slotted plastic or metal as a washer having a pair of slots 835 through which a webbing loop 838 is inserted. The webbing loop 838 is stitched, tied, heat bonded, or otherwise coupled at opposing ends so that the webbing loop 838 is locked in position relative to washer 836. As shown in FIG. 8J, the webbing loop 838 may be inserted through an eyelet 837 of the shoe and pulled through the eyelet 837 until the washer 836 is abutted against an inner surface of the shoe. The washer 836 prevents the webbing loop 838 from being pulled fully through the eyelet 837 of the shoe. The portion of the webbing loop 838 extending beyond an outer surface of the shoe may then be used as a guide for the lace of the lacing system as described herein.

In some embodiments, the portion of the webbing loop 838 extending beyond the outer surface of the shoe may be folded back upon itself by making a ½ turn to create a triangular webbing guide for the lace of the lacing system. The triangular webbing guide formed in this manner may be especially useful in directing the lace directly across the shoe's tongue at 90 degrees and/or in directing the lace longitudinally along the shoe's eyestay toward an adjacent webbing guide. The triangular webbing guide may also provide a relatively smooth radius for directing the lace from the longitudinal direction along the eyestay toward the lateral direction across the shoe's tongue and thereby reduces wear on the lace. Such triangular webbing guides have been found to provide reduced lace wear and lace management and/or directional characteristics. For example, when the lace crosses the shoe at roughly 90 degrees, the lace's force in closing the shoe is not reduced as typically occurs with angled lace crossings, especially large lace crossing angles.

Figure 8K:
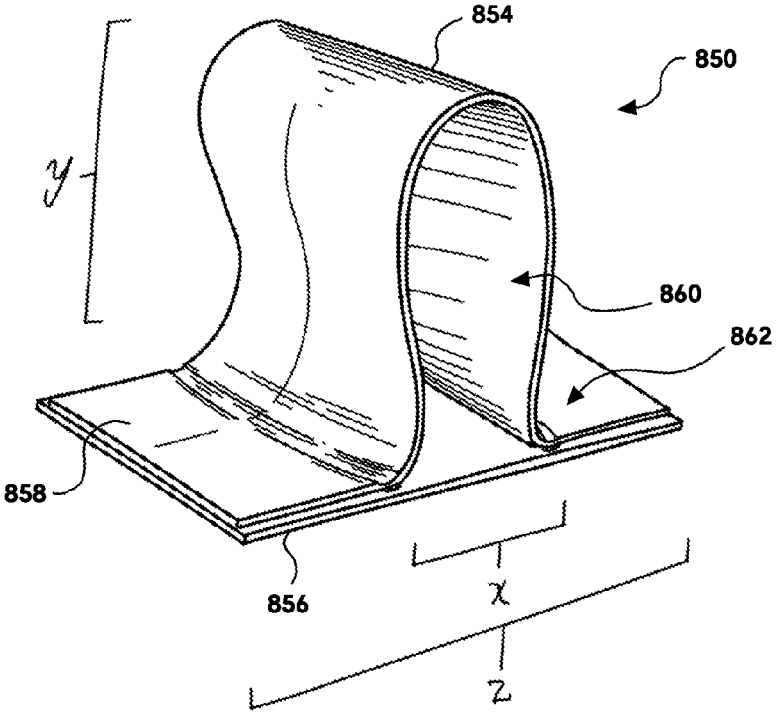
Figure 8L:
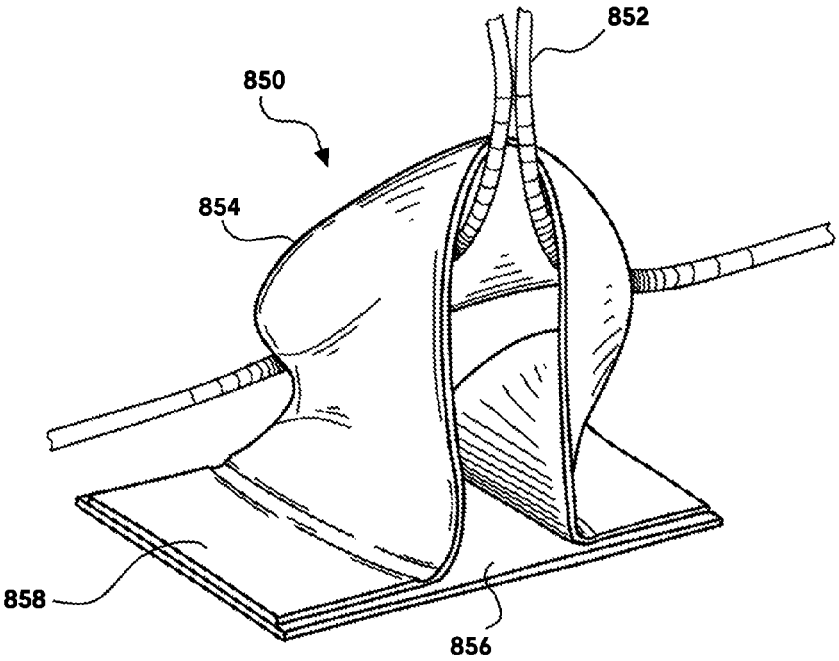

Referring now to FIG. 8K-L, illustrate another embodiment of a soft guide 850 that may be used to couple a lace 852 with a shoe and to guide the lace 852 about a lace path along the shoe. Similar to guide 830, guide 850 is configured for insertion through an eyelet of a shoe and further configured to prevent the guide 850 from being pulled through the eyelet. Guide 850 is made from multiple pieces of fabric (e.g., two pieces) that are coupled together. For example, the pieces of fabric may be stitched together, adhered together, sonically welded together, heat welded together, and the like. Unlike guide 830, guide 850 does not include a rigid backing, such as a plastic washer portion 836. Rather a backing strip of material or base member 856 is attached to an upper strip of material or upper member 854. The upper member 854 is attached to the base member 856 so that the upper member 854 extends roughly orthogonally from the base member 856 and forms a loop 860. The loop 860 functions to route the lace 852 after the lace 852 is inserted there through. The upper member 854 is sufficiently flexible so as to be positioned through an eyelet of a shoe or other article and the base member 856 is sufficiently rigid to restrict the base member 856 from being pulled through the eyelet. Similar to FIG. 8J, when the upper member 854 is inserted through the shoe's eyelet, the upper member 854 is positioned on one side of the eyelet while the base member 856 is positioned on an opposite side of the eyelet. As shown in FIG. 8L, in some embodiments, the upper member 854 can be at least partially folded over itself to form a triangular shaped guide for the lace 852. The triangular shaped guide may aid in guiding the lace 852 roughly orthogonally across the shoe's tongue and relative to an edge of the eyestay.

To prevent or greatly restrict the guide 850 from being pulled through the eyelet of the shoe, the base member 856 has a larger area or "footprint" than the upper member 854. Stated differently, the fabric material strip of the base member 856 may have a shorter longitudinal length than a longitudinal length of the upper member 854's fabric material strip. As such, as shown in FIG. 8K, when the opposing ends of the base and upper members fabric material strips are coupled together, the central portion of the upper member's fabric material strip extends from the base member 856 to form the loop 860. The coupling of the upper member 854 and base member 856 in this manner also defines a flange 858 that contacts the inner surface of the shoe and prevents or greatly restricts the guide 850 from being pulled through the eyelet. The coupling of the base member 856 and the upper member 856 may strengthen the flange portion 858 of the guide 850. The flange 858 can be of any shape, such as a square, rectangle, ellipse, circle, and the like, and can extend 360 degrees around the coupled base member 856 and upper member 854.

In some embodiments, the base member 856 can have a longitudinal length Z of approximately 6-20 mm, and more commonly 10-15 mm, so that each flange 858 (i.e., each end) has a longitudinal length of between 3 and 6 mm, and more commonly 3 and 5 mm. Flange or end 858 dimensions smaller than 3 mm may be too small and weak to prevent the guide 850 from being pulled through the eyelet while flange or end dimensions larger than about 5 or 6 mm may result in a portion of the flange or end 858 protruding beyond an edge of the eyestay and being visible.

The upper member 854 and/or loop 860 may extend from the base member 856 by a height Y of approximately 8-12 mm. If the height dimensions Y of the loop 860 are less than about 8 mm, there may be an insufficient loop size to thread the lace 852 through. In contrast, if the height dimensions Y are greater than about 12 mm, the loop 860 may contact an adjacent loop 860 resulting in a poor function of guide 850 and/or poor aesthetics. The above described dimensions Z and Y have been found to be ideal for enabling the loop 860 to protrude from the surface of the shoe or other article sufficiently to enable easily coupling with the lace 852 while minimizing the size of the guide 850 and allowing the base member 856 to remain hidden and concealed beneath the shoe's upper. It should be realized, however, that these dimension may be varied depending on need, functionality, appearance, and/or any other consideration.

The upper member 854 is attached to the base member 856 so that a portion of the loop directly adjacent the base member 856 forms a neck or gap 862. The neck or gap 862 may have a width of 3-5 mm, and more commonly about 3.5-4.5 mm. The width of the neck 862 should be selected to maintain a flange 858 length of between about 3-6 mm or 3-5 mm. In selecting an appropriate width X of the neck 862 and an overall length Z of the base member 856, the following equation may be used to result in a flange widths (i.e., width of 858) of 3-5 mm: $\frac{1}{2}(Z)-\frac{1}{2}(X)=3\text{-}5$ mm. The above dimensions may result in a loop 860 have a loop surface area of between about 24 and 60 $mm^2$, and more commonly between about 32 and 48 $mm^2$. A loop having a surface area as described above has been found to be ideal for enabling the loop 860 to be easily inserted within a shoe's eyelet while also providing a sufficient amount of loop through which the lace may be inserted and while minimizing the amount of loop extending from the eyelet.

Figure 8M:
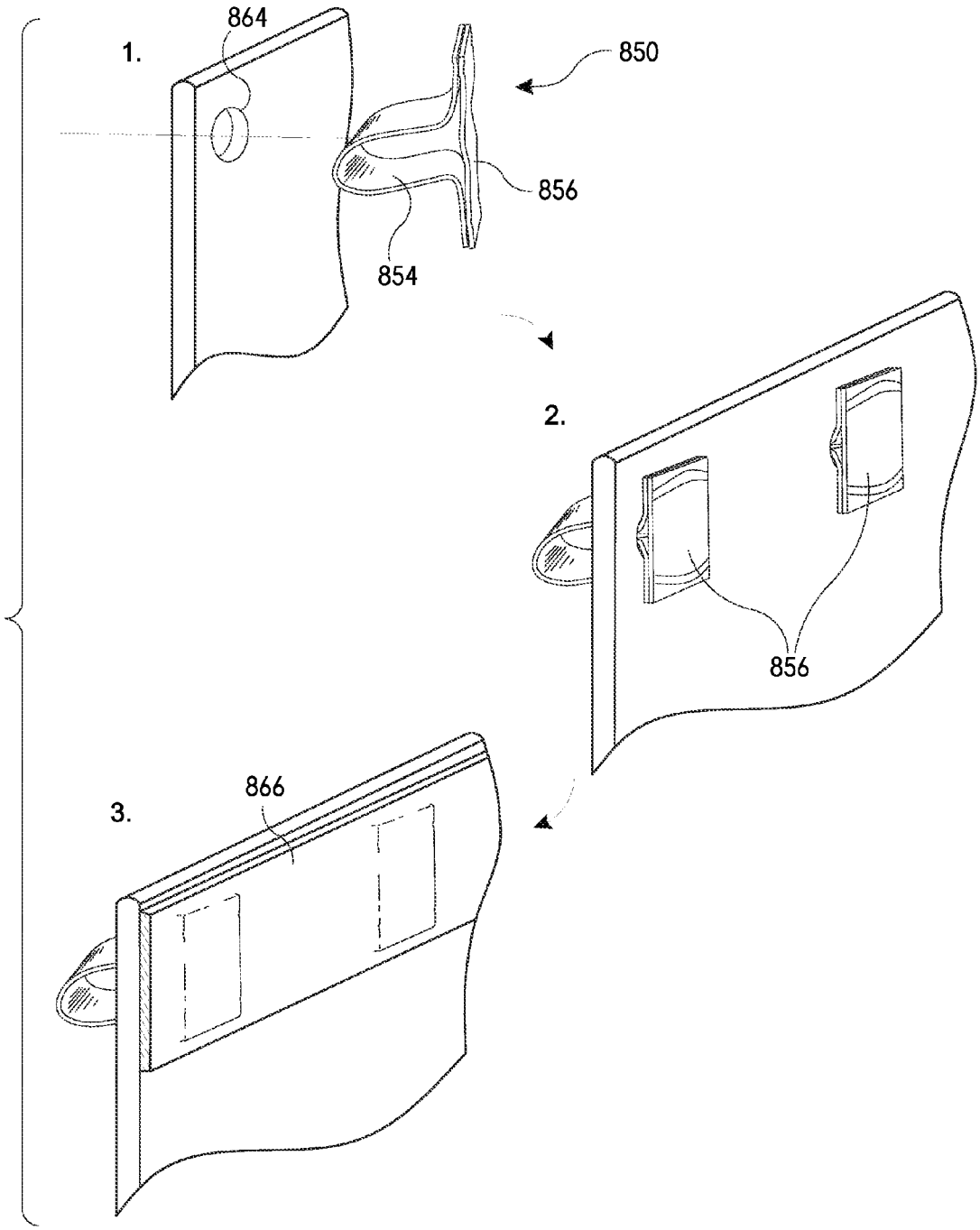

As shown in FIG. 8M, in some embodiments a backing material 866 may be positioned atop the base member 856 after the upper member 854 is positioned through the shoe's eyelet 864. The backing material 866 may be coupled with the shoe to conceal the base member 856 thereunder. In some embodiments, one or more of the guides described in FIGS. 8A-M may be coupled with a shoe to provide varied lace guide arrangements.

In some embodiments, a method of forming a guide member for routing a lace along a lace path of a shoe includes providing a base member that is sufficiently rigid so as to restrict the base member from being pulled through an eyelet of the shoe and attaching an upper member to the base member to form a loop for routing the lace after the lace is inserted through the upper member's loop. The upper member is sufficiently flexible so as to be positioned through the eyelet of the shoe. When the upper member is inserted through the eyelet, the upper member is positioned on one side of the eyelet while the base member is positioned on an opposite side of the eyelet.

As described herein, the upper member may be a fabric material strip having opposing ends that are coupled together to form a loop and the base member may be a rigid material having a pair of slots through which the fabric material is slidingly disposed. In other embodiments, the upper member may be a fabric material strip and the base member may be a fabric material strip. The base member's fabric material strip may have a shorter longitudinal length than a longitudinal length of the upper member's fabric material strip. In such instances, the method may also include coupling opposing ends of the fabric material strips with a central portion of the upper member's fabric material strip extending roughly orthogonally from the base member to form the loop. The coupled opposing ends may form flanges that extend roughly orthogonally from the upper material's loop, each flange having a width of between 3-5 mm. The upper member may be attached to the base member so that a portion of the loop directly adjacent the base member includes a neck or gap having a width of between 0.5-3 mm, and more commonly 1-2 mm. The upper member's loop may extend above the base member by between about 8-12 mm. In some embodiments, the method may further include positioning a backing material atop the base member after the upper member is positioned through the eyelet and coupling the backing material with the article to conceal the base member thereunder.

Referring now to FIGS. 9A-G, illustrated are various embodiments of using a shoelace, or webbing, or both to create webbing guides for the lacing system's lace. The embodiments described in FIGS. 9A-G minimize the number of components that must be coupled with the shoe in order to retrofit or adapt the shoe to the lacing system. Stated differently, the embodiments described in FIGS. 9A-G allow common or existing components of the shoe to be used in retrofitting or adapting the shoe to accommodate the lacing system. In other embodiments, fabric or webbing (e.g., polyester) specifically designed for creating the webbing guides may be used. The fabric or webbing may provide advantages over conventional shoelace materials, such as low friction, decreased squeaking or noise generation, increased lace durability due to low abrasion, and the like.

Figure 9A:
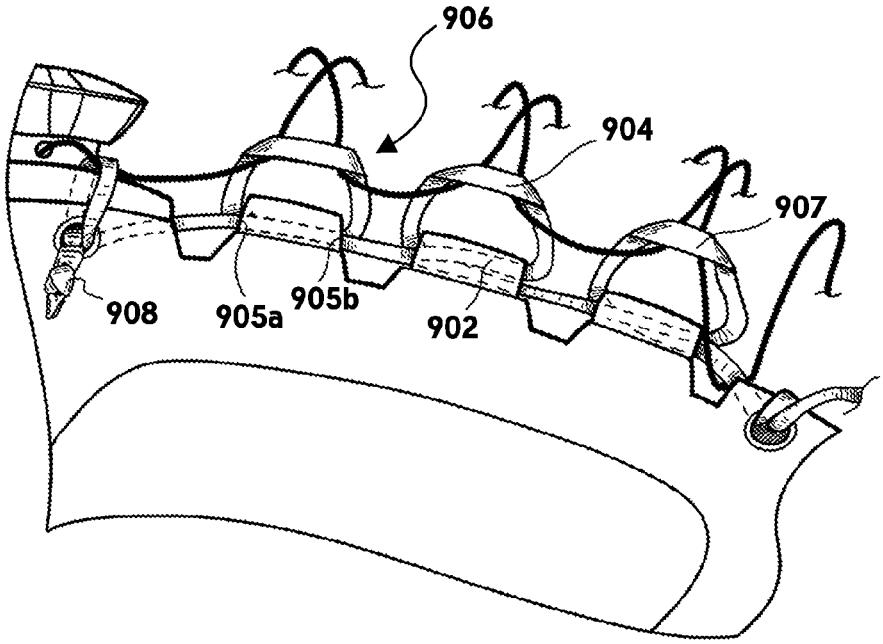
FIGS. 9A-G illustrate various embodiments of using a shoelace, or webbing, to create webbing guides for the tension member.
Figure 9B:
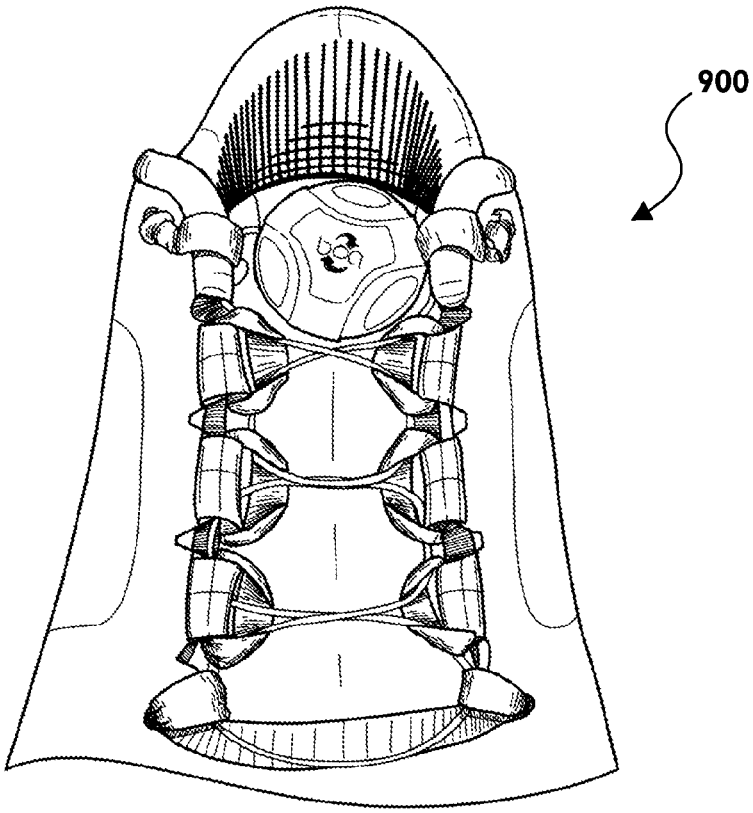

Referring specifically FIGS. 9A-B, in a first embodiment 900, the shoelace 904 is run longitudinally along the eyestay of the shoe and through eyelets or loops positioned along the eyestay of the shoe to create webbing loops through which the lacing system's lace may be threaded. For example, the shoelace 904 is run longitudinally along the eyestay (either along the internal or external surface of the eyestay) and through a shoelace guide or elongate eyelet 902 to a distal end 905*b* thereof. The shoelace 904 is then looped around the shoelace guide 902 to a proximal end 905*a* of the shoelace guide 905*b* and reinserted through the shoelace guide 902. In this manner a webbing loop 906 is created relative to the shoelace guide 902. The above process is repeated for each of the shoelace guides 902 positioned along the eyestay of the shoe to create webbing loops 906 relative thereto.

In some embodiments, the shoelace 904 may traverse across the shoe's tongue at a distal end of the eyestay and the above process may be repeated for one or more of the shoelace guides 902 positioned along the opposite eyestay of the shoe so that a single shoelace 904 is used to form essentially all the lacing system's guides. In other embodiments, separate shoelaces, or a combination of shoelaces, may be run along each of the eyestays so that more than one shoelace is used to form the webbing guides described above.

In some embodiments, the proximal end 905*a* and the distal end 905*b* of the shoelace guide 902 may be replaced by individual eyelets (not shown) positioned longitudinally along the eyestay, and the webbing loops 906 may be created relative to the eyelets 905*a* and 905*b*. For example, the shoelace 904 may be run longitudinally along the eyestay, through a distal eyelet 905*b*, and looped around to and through a proximal eyelet 905*a* to create a webbing loop 906 relative to the proximal and distal eyelets, 905*a* and 905*b*. In some embodiments, a portion of the webbing loops 906 may be folded backward to create triangular webbing guides 907 as described above. As also shown in FIG. 9A, opposing ends of the shoelace 904 may be tied in knots 908 to prevent the opposing ends of the shoelace 904 from being pulled through proximal eyelets of the shoe.

Figure 9C:
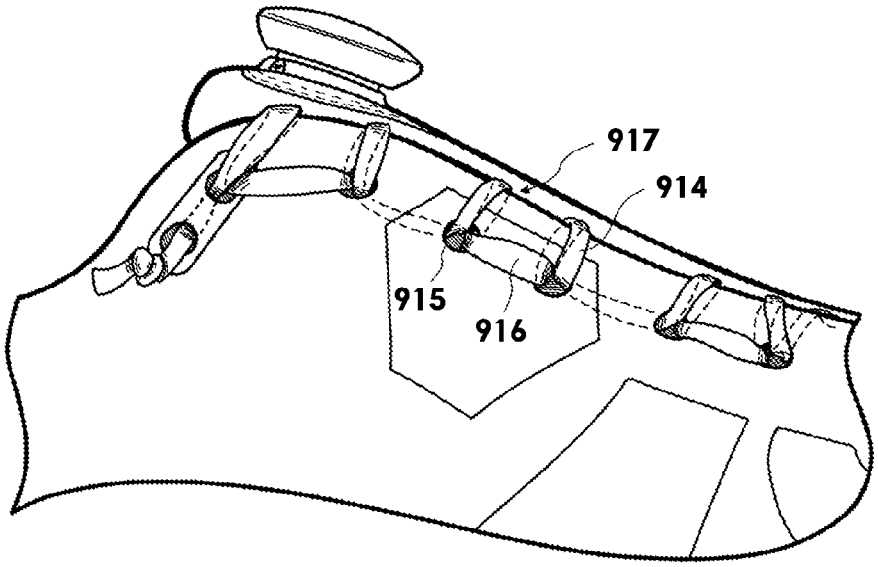
Figure 9D:
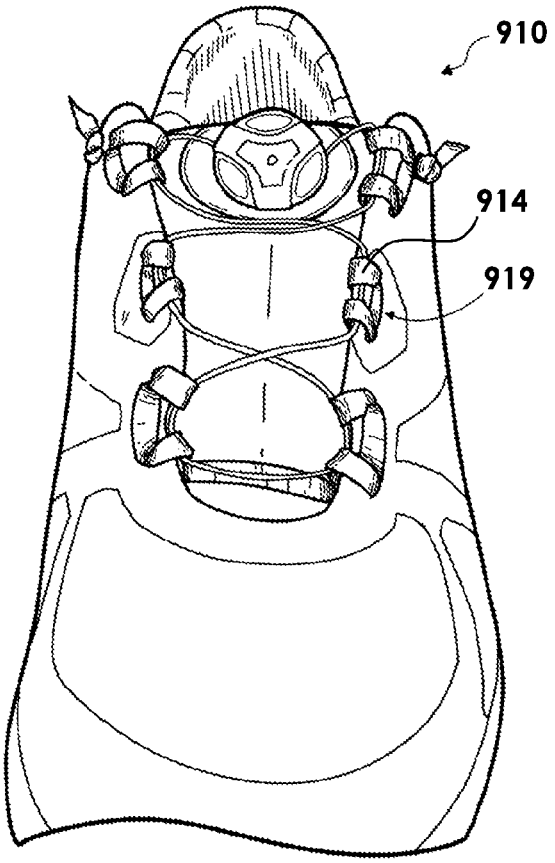

Referring now to FIGS. 9C-D, illustrated is another embodiment 910 of using a shoelace 914 to create webbing guides for the lacing system. Specifically, the shoelace 914 may be run longitudinally along the eyestay of the shoe until an eyelet 915 is encountered. When an eyelet 915 is encountered, the shoelace 914 may be inserted through the eyelet 915, wrapped around an edge of the eyestay, and back through the eyelet 915 as shown in FIG. 9C to create a shoelace loop 917 adjacent the eyelet 915. The shoelace loop 917 created adjacent the eyelet 915 may serve as a webbing guide for the lacing system's lace. The arrangement described in relation to FIGS. 9C-D typically results in an alternating lace pattern in which the shoelace 914 runs longitudinally along an outer surface of the eyestay between adjacent eyelets 915 and then runs longitudinally along an inner surface of the eyestay between adjacent eyelets 915.

The above process may be repeated each time an eyelet 915 is encountered so that a shoelace loop is created adjacent to each or some of the eyelets 915 as desired. As with the shoelace configuration described in FIGS. 9A-B, in some embodiments a single shoelace 914 may be used to create all or a portion of the webbing guides; or separate shoelaces may be used to create the webbing guides of the shoe. Further, in some embodiments each shoelace loop 917 may function as a single webbing guide in a dual or paired webbing guide arrangement 919. As shown in FIG. 9D, the shoelace 914 may be run longitudinally along the outer surface of the eyestay 916 between webbing guides that form the dual or paired webbing guide arrangement 919. In other lacing patterns, the lace may run through individual webbing loops.

Figure 9E:
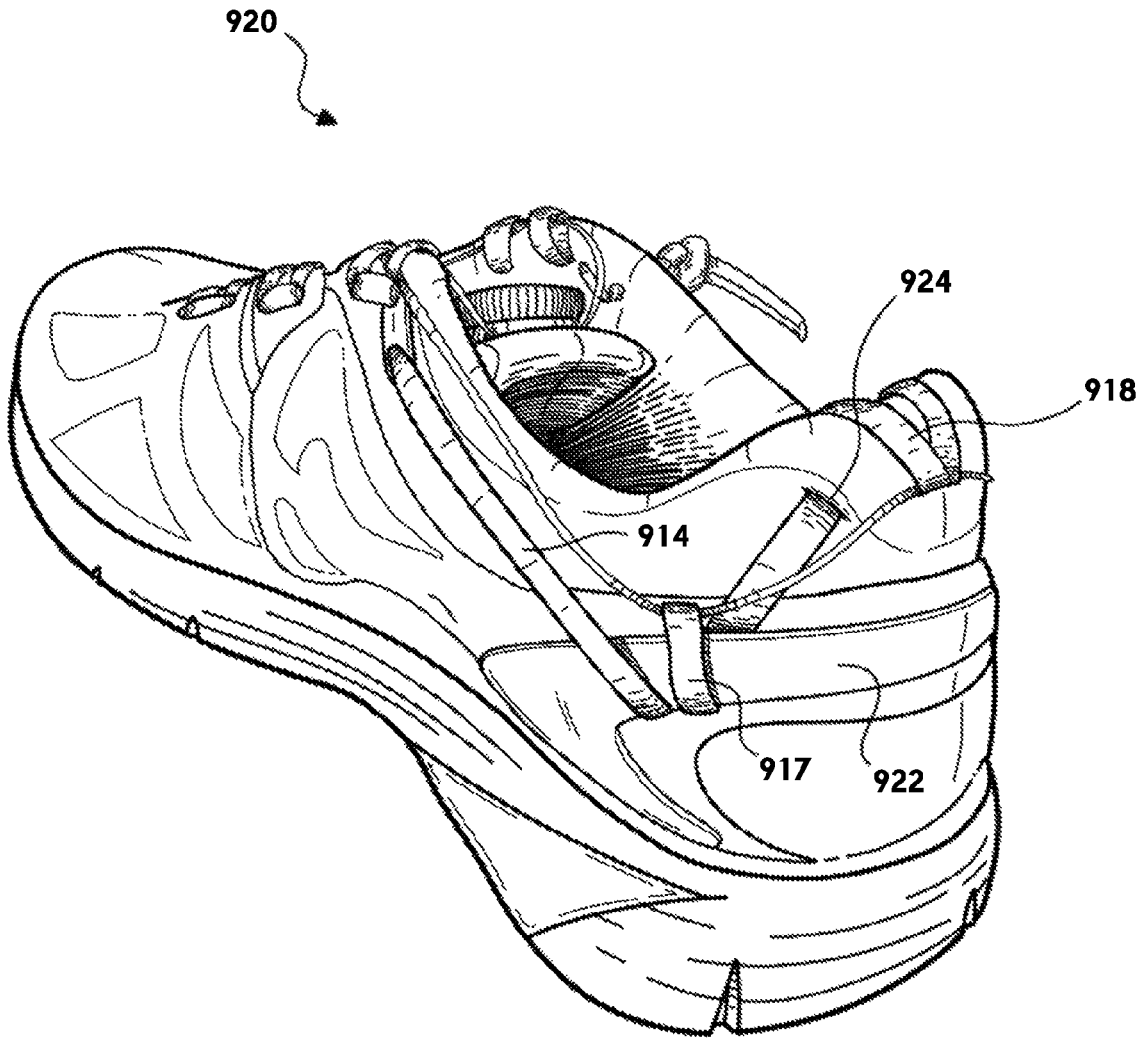

Referring now to FIG. 9E, illustrated is another embodiment 920 in which a shoelace 914 is used to create webbing guides for the lacing system. The shoelace arrangement along the eyestay of the shoe of FIG. 9E is similar to that described in relation to FIGS. 9C-D. FIG. 9E differs from FIGS. 9C-D in that the shoelace 914 is also wrapped around the collar of the shoe to create additional webbing guides near the shoe's collar. For example, in some embodiments the shoelace 914 may be wrapped around a feature 922 of the shoe's collar to create a first heel webbing guide 917 and/or may be inserted through a slot 924 and wrapped around the heel to create a second heel webbing guide 918. The lacing system's lace may be inserted through the first and/or second heel webbing guides as desired. In this manner, the lace may be wrapped around the shoe's collar in addition to traversing the shoe's tongue to provide an additional closure force that closes the shoe, such as to compress a collar of the shoe about the user's ankle to create greater heel hold. In some embodiments, the feature 922 and/or slot 924 may be pre-existing features of the shoe, or may be cut or fabricated into a shoe. In any embodiment, the shoelace 914 may be wrapped around a heel or collar portion of the shoe so as to retrofit the shoe and allow the lace to be wound around the shoe's collar.

In some embodiments, the shoelace may be run longitudinally along the eyestay of the shoe until an eyelet is encountered. The shoelace may then be inserted through the eyelet and wrapped twice there around to create two shoelace loops that are used as webbing guides for the lace of lacing system. The shoelace may then be reinserted into the eyelet and run longitudinally along the eyestay to an adjacent eyelet. The above described process may be repeated for one or all of the eyelets positioned along the eyestay to create webbing guides for the lacing system's lace as desired. In some embodiments, a single lace may be run along each eyestay to create all of the webbing guides for the lacing system, or multiple laces may be used as desired.

Each shoelace loop of the two shoelace loops created by the above mentioned process may function as a single webbing guide in a dual or paired webbing guide arrangement. For example, each eyelet may have one shoelace loop that functions with a shoelace loop of a proximally positioned eyelet to form a dual or paired webbing guide arrangement therewith, while the second shoelace loop functions with a shoelace loop of a distally positioned eyelet to form a dual or paired webbing guide arrangement therewith. In this manner the number of lace crossings across the shoe's tongue may be increased such as to increase the tension applied by the lacing system. In some embodiments, one or more of the eyelets may only have a single shoelace loop so that the overall lacing system structure includes a combination of single and double shoelace loop configurations.

Figure 9F:
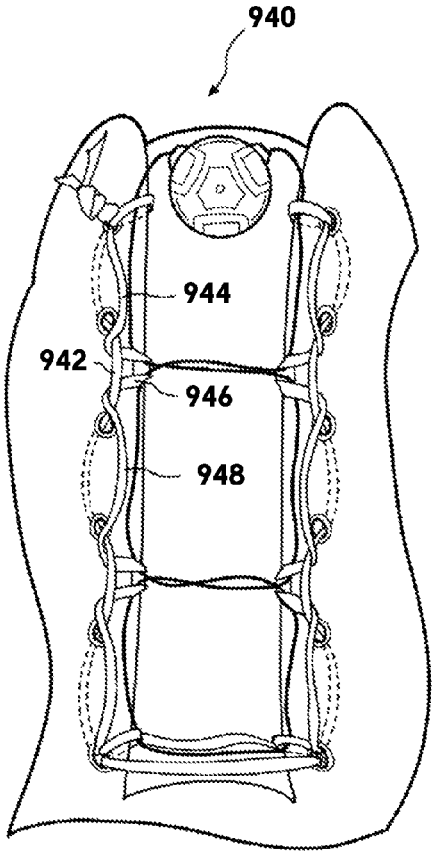
Figure 9G:
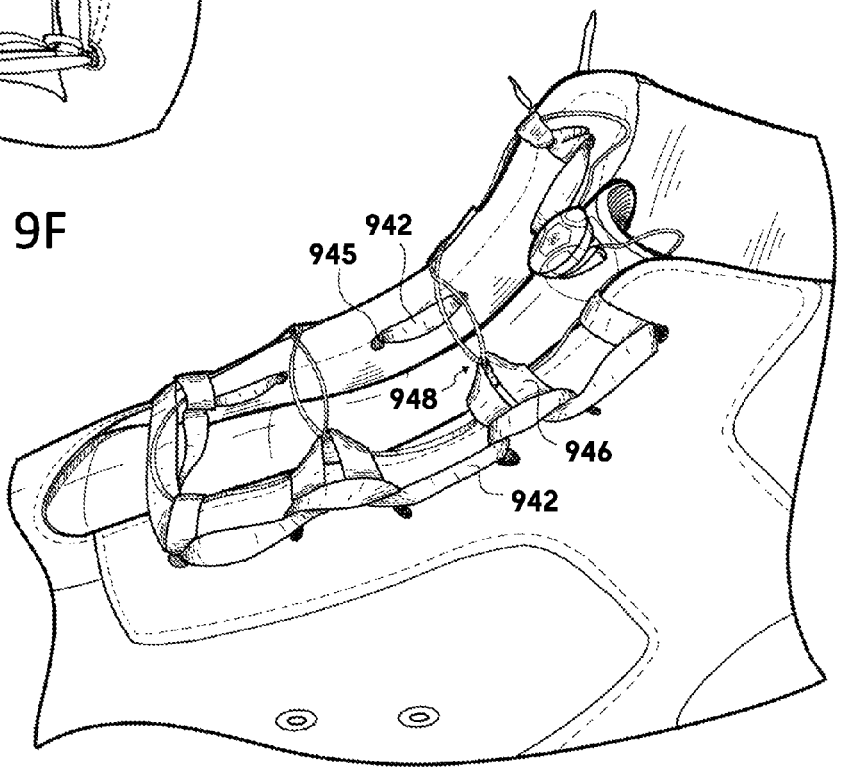

Referring now to FIGS. 9F-G, illustrated is yet another embodiment 940 of using a shoelace 944 to create webbing guides for a lacing system. In this embodiment, the shoelace 944 is run along the eyestay of the shoe twice in order to create the webbing guides. For example, the shoelace 944 is run longitudinally along the eyestay and weaved in and out of the eyelets 945 positioned longitudinally along the eyestay to create a first lace path 942 about the shoe's tongue. The first lace path 942 has alternating sections of the shoelace 944 running along the inner surface and outer surface of the eyestay between adjacent eyelets 945. The lace 944 is then run back along the eyestay to create a second lace path 948 about the shoe's tongue. The lace 944 of the second lace path 948 is pulled under the sections of the shoelace 944 of the first lace path 942 that run along the outer surface of the eyestay to create looped portions 946 that function as the lacing system's webbing guides.

In this arrangement, the looped portions 946 of the second lace path 948 form triangular webbing guides that direct the lace laterally across the shoe's tongue and longitudinally along the eyestay as described herein. In some embodiments, the lace 944 may be looped around a distal eyelet 945 of the eyestay to create a shoelace loop as previously described.

In some embodiments, a single shoelace 944 may be run longitudinally along both eyestays of the shoe twice in order to create both the first lace path 942 and the second lace path 948. In other embodiments two or more laces may be used to create the first lace path 942 and second lace path 948 as desired. The lace paths and webbing guides created in accordance with the description of FIGS. 9F-G provide robust webbing guides for the lacing system while also allowing formation of the triangular webbing guides that provide the various advantages described herein. In some embodiments, one or more of the shoelace patterns described in relation to FIGS. 9A-9G, or any combination thereof, may be used to create varied webbing guides arrangements.

Figure 10:
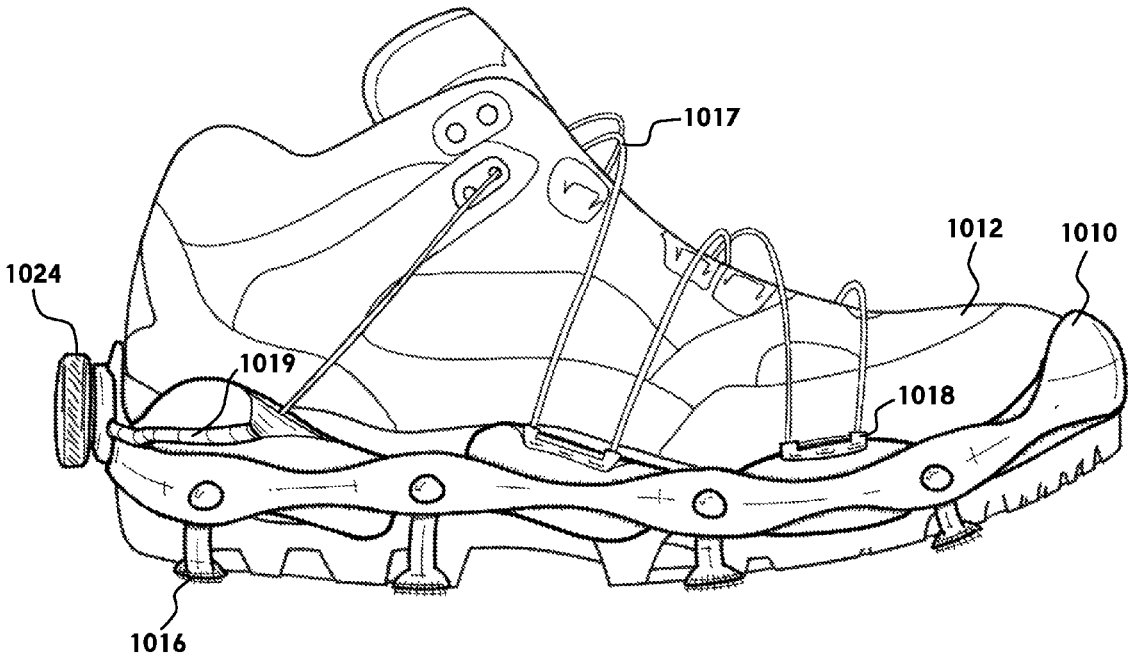
FIG. 10 illustrates an embodiment of a frame member for retrofitting a shoe to include a tightening system.
Figure 11A:
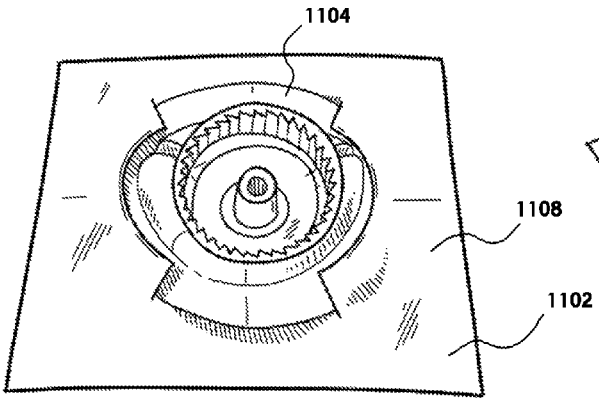
FIGS. 11A-D illustrate an embodiment of a panel that may be coupled with a tightening mechanism for retrofitting a shoe or article.
Figure 11B:
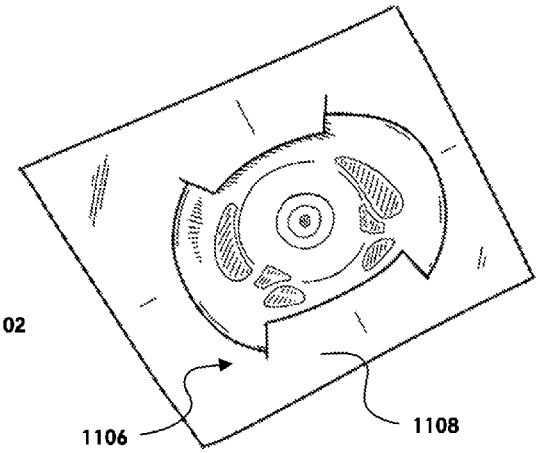
Figure 11C:
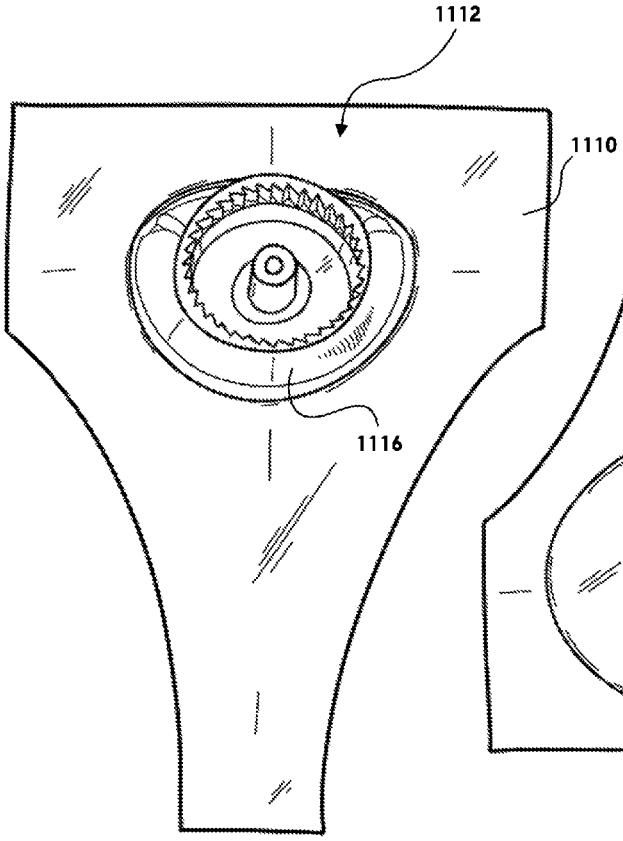
Figure 11D:
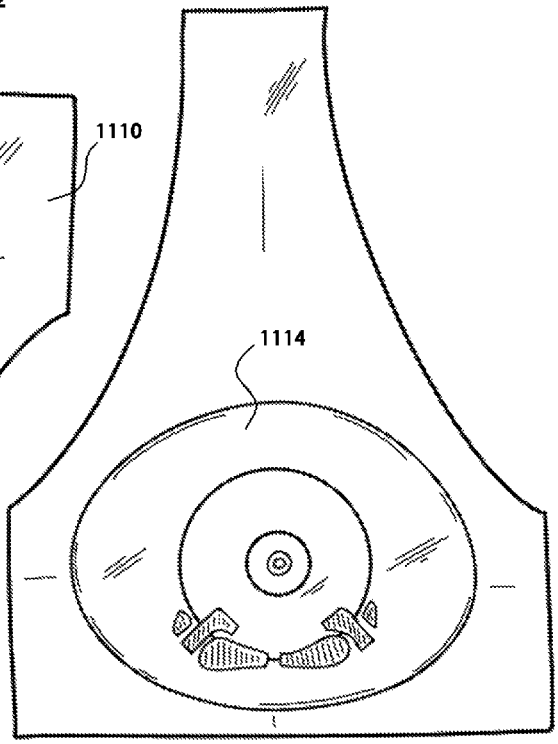

Referring now to FIG. 10, illustrated is an embodiment of retrofitting a shoe so as to include or be usable with a lacing system. The embodiment of FIG. 10 illustrates a lacing system that may be easily fit about a shoe and used to close the shoe. Specifically, a retrofit frame 1010 may be coupled with a shoe 1012. Frame 1010 includes a plurality of straps 1016 that extend from a main body of frame 1010 and around a sole of the shoe 1012. Frame 1010 is designed to fully wrap around the shoe 1012 so that a front portion of the frame 1010 wraps around the shoe's toe while a rear portion of the frame 1010 wraps around the shoe's heel. The reel assembly 1024 is coupled with the rear portion of frame 1010 so that the reel assembly 1024 is positioned adjacent the heel of the shoe. The frame 1010 also includes a plurality of guides 1018 that direct lace 1017 across the upper portion and tongue of the shoe 1012. Tubing 1019 may also be coupled with frame 1010 to direct the lace 1017 between portions of the shoe 1012 and/or frame 1010 as desired.

In another embodiment, a frame may be configured to be fit over the outer surface of the shoe. The retrofit frame may include an oval-shaped main body that wraps around the shoe from near the toe region of the shoe to the heel of the shoe. The retrofit frame may also include one or more straps that extend from the frame's main body lace and that fit under the shoe's sole to prevent the retrofit frame from being pulled off the shoe. The retrofit frame and the strap may be designed to allow the shoe's toe region to be inserted between the strap and an upper portion of the retrofit frame. In some embodiments, to more fixedly couple the retrofit frame about the shoe, the lace may be inserted through one or more eyelets of the shoe. In other embodiments, a shoelace may be run along the eyestay to create one or more webbing guides through which lace is inserted to fixedly couple the retrofit frame about the shoe.

In some embodiments, the frame of FIG. 10 may be made of a rubber or otherwise elastic material so as to allow the frames to be stretched over and about the shoe. The rubber or elastic material may also allow the frames to conform to the shape and size of the shoe. An inner surface of the frames may include a tacky or otherwise sticky material that helps to attach the frames to the shoe. The straps of the shoe may likewise be made of a rubber or elastic material to help the straps stretch and conform to the shoe; or the straps may be made of a relatively inelastic material so as to pull the frame tight and closed against the shoe. In some embodiments, a bottom surface of the straps of the frames may be contoured, shaped, or otherwise include components that allow the straps to perform one or more functions, such as gripping against slippery surfaces (e.g. ice), providing tread for hiking, ice climbing, running, and the like. In still another embodiment, the straps of the frame may be removable so that other straps that are designed for specific activities may be coupled with the frame when a user is planning to engage in a specific activity. The frames described above may provide increased support for footwear, which may be beneficial in certain activities or sports.

FIGS. 11A-D illustrate another embodiment in which a shoe may be retrofit to include the reel assembly. In a first embodiment, a panel 1102, which is typically made of a fabric or plastic material, may include a plurality of cuts 1106 that create one or more flaps 1108 that may be used to couple the reel assembly to the panel 1102. For example, a flange 1104 of the reel assembly may be inserted under one or more of the flaps 1108 created in the panel 1102. In one embodiment, opposite edges of the flange 1104 may be inserted under opposing flaps 1108 to couple the reel assembly with the panel 1102. In one embodiment, the flange 1104 may be stitched to the panels 1108 to permanently affix the reel assembly thereto. In another embodiment, the panels 1108 may be adhesively bonded or mechanically fastened to the flange 1104.

In another embodiment, a panel 1110 may include an aperture 1112 that is sized larger than a top portion of the reel assembly 1116, but sized smaller than the flange portion 1114 of the reel assembly. The reel assembly 1116 may be inserted within the aperture 1112 so that the top portion extends beyond a top surface of the panel 1110 while the flange 1114 is positioned behind the panel 1110. A top surface of the flange 1114 (not shown) may be adhesively bonded a bottom surface of the panel 1110 to affix the reel assembly thereto. In other embodiments, the flange 1114 may be stitched or mechanically fastened to the panel 1110.

In some embodiments, either of the panels, 1102 and 1110, maybe fabric or plastic components of the shoe, such as a tongue or heel portion of the shoe. The aperture 1112 or panels 1108 may be cut into the shoe material to allow the flange of the reel assembly to be coupled with the shoe. In other embodiments, the panels, 1102 or 1110, may be fabric or plastic components separate from the shoe that may be subsequently mounted or coupled with the shoe, such as via adhesive bonding, stitching, mechanically fastening, heat welding, and the like.

Figure 12A:
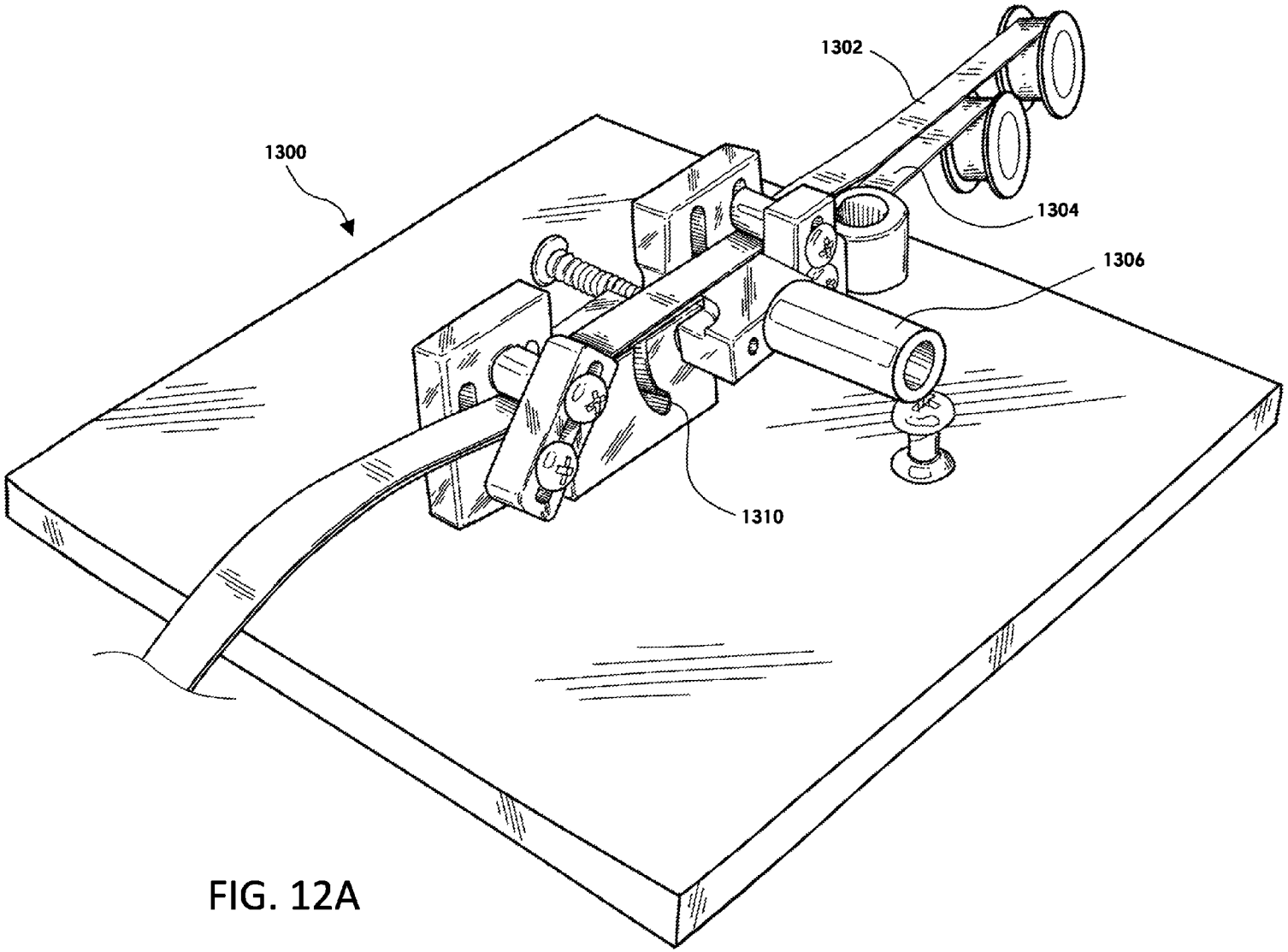
FIGS. 12A-D illustrate various embodiments of an apparatus for manufacturing the guides illustrated in FIGS. 8K-L.
Figure 12B:
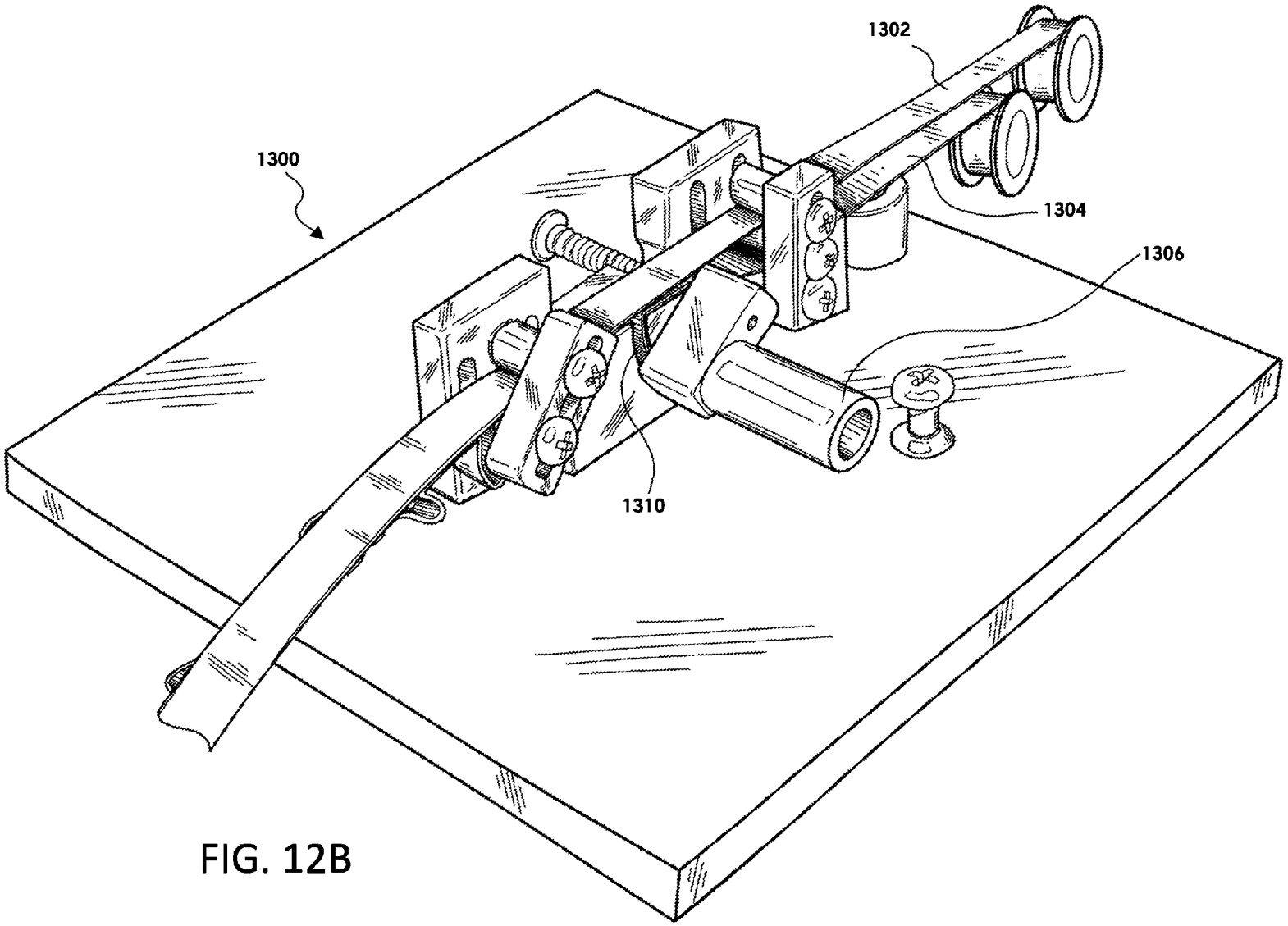
Figure 12C:
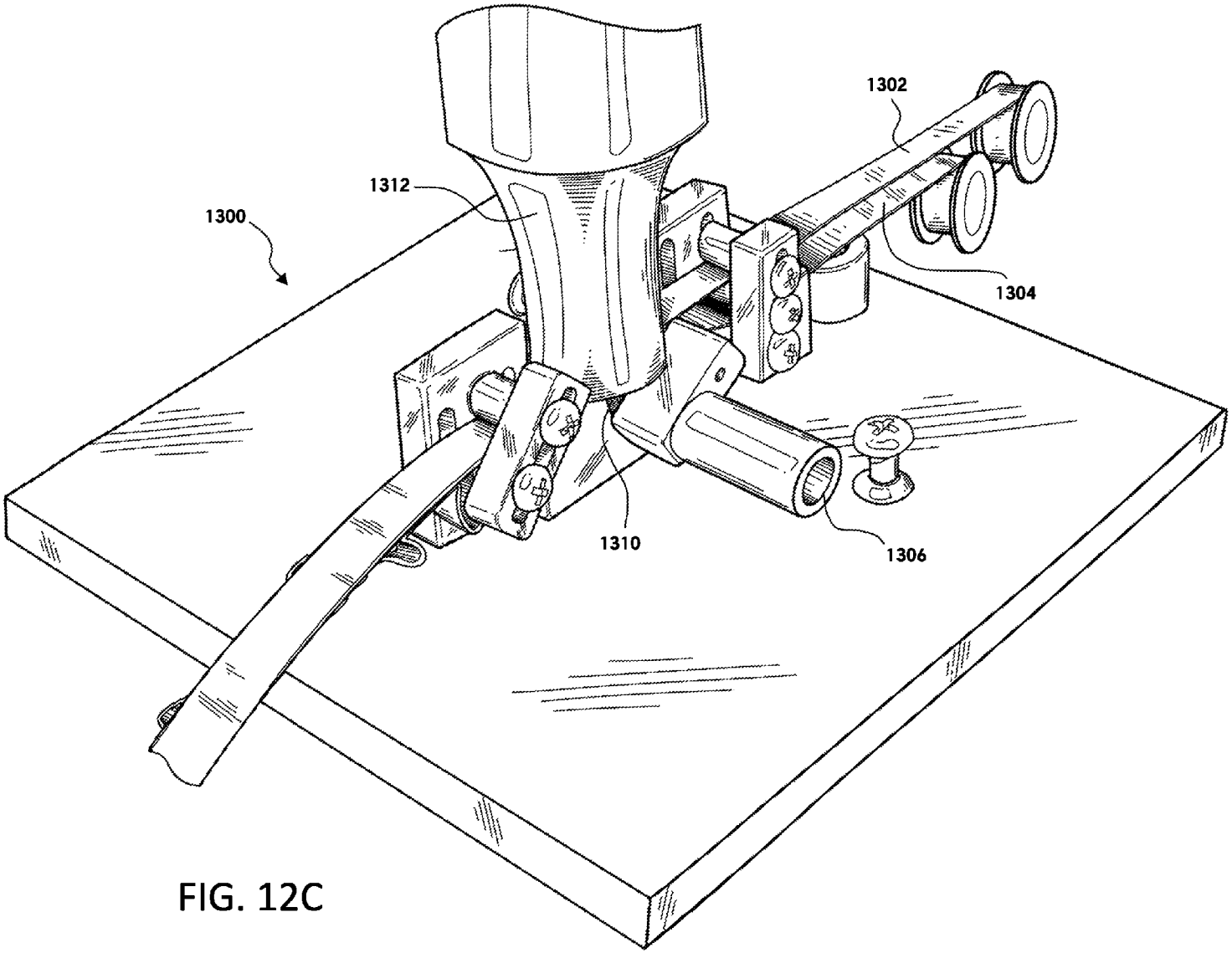
Figure 12D:
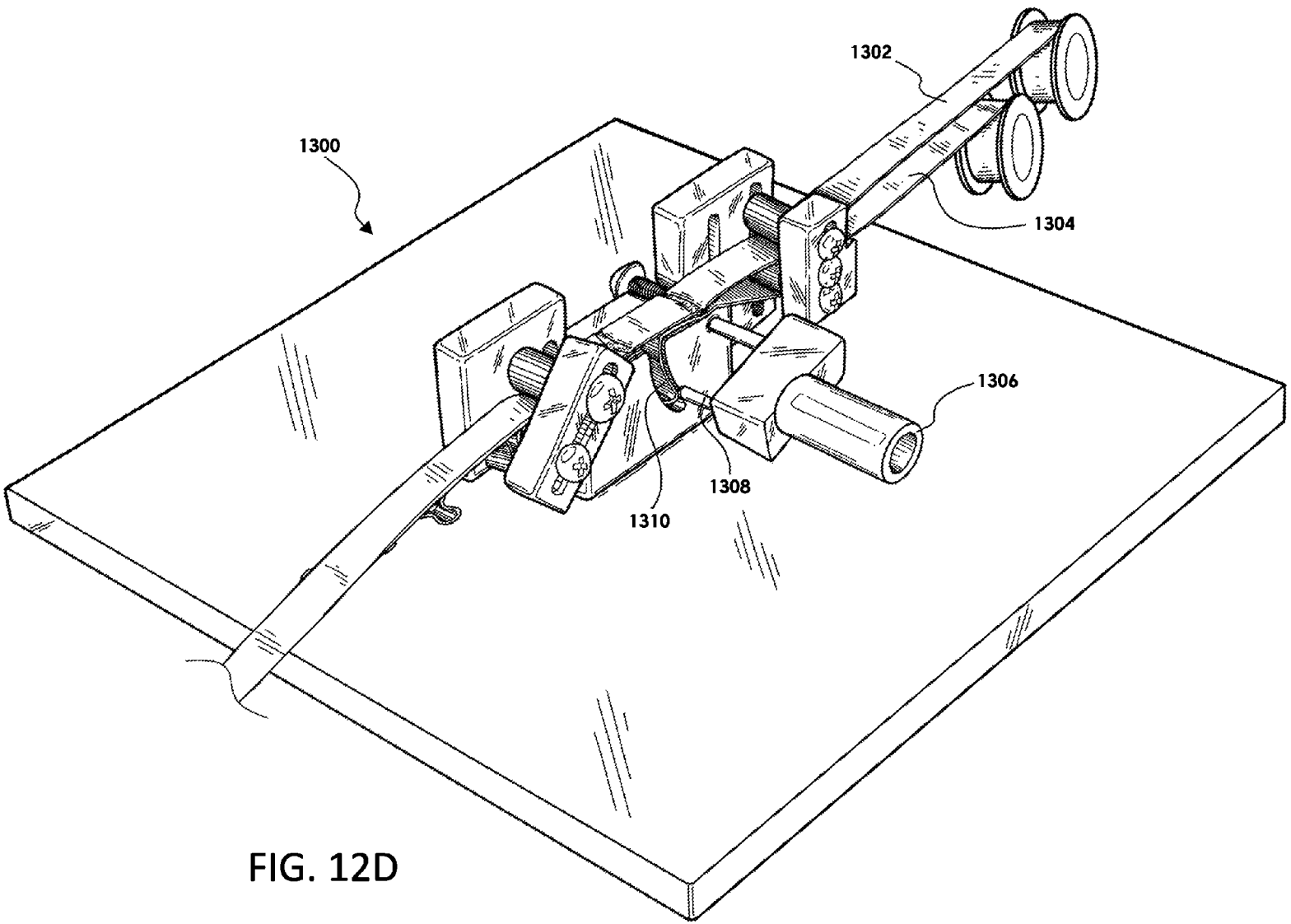

Referring now to FIGS. 12A-D, illustrated is an apparatus for manufacturing the soft guides 850 illustrated in FIGS. 8K-L. FIG. 12A illustrates one embodiment of an apparatus 1200, for producing the soft guides 850. The apparatus 1200 receives a first strip of fabric 1202 and a second strip of fabric 1204 at a first end. The first strip 1202 and second strip 1204 can be received within the first end of apparatus 1200 in a roughly parallel orientation. As shown in FIG. 12D, a pivoting arm 1206 can include a member 1208 that is inserted between the first strip 1202 and the second strip 1204. As shown in FIG. 12B, the pivoting arm 1206 is rotated so that the member 1208 slides within a slot 1210. Sliding of the member 1208 within the slot 1210 pushes the second strip 1204 into the slot 1210 to form the U-shaped or loop portion 860 of soft guide 850.

As shown in FIG. 12C, a sonic welder 1212 or other device is used to secure the first strip 1202 and the second strip 1204 together to form the guide 850 from the two pieces of material. In FIG. 12D, the sonic welder 1212 is removed, and the pivoting arm 1206 is pulled away from the apparatus 1200 to disengage the member 1208 from the second strip 1204. The pivoting arm 1206 can then be rotated to its beginning position and the member 1208 reinserted between the strips 1202 and 1204. In some embodiments, the apparatus 1200 may also include a punch or blade to cut each of the guides 850 from the strips 1202 and 1204 after they have been welded. A punch can be configured to create a square, circular, elliptical, or other shaped flange around the guide 850.

Any of the aforementioned retrofitting components may be manufactured and sold as a part of a kit that users may purchase to retrofit their own shoes. In other embodiments, the retrofitting may be done by one or more individuals, such as in a designated booth, before a sporting event or as part of a designated event or activity. In other embodiments, the lace used with the retrofit system may be color-coded or otherwise configured to indicate a durability of the lace and/or a specific use of the lace (i.e., use of the lace for a given activity). The reel assembly and/or guides may likewise be color-coded or otherwise configured to indicate a durability of these components and/or a specific use thereof. The user may select an appropriate lace, reel assembly, and/or guide for a given activity and retrofit their shoes to include appropriate lacing system components. In some embodiments, colored lace may be selected to match, complement, or contrast with the colors of the shoe.

In some embodiments, a shoe may come with components of the lacing system prebuilt into the shoe. For example, a bayonet or housing may be prebuilt into the shoe to allow the reel assembly to be easily snapped into place or otherwise coupled with the shoe via the bayonet or housing. Similarly, a guide may likewise be snapped or otherwise coupled into place via a bayonet or other component that is prebuilt into the shoe. In such embodiments, the components of the lacing system (e.g., the reel assembly, guides, and/or lace) may be manufactured and sold in packages based on a usage or application of the lacing system. For example, the reel assembly, guide, and/or lace packages may be designated as "dirt usage", "road usage", "water usage", and the like. The reel assembly, guides, and lace sold in such packages may be designed specifically for such applications and the user may be able to quickly and easily swap the components of the lacing system based on a usage of the shoe.

In still other embodiments, the shoe may come with prefabricated holes punched into and/or adjacent the tongue or eyestay so as to allow the components of the lacing system (e.g., real assemblies, guides, and the like) to be coupled with the shoe. In other embodiments, magnets or metal pieces may be positioned in or adjacent to the tongue or eyestay to allow coupling of the lacing system components therewith.

Some existing shoes contain various combination of webbing guides, plastic guides, metal guides, and the like. In such shoes, some existing lace guide features may be used in combination with the techniques described herein.

Having described several embodiments, it will be recognized by those of skill in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included.

As used herein and in the appended claims, the singular forms "a", "an", and "the" include plural referents unless the context clearly dictates otherwise. Thus, for example, reference to "a process" includes a plurality of such processes and reference to "the device" includes reference to one or more devices and equivalents thereof known to those skilled in the art, and so forth.

Also, the words "comprise," "comprising," "include," "including," and "includes" when used in this specification and in the following claims are intended to specify the presence of stated features, integers, components, or steps, but they do not preclude the presence or addition of one or more other features, integers, components, steps, acts, or groups.

What is claimed is:

1. A lacing system comprising:

a first guide member positionable on a first side of a footwear;

a second guide member positionable on a second side of the footwear opposite the first side;

a tension member guided by the first guide member and the second guide member along a path about the footwear, the tension member being tensionable so as to tighten the footwear about a foot; and a tensioning mechanism coupleable with the footwear and removable therefrom, the tensioning mechanism being operable with the tension member to maintain a tension of the tension member and thereby maintain a tightness of the footwear about the foot;

wherein the tensioning mechanism is coupled with a first end of an elongate panel member that is positionable along a tongue of the footwear between opposing sides of the footwear; and wherein a second end of the elongate panel member includes a support member that extends roughly orthogonally therefrom, the support member being coupleable with the opposing sides of the footwear to stabilize the elongate panel member about the tongue.

2. The lacing system of claim 1, wherein the support member is moveable proximally and distally relative to the second end of the elongate panel member so as to accommodate footwear of various shape and size.

3. The lacing system of claim 2, wherein the second end of the elongate panel member is trimmable and opposing ends of the support member are trimmable to facilitate in positioning of the elongate panel member along the footwear's tongue and coupling of the support member with the opposing sides of the footwear's tongue.

4. The lacing system of claim 1, wherein either or both the first guide member or the second guide member comprises a base member and an upper member attached to the base member so as to form a loop, the upper member being sufficiently flexible so as to be insertable through an eyelet of the footwear such that the upper member is positioned on one side of the eyelet while the base member is positioned on an opposite side of the eyelet and the base member being configured to prevent the guide member from being pulled through the eyelet.

5. The lacing system of claim 1, wherein the first guide member and the second guide member are formed via a fabric strip of material that is weaved along a tongue and through eyelets of the footwear to form one or more loop portions, the tension member being guided along the path about the footwear via insertion of the tension member through the loop portions.

6. The lacing system of claim 1, wherein prior to coupling the tensioning mechanism with the footwear, the tension member is fixedly attached to the tensioning mechanism and the first and second guide members are slidingly coupled with the tension member such that the lacing system is an all-in-one unit that is coupleable with the footwear.

7. The lacing system of claim 1, wherein either or both the first guide member or the second guide member comprise a fabric loop having opposing end that are insertable within adjacent eyelets of the footwear such that a middle portion of the fabric loop is positioned below the eyelets while opposing looped ends of the fabric loop are positioned above the eyelets.

8. The lacing system of claim 1, wherein the first guide member and/or the second guide member includes:

a base member; and an upper member attached to the base member so as to form a loop for routing the tension member after the tension member is inserted there through, the upper member being sufficiently flexible so as to be positioned through an eyelet of the article and the base member being sufficiently rigid so as to restrict the base member from being pulled through the eyelet;

wherein when the upper member is inserted through the eyelet, the upper member is positioned on one side of the eyelet while the base member is positioned on an opposite side of the eyelet.

9. The lacing system of claim 8, wherein the upper member is a fabric material loop or strip.

10. The guide member of claim 9, wherein the base member is a rigid material.

11. The lacing system of claim 9, wherein the base member is a fabric material strip having a shorter longitudinal length than a longitudinal length of the upper member's fabric material strip, and wherein opposing ends of the fabric material strips are coupled together with a central portion of the upper member's fabric material strip extending from the base member to form the loop.

12. The lacing system of claim 11, wherein the coupled opposing ends form flanges that extend roughly orthogonally from the upper material's loop, each flange having a longitudinal length of between 3 and 6 mm.

13. The lacing system of claim 8, wherein the upper member is attached to the base member such that a portion of the loop directly adjacent the base member comprises a gap having a width of between 3 and 5 mm.

14. The lacing system of claim 8, wherein the upper member's loop extends above the base member by between about 8 and 12 mm.

15. The lacing system of claim 8, further comprising a backing material that is positionable atop the base member after the upper member is positioned through the eyelet, the backing material being couplable with the article to conceal the base member thereunder.

16. A removable tightening device comprising:

a tensioning mechanism that is removably coupleable with an article, the tensioning mechanism being operable with a tension member to maintain a tension of the tension member, the tension member being guided along a path about the article via one or more guide members and being tensionable to tighten the article;

wherein the tensioning mechanism is coupled with an elongate panel member that is positionable about the article between opposing sides of the article; and wherein a support member is coupled toward an end of the elongate panel member opposite the tensioning mechanism, the support member being coupleable with the opposing sides of the article to stabilize the elongate panel member.

17. The removable tightening device of claim 16, wherein the one or more guide members comprise a base member and an upper member attached to the base member so as to form a loop, the upper member being sufficiently flexible so as to be insertable through an eyelet of the article such that the upper member is positioned on one side of the eyelet while the base member is positioned on an opposite side of the eyelet, the base member being configured to prevent the one or more guide members from being pulled through the eyelet.

18. The removable tightening device of claim 16, wherein prior to coupling the tensioning mechanism with the article, the tension member is fixedly attached to the tensioning mechanism and the one or more guide members are slidingly coupled with the tension member.

19. A removable device for tightening an article comprising:

a tensioning mechanism coupleable with the article and removable therefrom, the tensioning mechanism being operable to tension a tension member to tighten the article and to maintain the tension of the tension member so as to maintain a tightness of the article, the tension member extending along a lace path about the article and being guided along the lace path by one or more guide members of the article;

wherein the tensioning mechanism is coupled with an elongate panel member that is positionable about the article between opposing sides of the article; and wherein a support member is coupled toward an end of the elongate panel member opposite the tensioning mechanism, the support member being coupleable with the opposing sides of the article to stabilize the elongate panel member.

20. A method of configuring footwear to include a removable tensioning mechanism, the method comprising:

providing footwear having:

a first guide member positioned on a first side of the footwear; and a second guide member positioned on a second side of the footwear opposite the first side;

positioning a tension member about the footwear and along a path so that the tension member is guided by the first guide member and the second guide member along the path, the tension member being tensionable to tighten the footwear;

coupling a tensioning mechanism with the footwear, the tensioning mechanism being operable with the tension member to maintain a tension of the tension member and thereby maintain a tightness of the footwear, the tensioning mechanism being coupled with an elongate panel member;

positioning the elongate panel member along a tongue portion of the footwear between opposing sides of the footwear; and coupling a support member of the elongate panel member with the opposing sides of the footwear to stabilize the elongate panel member, the support member being coupled toward an end of the elongate panel member opposite the tensioning member.

21. The method of claim 20, further comprising adjusting the support member proximally or distally about the elongate panel member so as to accommodate a shape and/or size of the footwear.

22. The method of claim 21, further comprising:

trimming the end of the elongate panel member to facilitate in positioning the elongate panel member along the footwear's tongue; or trimming opposing ends of the support member to facilitate in coupling of the support member with the opposing sides of the footwear's tongue.

23. The method of claim 20, wherein either or both the first guide member or the second guide member comprises a base member and an upper member attached to the base member so as to form a loop, and wherein the method further comprises inserting the upper member through an eyelet of the footwear such that the upper member is positioned on one side of the eyelet while the base member is positioned on an opposite side of the eyelet.

24. The method of claim 20, further comprising:

weaving a shoelace along a tongue portion of the footwear and through one or more eyelets to form one or more loop portions, wherein the first guide member and the second guide member are formed from the one or more loop portions; and inserting the tension member through the one or more loop portions such that the tension member is guided along the path about the footwear.

25. A method of removably coupling a tensioning mechanism with an article comprising:

coupling a tensioning mechanism with an article such that the tensioning mechanism is removable from the article;

coupling the tensioning mechanism with a tension member, the tension member being guided along a path about the article via one or more guide members and being tensionable to tighten the article and the tensioning mechanism being operable to maintain a tension of the tension member and thereby maintain a tightness of the article, the tensioning mechanism being coupled with an elongate panel member;

positioning the elongate panel member along the footwear; and coupling a support member of the elongate panel member with opposing sides of the article to stabilize the elongate panel member about the article, the support member being coupled toward an end of the elongate panel member opposite the tensioning member.

26. The method of claim 25, wherein either or both the first guide member or the second guide member comprise a base member and an upper member attached to the base member so as to form a loop, and wherein the method further comprises inserting the upper member through an eyelet of the article such that the upper member is positioned on one side of the eyelet while the base member is positioned on an opposite side of the eyelet.

27. The method of claim 25, wherein prior to coupling the tensioning mechanism with the article, the tension member is fixedly coupled with the tensioning mechanism and the one or more guide members are slidingly coupled with the tension member, and wherein the method further comprises coupling the one or more guide members with the article.

28. The method of claim 27, wherein coupling the one or more guide members with the article removably couples the one or more guide members, tension member, and tensioning mechanism with the article.

29. The method of claim 27, wherein coupling the one or more guide members with the article comprises inserting a proximal end of the one or more guide members through a respective eyelet of the article.

30. The method of claim 25, wherein the article comprises footwear.

31. The method of claim 25, wherein at least one of the one or more guide members includes:

a base member, the base member being sufficiently rigid so as to restrict the base member from being pulled through an eyelet of the article; and an upper member attached to the base member so as to form a loop for routing the tension member after the tension member is inserted there through, the upper member being sufficiently flexible so as to be positioned through the eyelet of the article such that when the upper member is inserted through the eyelet, the upper member is positioned on one side of the eyelet while the base member is positioned on an opposite side of the eyelet.

32. The method of claim 31, wherein the upper member is a fabric material strip having opposing ends coupled together to form a loop, and wherein the base member is a rigid material having a pair of slots through which the fabric material is slidingly disposed.

33. The method of claim 31, wherein the upper member is a fabric material strip and the base member is a fabric material strip, the base member's fabric material strip having a shorter longitudinal length than a longitudinal length of the upper member's fabric material strip, and wherein opposing ends of the fabric material strips are coupled with a central portion of the upper member's fabric material strip extending roughly orthogonally from the base member to form the loop.

34. The method of claim 33, wherein the coupled opposing ends form flanges that extend roughly orthogonally from the upper material's loop, each flange having a width of between 3 and 6 mm.

35. The method of claim 31, wherein the upper member is attached to the base member such that a portion of the loop directly adjacent the base member comprises a gap having a width of between 3 and 5 mm.

36. The method of claim 31, wherein the upper member's loop extends above the base member by between about 8 and 12 mm.

37. The method of claim 31, further comprising:

a backing material positioned atop the base member after the upper member is positioned through the eyelet, the backing material being coupled with the article to conceal the base member thereunder.

* * * * *